US006200738B1

(12) United States Patent
Takano et al.

(10) Patent No.: US 6,200,738 B1
(45) Date of Patent: Mar. 13, 2001

(54) IMAGE FORMING METHOD

(75) Inventors: Hiroaki Takano; Hideaki Haraga; Kouji Tashiro, all of Hino (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/429,372

(22) Filed: Oct. 28, 1999

(30) Foreign Application Priority Data

Oct. 29, 1998 (JP) ..... 10-324496
Jan. 14, 1999 (JP) ..... 11-007747

(51) Int. Cl.[7] ..... G03C 7/333

(52) U.S. Cl. ..... 430/362; 430/349; 430/359; 430/360; 430/363; 430/404

(58) Field of Search ..... 430/359, 360, 430/362, 363, 404, 349

(56) References Cited

U.S. PATENT DOCUMENTS 5,747,228 * 5/1998 Bohan et al. ..... 430/362
5,804,356 * 9/1998 Cole et al. ..... 430/362
5,840,470 * 11/1998 Bohan et al. ..... 430/362

FOREIGN PATENT DOCUMENTS 0 526 931 A1 2/1993 (EP) .
0 762 201 A1 3/1997 (EP) .

* cited by examiner

*Primary Examiner*—Hoa Van Le
(74) *Attorney, Agent, or Firm*—Finnegan, Henderson, Farabow, Garrett & Dunner, L.L.P.

(57) ABSTRACT

An image forming method is disclosed, wherein a photographic element comprising a support having on at least one side thereof at least a photographic component layer containing light sensitive silver halide is subjected to exposure and photographic processing to form a dye image, in which the photographic processing is allowed to be completed, while the residual silver content in the photographic element is 5% or more; image information in the visible light wavelength region, in which the dye image has absorption, and image information in the invisible light wavelength region are read, and the obtained image information is further subjected to image processing to reduce noise due to the residual silver.

13 Claims, 6 Drawing Sheets

RELATIONSHIP BETWEEN PIXEL VALUE AND MASK SIZE RATIO
(100% = VALUE SPECIFIED BY USER)

RELATIONSHIP BETWEEN PIXEL VALUE AND THRESHOLD
(100% = VALUE SPECIFIED BY USER)

EXEMPLARY MASK FORM

IMAGE FORMING METHOD

FIELD OF THE INVENTION

The present invention relates to an image forming method of photographic recording elements and in particular, to a technique for reducing noise due to residual silver which leads to deterioration of picture quality, when digitally reading a processed photographic element containing residual silver produced along with simplified processing.

BACKGROUND OF THE INVENTION

Camera speed color photographic materials which are the most popular among photographic films comprise a unit recording blue light exposure to form a yellow dye image, a unit recording green light exposure to form a magenta dye image and a unit recording red light exposure to form a cyan dye image. In the development process of reducing silver halide grains containing latent images to silver, a developing agent is oxidized and the resulting oxidation product reacts with a dye forming coupler (or coupling) to form a dye image. Undeveloped silver halide is removed in the fixing step and developed silver is removed in the bleaching step. Obtained negative dye images are optically printed onto color photographic paper and a positive color print is obtained through developing, bleaching and fixing steps similar to the color photographic material.

The constitution of conventional color photographic films have been complicated. For example, the photographic films contain not only three kinds of light sensitive layers but also colloidal silver or dye to enhance spectral sensitivity of the three light sensitive layers, dye forming couplers, masking couplers to enhance faithful color reproducibility when printed onto a color photographic paper and fine silver particles or dye to prevent halation.

Recent popularization of personal computers and increased density of recording media have increased opportunity in which recording information of a processed photographic material is converted to electronic image information by means of an apparatus such as a film scanner and after subjected to processing such as image processing, is outputted onto silver salt paper or other recording materials. There are described in JP-A 10-111548 (herein, the term, JP-A means published and unexamined Japanese Patent Application) a color photographic recording element, an image forming method and an apparatus, which are suited for reading such image information.

Recently, further rapid access of processing is demonded. Of the processing steps, the desilvering process (including bleaching and fixing steps) accounts for about half of the total processing time.

There is also increased concern to take into account the influence of processing effluents on the environment. Specifically, in view of problems concerning processing effluent from the bleaching and fixing steps, a continued improvement for enhancing environmental suitability and shortening of the step is desired.

However, rapid access or shortening of the desilvering process results in rather large amounts of silver remaining in the processed color photographic material, producing factors deteriorating picture quality in the optical exposure onto color paper or in digitally reading by a scanner.

European Patent No. 526,931 describes rapid access of processing by digitally reading, instead of light exposure onto color paper from a processed color film. JP-A 6-266066 described a method of digitally reading information based on residual silver or developed silver, without forming dye images. JP-A 9-146247 describes a method suited both for projected light-exposure onto color paper from a processed photographic material still retaining silver and also for digital reading by means of a negative film scanner using diffuse light.

JP-A 6-28468 describes a method in which image information of the infrared wavelength region is employed in digitally reading information recorded in photographic materials for camera use. A technique employing this technique is known Digital ICE produced by Applied Science Fiction Corp, while a commercially available product known as LS 2000 is available from Nikon Corp. Thus, employment of the invisible image information (i.e., image information of the infrared wavelength region) is a technique for correcting surface defects to remove factors degrading picture quality, such as dust, flaws or mold on the surface of the photographic material. However, nothing is known with respect to a method for simplifying the processing steps by removal of residual silver employing image information of a wavelength region, in which a dye imagewise obtained upon development has no absorption, e.g., in the infrared wavelength region.

SUMMARY OF THE INVENTION

Accordingly, an object of the present invention is to provide a novel image forming method in which a silver halide photographic material for camera use is allowed to complete processing, while developed silver is retained therein; dye image information imagewise obtained therefrom is digitally read; and then silver image information retained therein is removed by using recorded image information of the wavelength region in which the dye has no absorption, thereby improving image quality, simplifying the processing steps and shortening the processing time.

Thus, the present invention is to provide a method in which after digitally reading dye image information obtained from a processed photographic material retaining silver, silver image information retained in the photographic material is removed by using recording image information within the wavelength region in which the dye has no absorption, thereby enabling to reduce noise caused by residual silver.

The present invention is also to provide rapid processing.

The object of the present invention can be accomplished by the following constitution:

an image forming method comprising the steps of:

(a) exposing a photographic element comprising a support having on at least one side thereof one or more photographic component layers including a component layer containing light sensitive silver halide and a dye forming coupler, and (b) subjecting the exposed photographic element to photographic processing to form a dye image, wherein the photographic processing is allowed to be completed, while the residual silver content in the photographic element, as defined below, is 5% or more, and the method further comprises:

(c) subjecting the processed photographic element to image processing, which comprises (c-1) reading image information in the visible light wavelength region and image information in the invisible light wavelength region corresponding to the residual silver and (c-2) subjecting the read image information to operational calculus to reduce image information due to the residual silver, Residual silver content=(Silver weight per unit area of a maximum exposure portion after subjected to the photographic processing/silver weight per unit area before subjected to the photographic processing)×100.

DETAILED DESCRIPTION OF THE INVENTION

Figure 1:
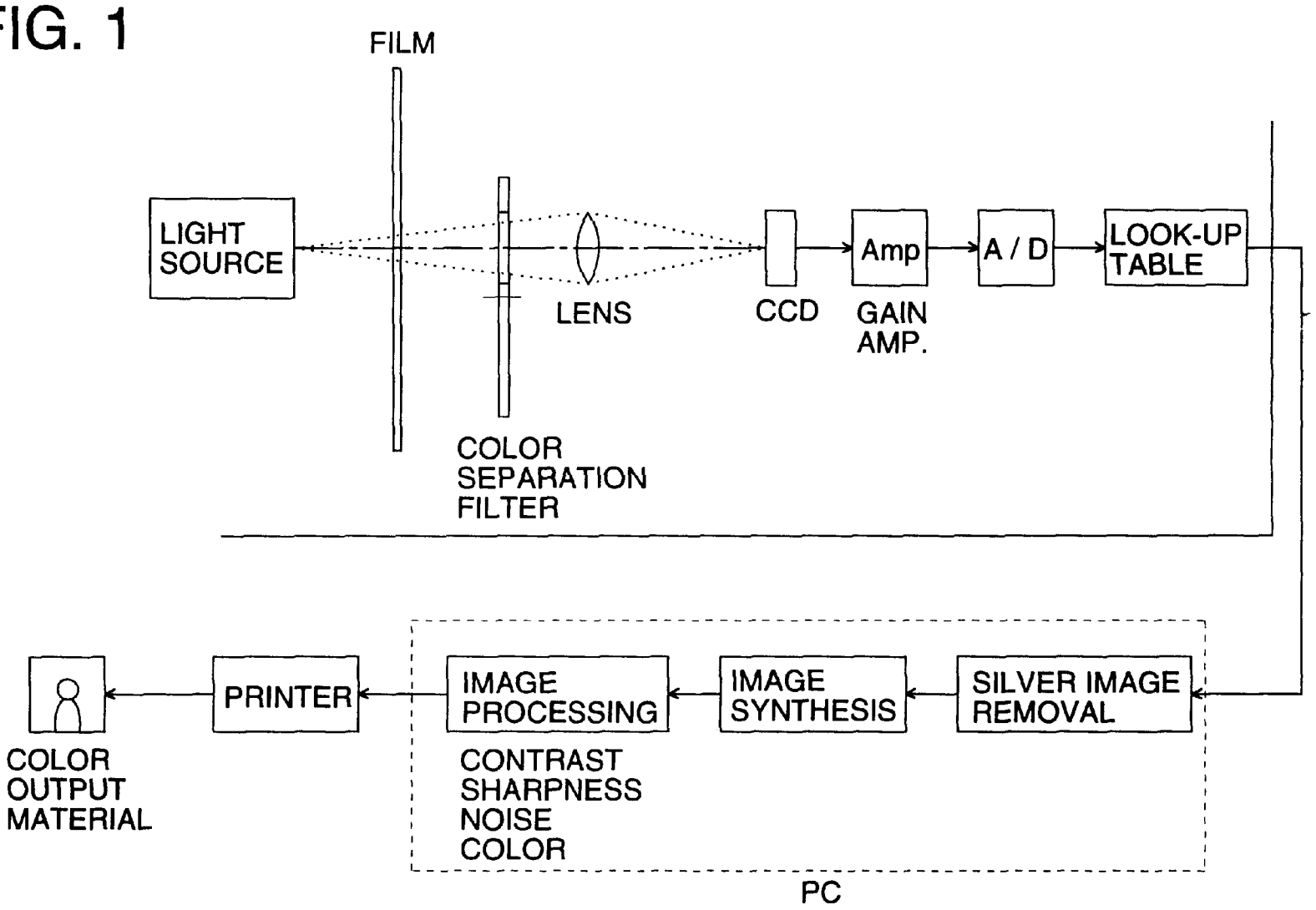
FIG. 1 shows a flow diagram illustrating one embodiment according to the present invention, comprising an image information-reading section and an image processing section.

There has not been known a novel image forming method in which in processing a photographic recording element (hereinafter, also denoted as a photographic material for camera use or a photographic material), the photographic element is allowed to complete processing, while developed silver is retained therein, dye image information obtained therefrom is digitally read, and then silver image information retained therein is removed by using recorded image information in the wavelength region in which the dye has no absorption, thereby improving image quality and simplifying the photographic processing steps. The wavelength region in which the dye has no absorption includes the ultraviolet region of 380 nm or less and the near infrared and infrared regions of 700 nm or more, which can not be observed by the human eye. It was proved that only the residual silver image retained in the developed photographic material for camera use is detected (in some cases, flaws or dust on the surface of the photographic material are also detected) so that it can be applied to remove the silver image from the dye image information. Embodiments of employing an infrared image information, as an image information in the wavelength region in which the dye has no absorption to remove the silver image will be further explained. To obtain an infrared image information, it does not need to use an image pick-up element having a specific sensitivity region but image pick-up elements, such as CCD employed in commercially available, low-priced digital cameras, can be used at inherent sensitivity levels (which are designed or manufactured so as not to provide sensitivity using a filter or coating).

To obtain an image information in the infrared region alone, as a silver image information, the visible absorption spectrum region of the dye image and the infrared region are to be separated using filters. Such filters are commercially available and can be readily obtained. For example, using Wratten filters 89B, 87 and 87C available from Eastman Kodak or Sharp cut filter R-76 available from Fuji Photo Film Co. Ltd., is obtained only infrared image information; and a visible image information is obtained using DR-550 filter available from Kenko Corp. The sensitivity peak of the image pick-up element is preferably within the range of 800 to 850 nm. In cases where the longer wavelength edge of the dye absorption spectrum reaches the infrared region, it needs to extend into the cutting wavelength region of a visible cut filter to further longer wavelengths.

According to the inventors of the this invention, it was proved that when the residual silver content of the photographic material {i.e., (silver weight per unit area of a maximum density portion after development/silver weight before development)×100} is 5% or more in reading color image information including developed silver image information, then effects of the invention are displayed.

Commercially available 35 mm film scanners include Q-Scan QS-1202JW, available from Konica Corp., Dimage Scan Multi F-3000, available from Minolta Corp. and LS-2000, available from Nikon Corp. Image pick-up elements (semiconductor image sensor) used in these apparatuses generally comprise one-dimensional line sensor in which CCDs are arranged in a row, and include a scanning mechanism. It is preferred, in terms of cost in reading and in decreasing time for reading, that using two-dimensional CCD area sensor having ca. $10^3 \times 10^3$ pixels used in digital cameras, infra-red, red, green and blue image information are separately read through filters and finally synthesized into one image.

When reading image information of a photographic material using a film scanner, it is preferred that light in the wavelength region including absorptions of at least three elements is allowed to be overall-irradiated or slit-scanned and its reflection light or transmission light be measured. In this case, diffuse light is more preferable than specular light since an information caused by a matting agent or flaws in the film can be removed. Using a light source, adding or increasing light of the infrared region, infrared image information can be efficiently obtained.

To perform efficient segmentation of an infrared image information and red, green, blue visible image informations, it is desirable to install a rotating plate fitted with filters between the image pick-up elements and the photographic material, and to read the information with revolving the rotating plate. A color separation filter and an infrared-cut filter are used in combination to input a visible image.

Apparatuses for reading image information of the photographic element having a residual silver content of 5% or more, as described above, which are preferably used in the invention, include:

an apparatus, in which a section for reading image information in the visible light wavelength region and image information of the invisible light wavelength region is provided with one-dimensional or two-dimensional image pick-up element and a scanning mechanism;

an apparatus, in which a section of reading image information in the visible light wavelength region and image information in the invisible light wavelength region has an apparatus to segment the read image information by revolving a rotating plate provided with plural optical filters between an image pick-up element and the photographic element; and an apparatus, in which a section of reading image information in the visible light wavelength region and image information in the invisible light wavelength region employs a diffuse light source.

In designing an apparatus for reading not only visible images but also infrared images, it is necessary to take into account the displacement of focal points of the infrared image and visible image, which is caused by chromatic aberration produced when allowing image information recorded in the photographic material to be image-formed on the CCD through an optical glass lens. The photographic material used in the invention is directly printed onto color photographic paper using a conventional mini-lab system, so that it is preferred not to use dyes such as colored couplers, such as those used in conventional color negative films.

One of the preferred embodiments of processing photographic materials used in the invention is thermal processing system.

FIG. 1 illustrates a flow chart comprising an image information reading section of one embodiment of the invention and also an image processing section.

Image processing is performed, in which images of different color informations obtained by using the photographic material processed under the conditions as stated above and also the reading apparatus described above, each are synthesized according to the following formula:

$$\begin{pmatrix} R' \\ G' \\ B' \end{pmatrix} = \begin{pmatrix} r_1 & g_1 & b_1 & i_1 \\ r_2 & g_2 & b_2 & i_2 \\ r_3 & g_3 & b_3 & i_3 \end{pmatrix} \begin{pmatrix} R \\ G \\ B \\ I \end{pmatrix}$$

wherein R, G, B and I represent red, green, blue and invisible (preferably, infrared) input signals, respectively; $r_1$, $r_2$ and $r_3$ independently represent red signal correction coefficient, and $r_1 \geqq 1$; $g_1$, $g_2$ and $g_3$ independently represent green signal correction coefficient, and $g_2 \geqq 1$; $b_1$, $b_2$ and $b_3$ independently represent blue signal correction coefficient, and $b_3 \geqq 1$; $i_1$, $i_2$ and $i_3$ independently represent infrared signal correction coefficient, and $i_1<0$, $i_2<0$ and $i_3<0$; R', G' and B' represent red, green and blue output signals.

There are further needed an image processing for subtracting an infrared image information from the synthesized image information to remove silver image information and a treatment to interpolate missing image informations.

The image processing can readily be performed using commercially available software, such as Photoshop available from Adobe Corp. and correction treatment such as adjustment of lightness or contrast and color balance adjustment can be simply accomplished.

For example, synthesis of red, green and blue image imformations can be achieved using Layer Pallet, which is a function of the Photoshop. The silver image information can be substantially removed by superposing an image prepared by applying the contrast-reversing function of the Photoshop to the obtained infrared image information and each of red, green, and blue image information, using the Layer Pallet function. The interpolation of missing information after removal of the silver image information can efficiently be performed using the maximum lightness treatment function, which is the filter function of the Photoshop. To further enhance image quality, it is desirable to enhance sharpness by using an unsharp mask which is the filter function of Photoshop, and to remove noise which leads to deterioration in image quality, by using noise removal software, such as Photoshop Plug-in (available from Konica Corp.). Herein, the noise means random electric noise produced when reading with a scanner, and the noise removal software has been developed and employed to prevent such noise. Alternatively, a method of synthesizing images obtained by using an image pick-up element with a low noise level or reading plural times is also known. It was proved that this method was also effectual in removing random noise caused by silver image and random noise strengthened when applying an image processing for enhancing sharpness, such as the use of an unsharp mask.

The image processing comprises sharpness enhancement processing, followed by smoothing processing. To optimize the combination of the sharpness enhancement processing and the subsequent smoothing processing, it is desirable to conduct, as a preliminary experiment, matrix display through varying parameters. A program to automatically perform such matrix display may be prepared and annexed as a plug-in software, or incorporated, in advance, as a software function of a scanner.

Figure 2:
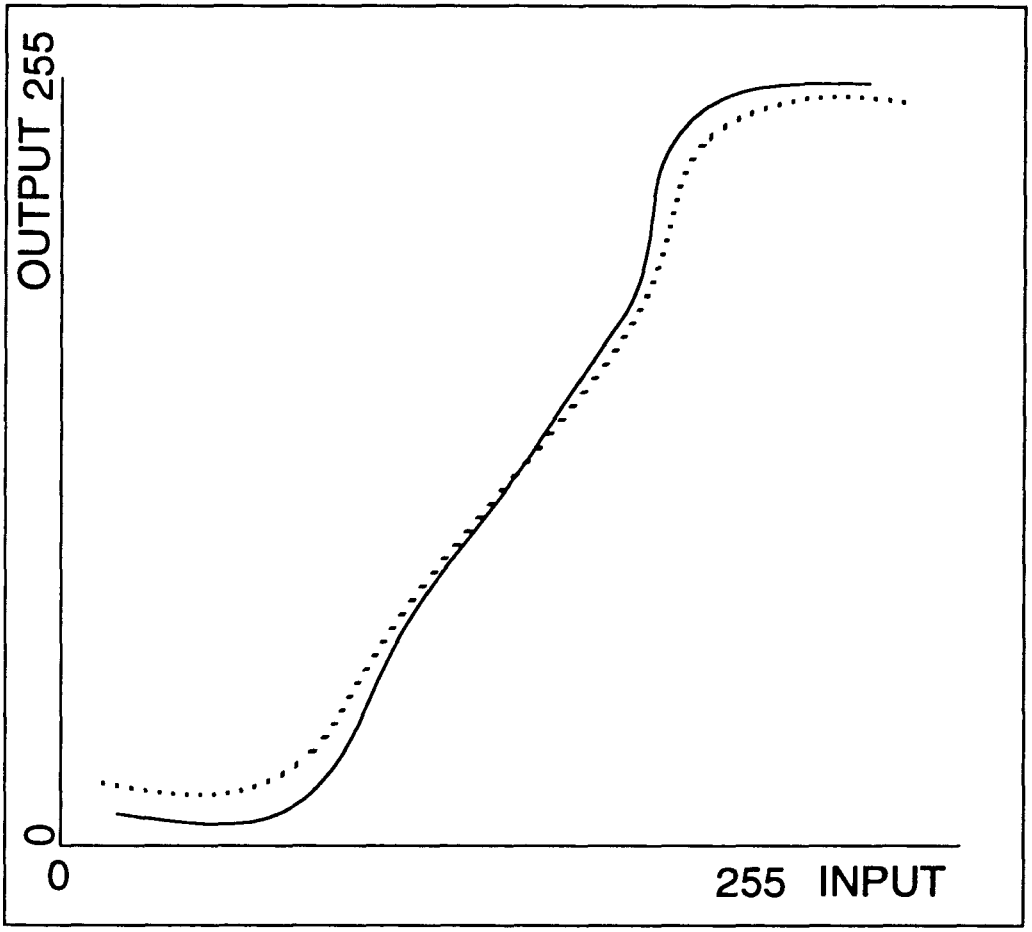
FIG. 2 shows gradation correction graphs.
Figure 3:
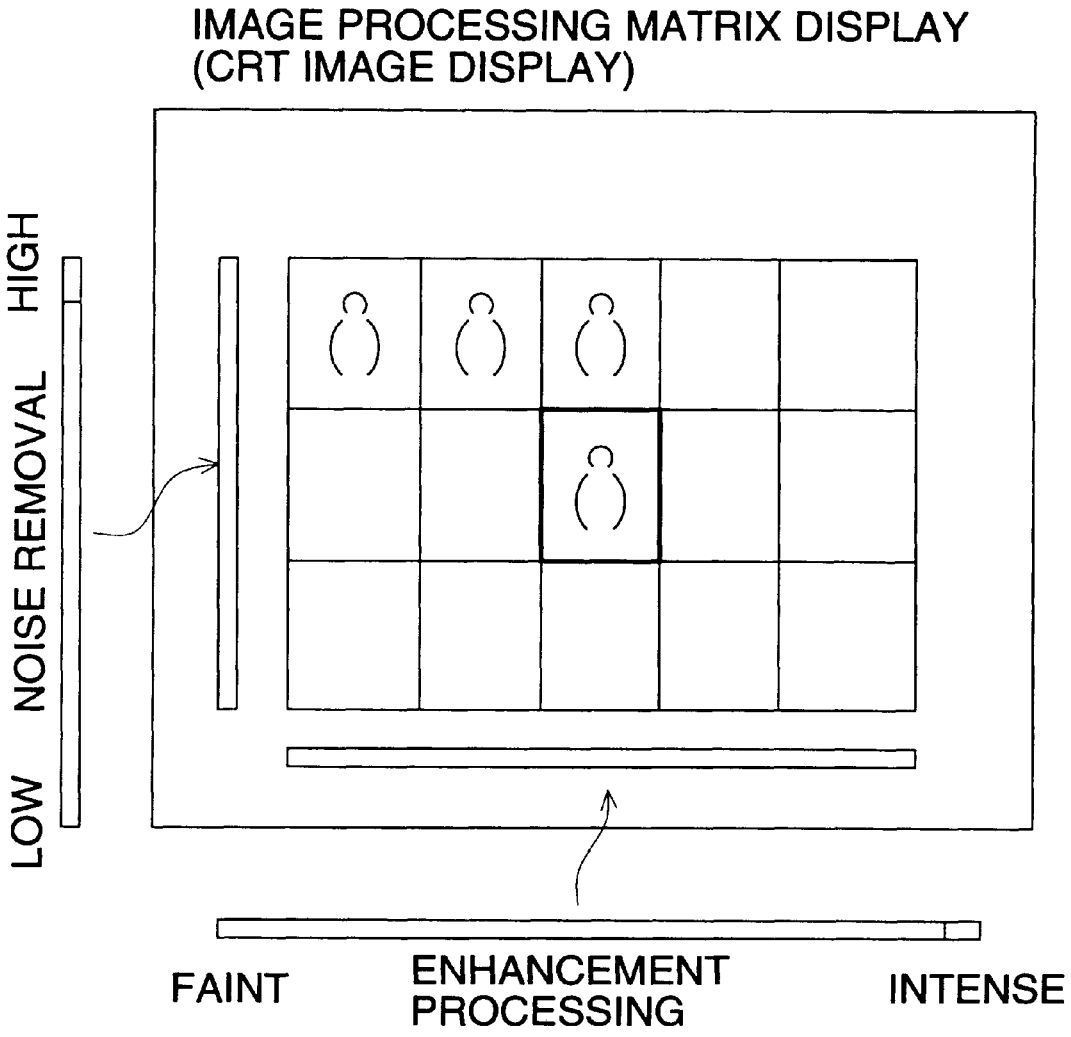
FIG. 3 illustrates an example of the matrix display.

FIG. 2 shows gradation correction graphs. FIG. 3 illustrates an example of the matrix display.

The sharpness enhancement processing is conducted using an unsharp mask. In this case, it is necessary to adjust appropriate parameters to optimize them so that high frequency noise is not excessively emphasized at the same time. However, it is useful to allow some noise (random noise)to emphasize to some extent, thereby preventing too much loss of information in the subsequent smoothing processing. After completion of the sharpness enhancement processing, the smoothing processing is conducted. The use of a smoothing filter, which is variable in characteristics based on the noise of the film, is preferred to display desired effects of the invention. Examples of the smoothing filter which can vary the size or the threshold of a mask based on noise characteristics include the noise removing function of Photoshop plug-in software (available from Konica Corp.).

Figure 4:
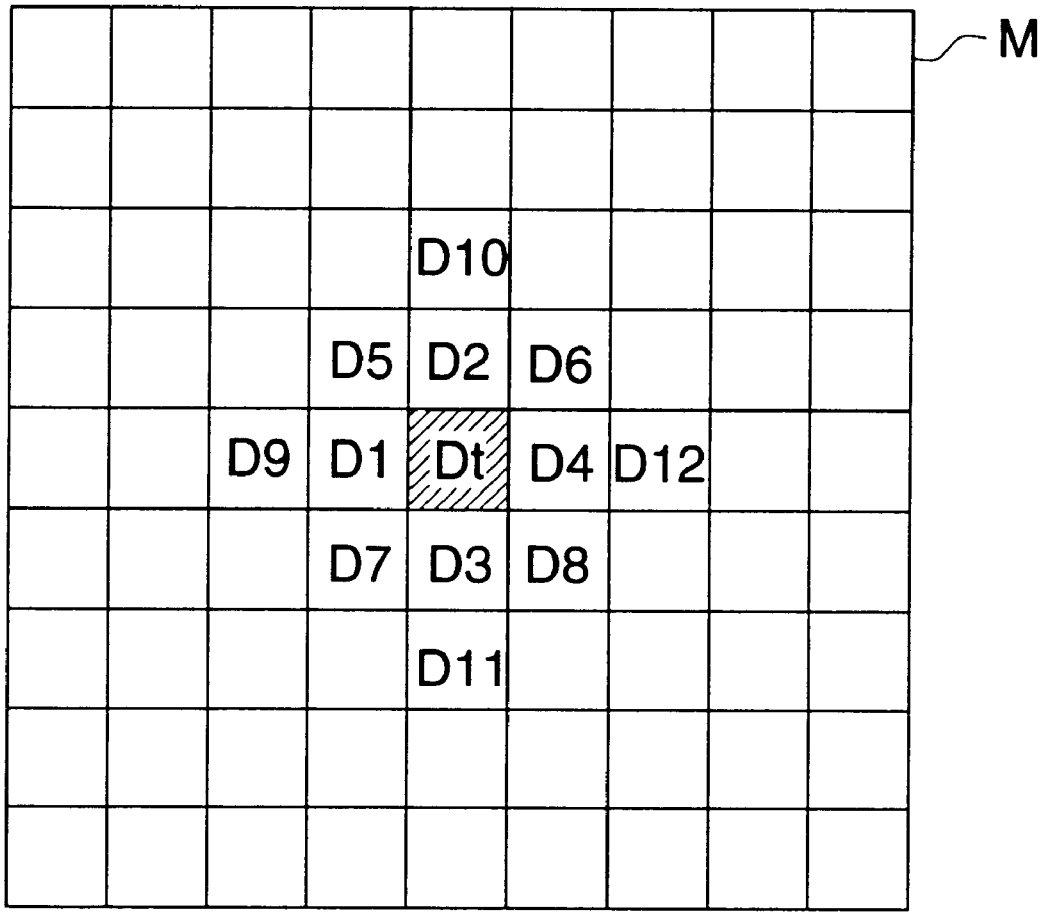
FIG. 4 illustrates an example of mask M used in image processing of one embodiment of the invention.

FIG. 4 illustrates an example of mask M used in image processing of one embodiment of the invention.

Figure 5:
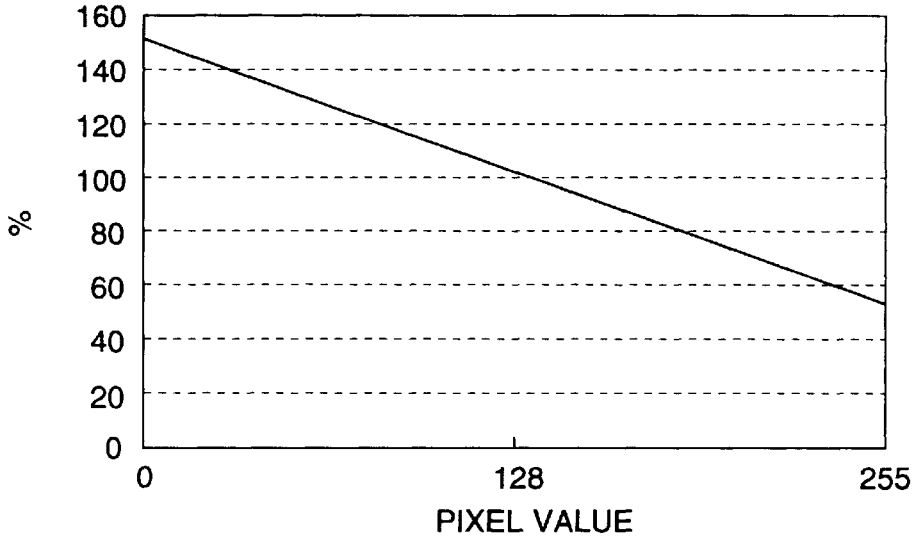
FIG. 5 shows the relationship between the pixel value of a noted picture element and the size of mask M.

FIG. 5 shows the relationship between the pixel value of a noted picture element and the size of mask M.

Figure 6:
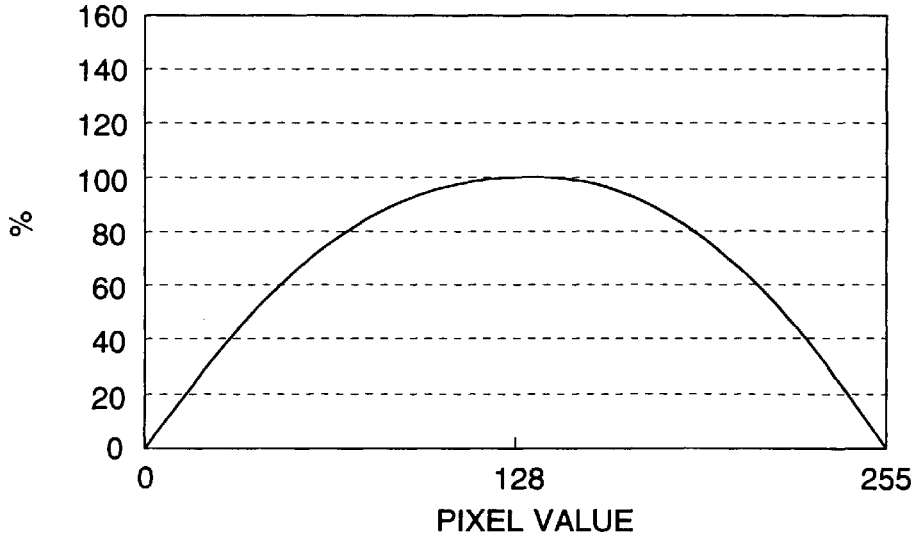
FIG. 6 shows the relationship between the pixel value of a noted picture element and the threshold.

FIG. 6 shows the relationship between the pixel value of a noted picture element and the threshold.

Figure 7:
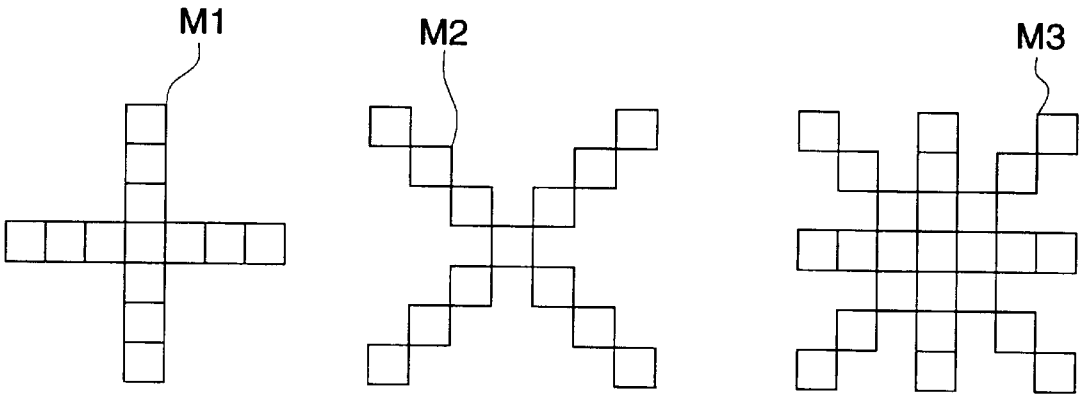
FIGS. 7(*a*), 7(*b*) and 7(*c*) show mask forms.

FIG. 7 shows different forms of masks, being M1, M2 and M3.

The size of mask M as shown in FIG. 4 (the range of a pixel) varies linearly based on parameters which are inputted by a user in the user operation section and the pixel value of a noted picture element. FIG. 5 shows the relationship between a pixel value of a noted picture element and the size of mask M. In FIG. 5, for example, in cases where the user inputs a mask parameter of 11, the size of mask M is 7×7 pixels when the pixel value of a noted picture element is 255 (maximum); the size of mask M is 11×11 pixels when the pixel value of a noted picture element is 128 (intermediate); and the size of mask M is 15×15 pixels when the pixel value of a noted picture element is 0 (minimum).

A noted picture element (Dt) is placed in the center of the mask M and the difference between the pixel value of the noted picture element Dt and that of picture elements other than Dt (surrounding picture elements), Dn (n=1, 2 . . . ). Then, the differences and the threshold value are compared.

The threshold varies in the manner of a quadratic curve, based on parameters inputted by a user in the user operation section and the pixel value of the noted picture element Dt. FIG. 6 shows the relationship between the pixel value of a noted picture element and its threshold. According to the relationship, in cases where the user inputs a parameter of 32, the threshold is 32 when the pixel value of the noted picture element is 128 (intermediate), while the threshold is 2 when the pixel value of the noted picture element is 0 (minimum) or 255 (maximum).

CPU 2 compares the differences between noted picture element D and surrounding picture elements Dn with the threshold determined according to the relationship of FIG. 7. From the comparison, any one of the following cases (1) through (3) results, provided that, as shown in FIG. 5, surrounding picture elements are denoted as D1, D2, . . .

from the periphery nearest to Dt and comparison having started from D1.

(1) Difference in pixel value between D1 and Dt>Threshold

In this case, the pixel value of the noted picture element Dt retains its original value (i.e., input value) and processing of the noted picture element is completed. Thus, if the difference between Dt and D1 is larger than the threshold, the surrounding of the noted pixel Dt, which may possibly be on the edge portion of the image, retains the original image without smoothing processing.

(2) Difference in pixel value between Dt and a part of surrounding pixels Dn>Threshold If the difference in pixel value between Dt and D1 is not more than the threshold, the difference between Dt and D2 is compared with the threshold. In this case, if the difference between Dt and D2 is more than the threshold, the pixel value of Dt is replaced by that of D2 and the processing of the noted pixel Dt is completed. On the other hand, if this difference is not more than the threshold, the comparison of the difference between Dt and D3 with the threshold is further continued. In this case, if the difference between Dt and D3 is more than the threshold, the pixel value of Dt is replaced by an average value of the pixel values of D1 and D2 and the processing of the noted pixel Dt is completed. If the difference between Dt and D3 is not more than the threshold, the comparison is similarly repeated.

(3) Difference in pixel value between Dt and all surrounding pixels Dn<Threshold This is a case wherethe difference in pixel value between Dt and all of surrounding pixels Dn within the mask M is less than the threshold. In this case, the pixel value of Dt is replaced by an average value of the pixel values of all pixels. Thus, if the difference between the noted pixel Dt and surrounding pixels Dn is less than the threshold, color of the surrounding of the Dt is regarded to be uniform and smoothing of the color is performed by the processing above described.

When applying the procedure described above, it is preferred to optimize parameters so that only the frequency component of noise is subjected to processing and a small amount of noise is allowed to remain without removing signals. As a result of experiments to define preferable image quality, it was proved that a certain extent of reduction in sharpness and a certain extent of granularity were necessary for pleasingtexture of the total scene, specifically for portrayal of human skin. Accordingly, the sharpness enhancement processing and noise removal processing are to be applied at a little lower level than usual, in accordance with whether the scene to be processed is a portrait or not. The sharpness enhancement processing and the smoothing processing are empirically optimized in accordance with characteristics of the photographic material to be used, the film format size and the kind of scene; and a series of operations may be registered so as to automatically conduct this, and a program may be prepared and annexed as a plug-in software, or incorporated, in advance, as a software function of a scanner.

Next, processing to enhance a portrait scene to a preferable level in image quality, is conducted under the following conditions:

graininess: in which a noise component is uniformly added so that the standard deviation of a density histogram of a gray chart having an 8 bit input value of 125 is 3 to 7, gradation: in which a tone curve is corrected so that an output value in response to an 8 bit input value of 65 is allowed to decrease by 5% or more and an output value in response to an input value of 190 is allowed to increase by 5% or more, and color reproduction: in which chromaticity coordinates in the L* a* b* color system meet the following requirements with respect to human skin color of an outputted print:

$$5<a^*<40, \text{ and } 5<b^*<40.$$

To register the results in accordance with the kind of film or film format, and to perform its automation after reading with a scanner, the program thereof may be prepared or annexed as a plug-in software or incorporated, in advance, as a software function of a scanner.

The thus obtained image data can be viewed using various displays. Examples of the image displays include color or monochromatic CRTs, liquid crystal displays, plasma emission displays and EL displays.

In the invention, the thus read image signals can be outputted onto various recording materials to form images. The recording materials for outputted data include various types of hard copy media as well as silver halide photographic materials. Examples thereof include ink-jet systems, sublimation type thermal transfer systems, electrophotography systems, Cycolor system, Thermo Autochrome system, silver halide color paper print systems, silver halide thermal development systems, etc. Exemplarily, types of these systems are CRT printer DP-8180, Digital Minilab QD-21 (both are available from Konica Corp.) and Frontier 350 System (available from Fuji Photo Film Co. Ltd. Using any one of those described above, effects of the invention can be sufficiently displayed.

Silver halide emulsion usable in the invention are described in Research Disclosure item 308119 (hereinafter, simply denoted as RD308119).

The silver halide emulsions are preferably those which have been subjected to physical ripening, chemical ripening and spectral sensitization. As a chemical sensitized is employed a sulfur sensitizer, selenium sensitizer or tellurium sensitizer. Photographic additives usable in the invention are described in RD308119, RD17643 and RD18716.

A variety of couplers can be employed and examples thereof are described in the Research Disclosures described above. Additives used in the invention can be incorporated by the dispersing method described in RD308119, XIV. Supports described in RD17643 page 28; RD18716, pages 647–648 and RD308119, XIV.

The photographic materials used in the invention may be provided with an auxiliary layer such as a filter layer or interlayer, and may take any layer arrangement, including conventional layer order, inverted layer order and unit constitution.

The present invention can be applied to various color photographic materials, including color negative films for general use or cine-use, color reversal films for slide or TV and color positive films.

The color photographic materials can be processed in the conventional manner, as described in RD17643 pages 28–29 and RD18716 page 615, left to right columns.

In cases where the color photographic material is used in a roll form, it is preferably contained in a cartridge. The most popular cartridge is a patrone of the present 135 format. Patrones proposed in the patents described below are also usable: Japanese Utility Model Application No. 58-67329, JP-A 58-181035, U.S. Pat. No. 4,221,479, JPA-1-231045 and 2-199451, U.S. Pat. Nos. 4,846,418, 4,848,693 and 4,832,275. The present invention may also be applied to "Small-sized photographic roll film patrone and film camera" described in JP-A 5-210201.

Chemical sensitization in the presence of a compound capable of being adsorbed onto silver halide results in enhanced effects. The compounds capable of being adsorbed onto silver halide include sensitizing dyes, fog inhibitors, and stabilizers.

Examples of the sensitizing dyes include cyanine dyes, merocyanine dyes, complex cyanine dyes, complex merocyanine dyes, holo-polar cyanine dyes, hemi-cyanine dyes, styryl dyes, hemioxonol dyes, and polymethine dyes including oxonol, merostyryl and streptcyanine.

Examples of the fog inhibitors and stabilizers include tetraazaindenes; azoles such as benzothiazolium, nitroindazoles, nitrobenzimidazoles, chlorobenzimidazoles, bromobenzimidazoles, mercaptothiazoles, mercaptobenzimidazoles, aminotriazoles, benzotriazoles, nitrobenztriazoles, mercaptotetrazoles (specifically, 1-phenyl-5-mercaptotetrazole); mercaptopyrimidine; mercaptotriazines; thioketo compounds such as oxazolithione; benzenethiosulfinic acid; benzenesulfinic acid; benzenesulfonic acid amide; hydroquinone derivatives, aminophenol derivatives, gallic acid derivatives; and ascorbic acid derivatives.

Sensitization in the presence of a silver halide solvent leads to enhanced effects. Examples of the silver halide solvent include (a) thioethers described in U.S. Pat. Nos. 3,271,157, 3,531,289 and 3,574,628, JP-A 54-1019 and 54-158917; (b) thiourea derivatives described in JP-A 53-82408, 55-77737 and 55-2982; (c) silver halide solvent compounds containing a thiocarbonyl group attached to an oxygen or sulfur atom, and a nitrogen atom described in JP-A 53-144319; (d) imidazoles; (e) sulfites and (f) thiocyanates.

Next, materials employed in thermal processing and thermal processing methods will be described.

Silver Halide

Silver halide used in the invention includes any one of silver bromide, silver iodobromide, silver chloride, silver chlorobromide, silver iodochlorobromide, and silver iodichloride. In general, silver iodobromide, silver bromide and silver iodochlorobromide are preferred in terms of high sensitivity level; and silver chloride and silver chlorobromide are preferred in terms of processing speed. Silver halide emulsions can be prepared in accordance with the methods described in P. Glafkides, "Chimie et Physique Photographique" (published by Paul Montel Co., 1967), G. F. Duffin, "Photographic Emulsion Chemistry" (published by The Focal Press, 1966), V. L. Zelikman et al., "Making and Coating Photographic Emulsion" (published by The Focal Press, 1964); JP-A 51-39027, 55-142329, 58-113928, 54-48521, 58-4938 and 60-138538; and Abstracts of Annual Meeting of Society of Japanese Photographic Science and Engineering (1983), page 88. Namely, any of several acid emulsions, neutral emulsions, ammonia emulsions, and the like may be employed. Furthermore, when grains are prepared by allowing soluble silver salts to react with soluble halide salts, a single-jet method, a double-jet method, combinations thereof, a method in which grains are formed in excess of silver ions (reversed precipitation) or a method in which a soluble silver salt and a soluble halide are supplied to fine seed crystals, may be employed.

Silver halide grain size distribution of the silver halide emulsion may be narrow or broad, and monodisperse grains which are hogeneous in grain size, is preferred. Thus, the distribution width, which is defined by a relative standard deviation (coefficient of variation) as descrobed below, is preferably 25% or less, and more preferably 20% or less:

(Standard deviation of grain size/average grain size)×100=Distribution width (%)

The average grain size of silver halide grains is not specifically limited, but when the grain volume is converted to a cube, its edge length is preferably 0.05 to 2.0 μm, more preferably 0.1 to 1.2 μm.

Silver halide grains contained in the silver halide emulsion may be in a regular form, such as cubic, octahedral or tetradecahedral form, in a irregular form, such as tabular twinned crystals or a mixture thereof, and tabular grains are preferred. The tabular grains used in the invention have an average ratio of grain diameter to grain thickness (aspect ratio) of not less than 2 (more preferably 3 to 20, and still more preferably 4 to 15). The tabular silver halide grains may be bounded by (111) faces, or {100} faces. The tabular grains may be {111} and {100} faces. In cases where silver iodobromide or silver bromide tabular grains are employed, at least 50% of the total grain surface is preferably {111} faces, more preferably, 60 to 90% of the grain surface is {111} faces and specifically preferably, 70 to 95% of the grain surface is {111} faces. The grain surface other than the {111} faces is preferably {100} faces. The proportion of the faces can be determined employing adsorption difference of a sensitizing dye between {111} and {100} faces [T. Tani, J. Imaging Sci., 29, 165 (1985)].

Tabular silver (iodo)bromide grains used in the invention are preferably hexagonal. The hexagonal tabular grains are those which comprise hexagonal major faces ({111} face), having the maximum ajacent edge ratio of 1.0 to 2.0. The adjacent edge ratio is a ratio of a maximum edge length to a minimum edge length. The hexagonal tabular grains having the maximum adjacent edge ratio of 1.0 to 2.0 may be rounded form at the corner or substantially in a circle form. When the tabular grains are rounded, the edge length can be represented by a distance between intersections when extending a straight line portion of the grain and extending a straight line portion of the adjacent edge. At least ½ of the edge of the hexagonal tabular grains substantially comprise straight line and the adjacent edge ratio is preferably 1.0 to 1.5.

The tabular silver (iodo)bromide grains preferably have dislocations. The dislocation of silver halide grains can directly be observed using a transmission electron microscope, for example, in accordance with the method described in J. F. Hamilton, Phot. Sci. Eng., 11, 57 (1967) and T. Shiozawa, J Soc. Photo. Sci. Japan, 35, 213 (1972). The dislocation is located preferably with the range of 0.58 to 1.0 L in the outward directo from the grain center (and more preferably 0.80 to 0.98 L). Dislocatuion lines are located in the direction from the center to the outer surface, which often snake. Graind having one or more dislocation lines preferably account for at least 50% by number. The higher is the proportion of tabular grains having the dislocation line, the more preferred.

Tabular silver chloride, silver chlorobromide, silver iodochloride and silver iodochlorobromide grains are also employed in the invention. Either abular grain having {100} mjor faces or tabular grains having {111} major faces can be employed. The tabular grains having {100} major faces are described in U.S. Pat. No. 5,314,798, European Patent 534,395A, 617,321A, 617,317A, 617,318A, and 617,325A; WO94/22051; European Patent 616,255A; U.S. Pat. Nos. 5,356,764, 5,320,938 and 5,275,930; JP-A 5-204073, 5-281640, 7-225441 and 6-30116. The tabular grain having {111} major faces are also described in various references, e,g., U.S. Pat. No. 4,439,520. Further, U.S. Pat. No. 5,250,403 describes ultrathin tabular grains having an equivalent circle diameter of 0.7 μm or more and a thickness of 0.07 μm or less. Furthermore, U.S. Pat. No. 4,435,501 describes a technique of epitaxially growing silver halide on the tabular grain surface.

The diameter of the tabular grain is a diameter of a circle having the same area as the grain projected area. The grain projected area can be determined from the sum of grain area. Each of them can be determined by electronmicroscopic observation of a silver halide crystal sample in which silver halide grains are distributed on a sample plate without being overlapped with each other. The mean projected area diameter of tabular grains, which is represented in terms of an equivalent circle diameter of the grain projectes area, is preferably not less than 0.30 μm, more preferably 0.30 to 5 μm, and still more preferably 0.40 to 2 μm. The grain diameter can be determined by magnifying to 10,000 to 70,000 time with an electron microscope and measuring the projected area on the print. The mean grain diameter (ϕ) can be determined according to the following formula:

$$\text{Mean diameter } (\phi)=(\Sigma ni\phi i)/n$$

where n is the total number of measured grains, ni is a frequency of grains having a diameter of ϕi, provided that the number of measured grains are randomly 1,000 or more. The grain thickness can be determined by obliquely observing the grain. The tabular grain thickness is preferably 0.03 to 1.0 μm, and more preferably 0.05 to 0.5 μm. The low grain thickness distribution is preferred. Thus, the thickness width defined below is preferably 25% or less, and more preferably 20% or less:

(Standard deviation of thickness/mean thickness)×100=width of thickness distribution (%)

Taking account of factors of the aspect ratio and the grain thickness, the tabularity, defined as $A=ECD/b^2$ is preferably 20 or more, wherein ECD is a mean projection diameter (μm) and b is a grain thickness. The mean projection diameter is a number-averaged value of the equivalent circle diameters of tabular grains.

The low distibution of halide content among tabular grains is preferred. Thus, the distribution width of halide content, as defined below, is preferably 25% or less, and more preferably 20% or less:

(Standard deviation of halodecontent/mean halide content)×100= distribution width of halide content Silver halide grains used in the invention may have core/shell type structure having at least two layers different in halide composition in the interior of the grain, or homogeneous halide composition. The mean iodide content of silver halide grains used in the invention is preferably 20 mol % or less, and more preferably 0.1 to 10 mol %. Silver halide grains used in the invention may be halide conversion type grains. The halide conversion amount is preferably 0.2 to 2.0 mol %, based on silver, and conversion may be performed during or after physical ripening. Halide conversion is conventionally conducted by adding an aqueous halide solution or fine silver halide graind which is lower in solubility product of silver halide than the halide composition of the grain surface prior to conversion. The fine silver halide grain size is preferably 0.2 μm or les, and more preferably 0.02 to 0.1 μm.

Silver halide grains can be allowed to contain a metal ion in the interior or exterior of the grain by adding, in the stage of nucleation or growth, at least a metal compound selected from a cadmium salt, zinc salt, lead salt, thallium salt, iridium salt (including its complex salt), rhodium saly (including its complexsalt) and iron salt (including its complex salt).

Silver halide emulsions used in the invention may be desalted to remove soluble salts, or the emulsion may not be desalted. Desalting can be conducted in accordance with the method described in Research Disclosure No. 17643, section II.

Two or more silver halide emulsion may optionally be blended.

Sensitization

Photosensitive silver halide emulsions are conventionally those which have been subjected to chemical sensitization. Silver halide emulsions used in the invention can be chemically sensitized using known methods, including chalcogen sensitization such as sulfur sensitization, selenium sensitization, or tellurium sensitization; noble metal v using gold or platinum or paradium; or their combination (e.g., as described in JP-A 3-110555 and 5-241267).

Preferred chalcogen sensitizers applicable to silver halide emulsions used in the invention include sulfur sensitizers and selenium sensitizers. Examples of the sulfur sensitizers include a thiosulfate, allylthiocarbamide, thiourea, allylisothiocyanate, cystine, p-toluenethiosulfonate, rhodanine and inorganic sulfur. The addition amount of the sulfur sensitizer, which is optionally varied depending on silver halide or expected effects, is preferably $5\times10^{-10}$ to $5\times10^{-5}$ mol per mol of silver halide, and more preferably $5\times10^{-8}$ to $3\times10^{-5}$ mol per mol of silver halide.

As gold sensitizers are added chloroauric acid or gold sulfide as well as gold complexes. Ligand compounds include dimethylrhodanine, thicyanic acid, mercaptotetrazole and nercaptotriazole. The addition amount of a gold compound, depending on silver halide, the kind of the compound to be used and ripening conditions, is preferably $1\times10^{-8}$ to $1\times10^{-4}$ mol per mol of silver halide, and more prefderably $1\times10^{-8}$ to $1\times10^{-5}$ mol per mol of silver halide.

Chemical sensitization can be conducted in the presence of a nitrogen-containing heterocyclic compound (as described in JP-A 62-253159). Fog inhibitors may be added after completing chemical sensitization, as described in JP-A 5-45833 and 62-40446. The pH at chemical sensitiation is preferably 5.3 to 10.5, and more preferably 5.5 to 8.5; and the pAg is preferably 6.0 to 10.5, and more preferably 6.8 to 9.0. The coating amount of photosensitive silver halide used in the invention is 1 mg to 10 g/m2, in terms of equivalent converted to silver.

Silver halide emulsions used in the invention can be prepared in combination with reduction sensitization. It is possible to provide a reduction sensitization nucleus in the interior and/or on the surface of the grain by allowing the silver halide emulsion to be held in a reducing atmosphere. The reduction sensitization is preferably conducted during grain growth. Reduction sensitization may be conducted, while growing grains. Alternatively, the grain growth is interrupted, reduction sensitization is conducted, and then reduction-sensitized silver halide grains are further allowed to grow. Concretely, reduction sensitizationis conducted by adding a reducing agent and/or an aqueous silver salt solution to the silver halide emulsion. Preferred examples of the reducing agent include thiourea dioxide, ascorbic acid including its derivatives, polyamines such as hydrazine and diethylenetriamine, dimethylamine boranes and sulfites. The addition amount of the reducing agent can appropriately be varied, depending on the kind of the reducing agent, the grain size, halide composition and crystal habit of silver halide grains and environmental conditions such as reaction temperature, pH and pAg. For example, thiourea dioxide is preferably 0.01 to 2 mg per mol of silver halide, and ascorbic acid is preferably 0.2 to 50 m per mol of silver halide.

Reduction sensitization is conducted preferably at a temperature of 40 to 80° C., a pH of 5 to 11, and a pAg of 1 to 10 over a period of 10 to 200 min. Silver nitrate is preferably added as an aqueous silver salt. So-called silver ripening, as one of reduction sensitization, is carried out by adding an aqueous silver salt. The silver ripening is carried out preferably at a pAg of 1 to 6, and more preferably 2 to 4. The conditions such as temperature, time and pH are preferably within the range described above.

It is preferred to deactivate the reducing agent and restrain or stop the reduction sensitization by adding an oxidizing agent such as hydrogen peroxide or its adduct, peroxo acid salt, ozone, $I_2$ and thiosulfonic acid at a desired time during the grain formation. Addition of the oxidizing agent can be made at any time after the start of forming silver halide grains and before adding a gold sensitizer (or a chemical sensitizer).

Silver halide emulsions used in the invention are spectrally sensitized with methine dyes or others so that the emulsions further have spectral sensitivity, such as green-sensitivity or red-sensitivity. A blue-sensitive emulsion may optionally be spectral-sensitized to the blue regin. Used spectral sensitizing dyes include cyanine dyes, merocyanine dyes, complex cyanine dyes, complex merocyanine dyes, holopolar cyanine dyes, hemi-cyanine dyes, styryl dyes and hemi-oxonol dyes, as described in U.S. Pat. No. 4,617,257; JP-A 59-180550, 64-13546, 5-45828, and 5-45834. These dyes may be used alone or in combination. Sensitizing dyes are used in combination for the purpose of supersensitization or adjusting the wavelength region to be spectrall sensitized A dye having no spectral sensitizing capability or a compound having no absorption in the visible region, each of which ehhibits supersensitization in combination with a spectral sensitizing dye, may be incorporated in the emulsion (as described, e.g., in U.S. Pat. No. 3,615,641 and JP-A 63-23145). The spectral sensitizing dyes may be added before, during or after chemical ripening, or may be added before or after nucleation of silver halide grains. The spectral sensitizing dye ot supersensitizer may be incorporated in the form of a solution of an organic solvent such as methanol, a dispersion in a gelatin or a solution of a surfactant. The addition amount thereof is preferably $10^{-8}$ to $10^{-2}$ mole per mole of silver halide.

Hydrophilic colloidal materials used in the silver halide photographic materials include, besides conventiona gelatin in silver halide emulsions, gelatin derivatives such as actylated gelatin and phthalated gelatin and synthetic or natural hydrophilic polymers such as water-soluble cellulose derivatives.

A variety of techniques and additives can be employed in silver halide photographic materials used in the invention. For example, in addition to light sensitive silver halide emulsion layer, there may be provided auxiliary layers such as a protective layer, filter layer, anti-halation layer, cross-over light-shielding layer and backing layer. Into these layers, various adjuvants, such as a chemical sensitizer, noble metal sensitizer, sensitizing dye, supersensitizer, coupler, high boiling solvent, antifoggant, stabilizer, development restrainer, bleach accelerator, fixing accelerator, anti-staining agent, formaline scavenger, color toning agent, hardener, surfactant, thickener, plasticizer, lubricant, UV absorbent, anti-iradiation dye, filter light absorbing dye, antimold, polymeric latex, heavy metal, and matting agent may be added according to various methods.

A variety of adjuvants may be incorporated to the photographic material in accordance with its purpose. The adjuvants are described in Research Disclosure (RD) 17643 (December, 1978), ibid 18716 (November, 1979), and ibid 308119 (December, 1989). Kinds of compounds described in these RD and described section are shown below.

| | RD-17643 | | RD-18716 | RD-308119 | |
|---|---|---|---|---|---|
| Additive | Page | Sec. | Page | Page | Sec. |
| Chemical sensitizer | 23 | III | 648 upper right | 996 | III |
| Sensitizing dye | 23 | IV | 648–649 | 996–8 | IV |
| Desensitizing dye | 23 | IV | | 998 | IV |
| Dye | 25–26 | VIII | 649–650 | 1003 | VIII |
| Developing accelerator | 29 | XXI | 648 upper right | | |
| Antifoggant/stabilizer | 24 | IV | 649 upper right | 1006–7 | VI |
| Brightening agent | 24 | V | | 998 | V |
| Hardening agent | 26 | X | 651 left | 1004–5 | X |
| Surfactant | 25–27 | XI | 650 right | 1005–6 | XI |
| Antistatic agent | 27 | XII | 650 right | 1006–7 | XIII |
| Plasticizer | 27 | XII | 650 right | 1006 | XII |
| Lubricant | 27 | XII | | | |
| Matting agent | 28 | XVI | 650 right | 1008–9 | XVI |
| Binder | 26 | XXII | | 1003–4 | IX |
| Support | 28 | XVII | | 1009 | XVII |

Color developing agent

The photographic material used in the invention may contain a color developing agent. The color developing agent is oxidized through development a silver salt to produce an oxidation product, which is coupled to form a dye. Examples of the combination of a color developing agent and a coupler include p-phenylenediamines, and phenol or active methlene couplers described in U.S. Pat. No. 3,531,256; and p-aminophenol type developing agents and active methylene couplers, described in U.S. Pat. No. 3,761,270. The combination of a sulfonamidophenol and a four-equivalent coupler, as described in U.S. Pat. No. 4,021,240 and JP-A 60-128438, exhibited superior raw storage stability when occluded in the photographic material. The color developing agent may be contained in the form of its precursor. Examples thereof include indoaniline type compounds described in U.S. Pat. No. 3,342,597; Schif base type compounds described in U.S. Pat. No. 3,342,599 and Research Disclosure Nos. 14,850 and 15,159; aldol compounds described in ibid No. 13,924; metal salt complex described in U.S. Pat. No. 3,719,492; and urethane compounds described in JP-A 53-135628. Developing agents to be contained in the photographic material is required to stable during storage and not to reduce silver salts, Color developing agents meeting the requirements described above include a sulfonamidophenol type developing agent described in JP-A 9-15806; a hydrazine type developing agent described in JP-A 5-241282, 8-234388, 8-286340, 9-152700, 9-152701, 9-152702, 9-152703 and 9-152904; hydrazone type developing agent described in JP-A 7-202002 and 8-234390.

Compounds represented by the following formulas I, II, III, IV and V are employed as a preferred color developing agent. Of these, the compound represented by formula I or IV is more preferred. These developing agents will be further described:

Formula I

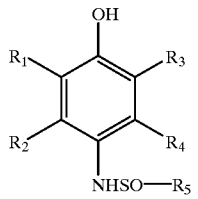

Formula II

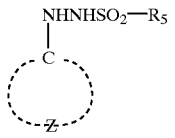

Formula III

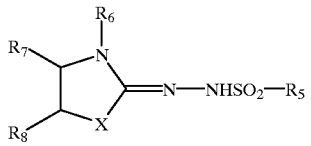

Formula IV

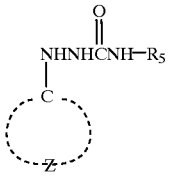

Formula V

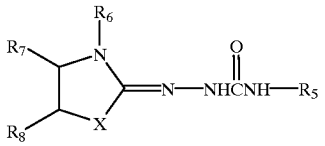

where $R_1$ to $R_2$ each represent a hydrogen atom, alkyl group, aryl group, alkylcarbonamido group, arylcarbonamido group, alkylsulfonamido group, arylsulfonamido group, alkoxy group, aryloxy group, alkylthio group, arylthio group, alkylcarbamoyl group, arylcarbamoyl group, alkylsulfamoyl group, arylsulfamoyl group, sulfamoyl group, cyano group, alkylsulfonyl group, arylsulfonyl group, alkoxycarbonyl group, aryloxycarbonyl group, alkylcarbonyl group, arylcarbonyl group, and acyloxy group; $R_5$ represents a substituted or unsubstituted alkyl group, aryl group, or heterocyclic group; Z represents an atomic group necessary to form an aromatic ring (including aromatic heterocyclic ring), provided that when Z forms a benzene ring, the sum of Hammett's constant ($\sigma$) of substituent(s) is 1 or more; $R_6$ represents a substituted or unsubstituted alkyl group; X represents an oxygen atom, sulfur atom, selenium atom, or tertiary nitrogen atom substituted by an alkyl or aryl group; and $R_7$ and $R_8$ each represent a hydrogen atom or a substituent, provided tha $R_7$ and $R_8$ may combine with each other to form a double bond or a ring.

The compound represented by formula I is generally called a sulfonamidophenol compound, in which $R_1$ to $R_4$ eacg represent a hydrogen atom, halogen atom (e.g., chlorine, bromine), alkyl group (e.g., methyl, ethyl, isopropyl, n-butyl, t-butyl), aryl group (e.g., phenyl, tolyl, xylyl), alkylcarbonamido group (e.g., acetylamino, propionylamino, butyloylamino), arylcarbonamido group (e.g., benzoylamino), alkylsulfonamido group (e.g., methanesulfonylamino, ethanesulfonylamino), arylsulfonamido group (e.g., benzenesulfonylamino, toluenesulfonylamino), alkoxy group (e.g., methoxy, ethyl, butoxy), aryloxy group (e.g., pheoxy), alkylthio group (e.g., methylthio, ethylthio, butykthio), arylthio group (e.g., phenylthio, tolylthio), alkylcarbamoyl group (e.g., methylcarbamoyl, dimethylcarbamoyl, ethylcarbamoyl, diethylcarbamoyl, dibutylcarbamoyl, piperidylcarbamoyl, morpholylcarbamoyl), arylcarbamoyl (e.g., phenylcarbamoyl), methylphenylcarbamoyl, ethylphenylcarbamoyl, benzylphenylcarbamoyl), carbamoyl group, alkylsulfamoyl group (e.g., methylsulfamoyl, dimethylsulfamoyl, ethylsulfamoyl, diethylsulfamoyl, dibutylsulfamoyl, piperidylsulfamoyl, morphorylsulfamoyl), arylsulfamoyl group (e.g., phenylsulfamoyl, methylphenylsulfamoyl, ethylphenylsulfamoyl, benzylphenylsulfamoyl), sulfamoyl group, cyano group, alkylsulfonyl group (e.g., methanesulfonyl, ethanesulfonyl), arylsulfonyl group (e.g., phenylsulfonyl, 4-chlorophenylsulfonyl, p-toluenesulfonyl), alkoxycarbonyl group (e.g.,methoxycarbonyl, ethoxycarbonyl, butoxycarbonyl), aryloxycarbonyl (e.g., phenoxycarbonyl), alkylcarbonyl (e.g., acetyl, propionyl, butyloyl), arylcarbonyl (e.g., benzoyl, alkylbenzoyl), or acyloxy group (e.g., acetyloxy, propionyloxy, butyloyloxy). Of $R_1$ to $R_4$, $R_2$ and $R_4$ preferably eacg are a hydrogen atom. The sum of Hammett's constant ($\sigma p$) of $R_1$ to $R_4$ is preferably 0 or more. R5 represents an alkyl group (e.g., methyl, ethyl, butyl, octyl, lauryl, cetyl, stearyl), aryl group [e.g., phenyl, tolyl, xylyl, 4-methoxyphenyl, dodecyphenyl, chlorophenyl, trichlorophenyl, nitrochlorophenyl, triisopropylphenyl, 4-dodecyoxyphenyl, 3,5-di-(methoxycarbonyl)] or heterocyclic group (e.g., pyridyl).

The compounds represented by formula II are generally called sulfonylhydrazines. The compounds represented by formula IV are generally called carbamoylhydrazines, in which Z represents an atomic group necessary to form an aromatic ring. The aromatic ring formed by Z needs to be electron-attractive enough to provide silver-developing activity to the compound. Accordingly, a nitrogen containing aromatic heterocyclic ring or an aromatic ring having a benzene ring substituted by an electron-attractive group is preferably employed. Preferred examples such aromatic ring include a pyridine ring, pyrazine ring, pirimidine ring, quinoline ring, and quinoquoxaline ring. In cases of the benzene ring, examples of the substituent include an alkylsulfonyl group (e.g., methansulfonyl, ethanesulfonyl), halogen atom (e.g.,chlorine, bromine), alkylcarbamoyl group (e.g., methylcarbamoyl, dimethylcarbamoyl, ethylcarbamoyl, diethylcarbamoyl, dibutylcarbamoyl, piperidylcarbamoyl, morpholylcarbamoyl), arylcarbamoyl (e.g., phenylcarbamoyl, methylphenylcarbamoyl, ethylphenylcarbamoyl, benzylphenylcarbamoyl), carbamoyl group, alkylsulfamoyl group (e.g.,methylsulfamoyl, dimethylsulfamoyl, ethylsulfamoyl, diethylsulfamoyl, dibutylsulfamoyl, piperidylsulfamoyl, morphorylsulfamoyl), arylsulfamoyl group (e.g., phenylsulfamoyl, methylphenylsulfamoyl, ethylphenylsulfamoyl, benzylphenylsulfamoyl), sulfamoyl group, cyano group, alkylsulfonyl group (e.g., methanesulfonyl, ethanesulfonyl), arylsulfonyl group (e.g., phenylsulfonyl, 4-chlorophenylsulfonyl, p-toluenesulfonyl), alkoxycarbonyl group (e.g.,methoxycarbonyl, ethoxycarbonyl, butoxycarbonyl), aryloxycarbonyl (e.g., phenoxycarbonyl), alkylcarbonyl (e.g., acetyl, propionyl, butyloyl), and arylcarbonyl (e.g.,benzoyl, alkylbenzoyl). The sum of the Hammett's constant of the substituent is 1 or more.

The compounds represented by formula III are generally called sulfonylhydrazones. The compounds represented by formula V are generally called carbamoylhydrazones, in which $R_6$ represents a substituted or unsubstituted alkyl group (e.g., methyl, ethyl); X represents anoxygen atom, sulfur atom selenium atom or a tertary nitrogen atom substituted by an alkyl or aryl group, and an alkyl-substituted tertary nitrogen aton is preferred. $R_7$, and $R_8$ eacg represent a hydrogen atom or a substituent, provided that $R_7$ and $R_8$ may combine with each other to form a ring.

Exemplary examples of the compounds represented by formulas I to V are shown below, but the compounds are not limited to these examples.

A-1

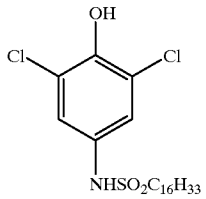

A-2

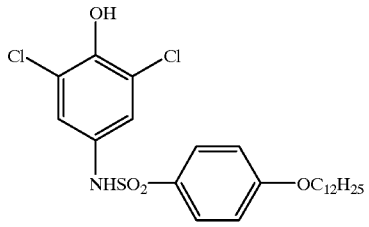

A-3

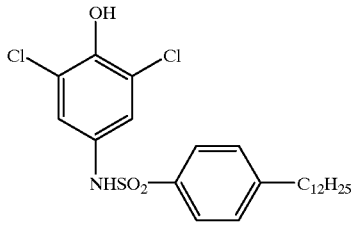

A-4

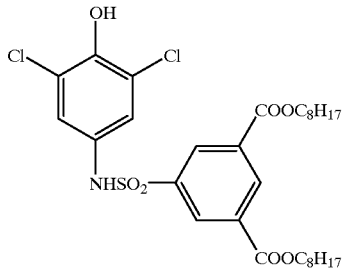

A-5

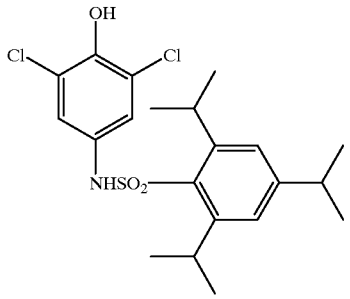

A-6

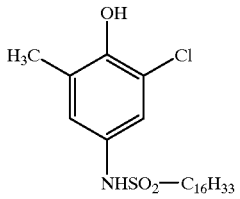

A-7

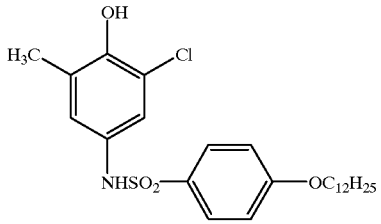

A-8

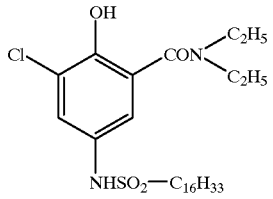

A-9

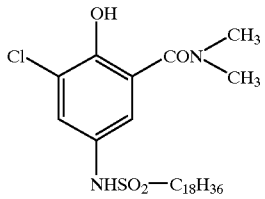

A-10

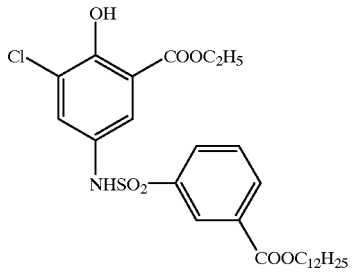

-continued
A-11
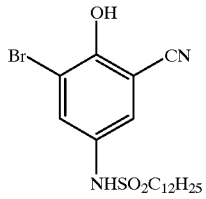
A-12
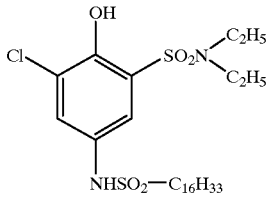
A-13
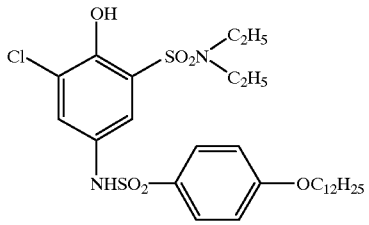
A-14
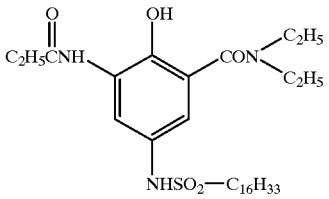
A-15
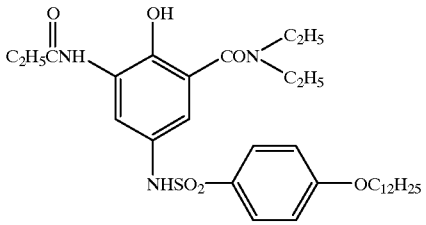
A-16
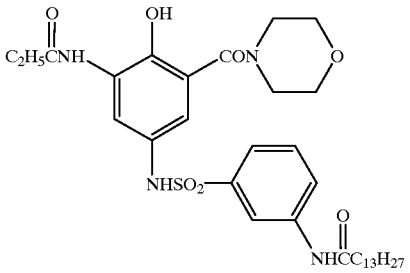
A-17
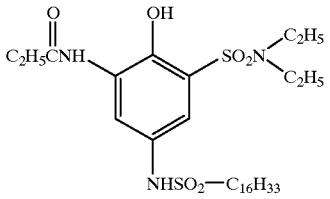
A-18
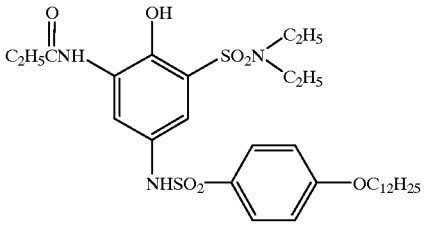
A-19
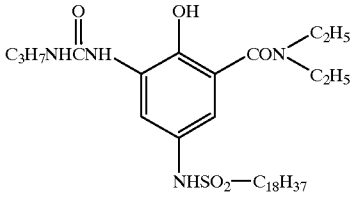
A-20
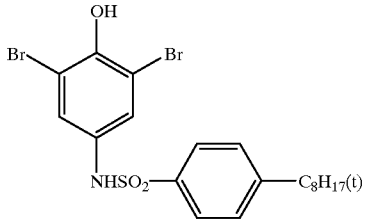
A-21
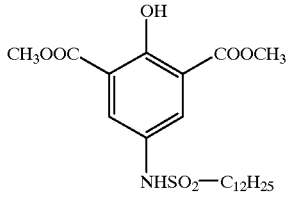
A-22
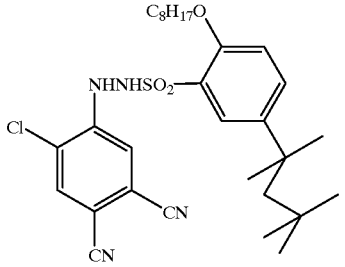

-continued
A-23
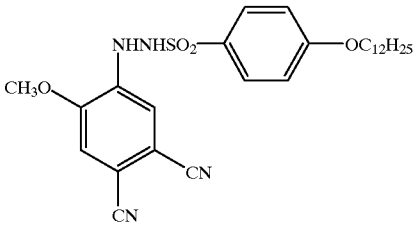
A-24
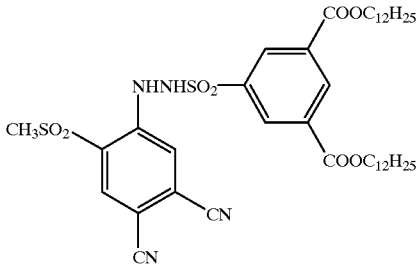
A-25
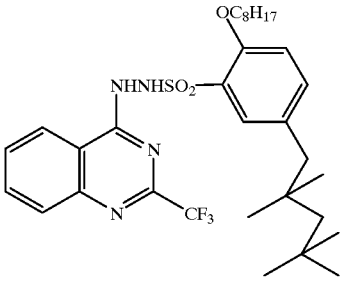
A-26
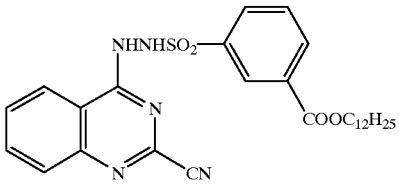
A-27
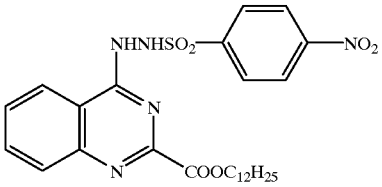
A-28
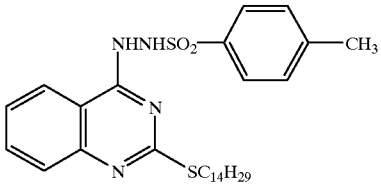
A-29
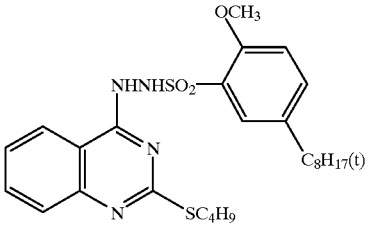
A-30
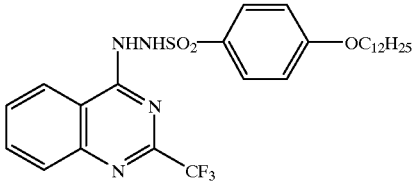
A-31
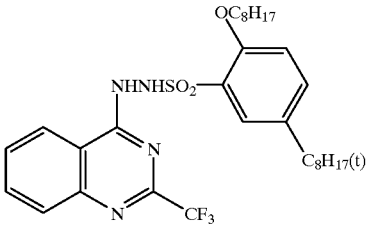
A-32
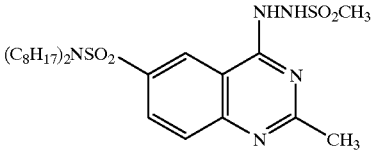
A-33
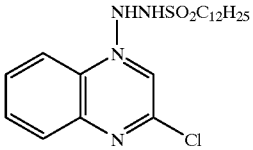
A-34
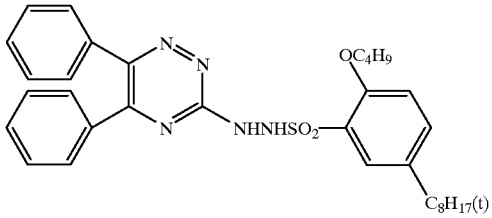

-continued
A-35
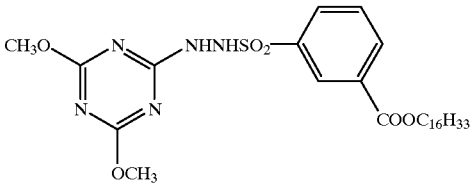
A-36
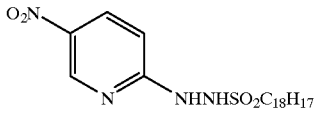
A-37
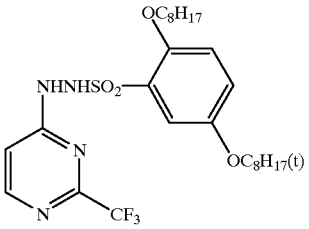
A-38
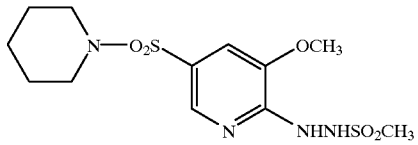
A-39
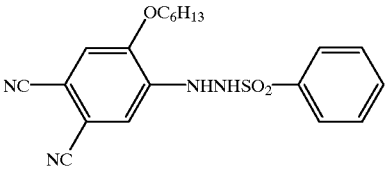
A-40
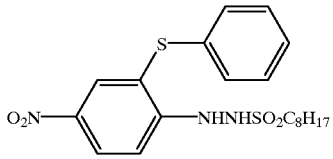
A-41
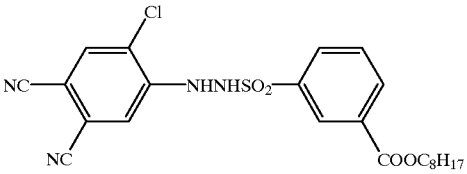
A-42
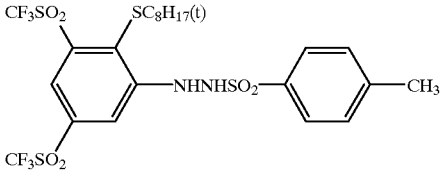
A-43
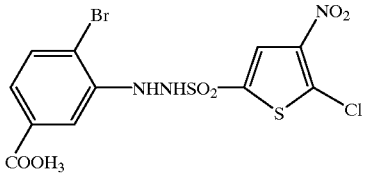
A-44
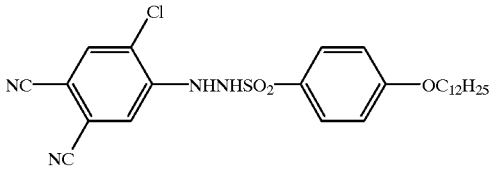
A-45
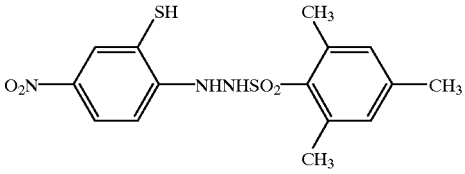
A-46
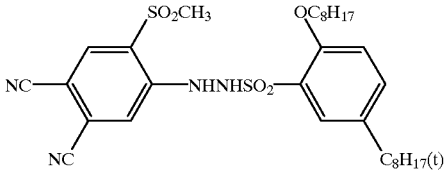
A-47
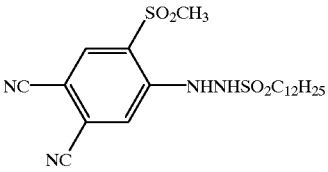

-continued
A-48
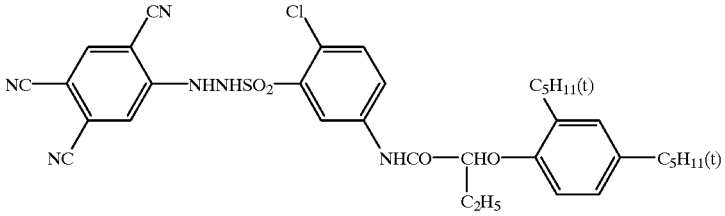
A-49
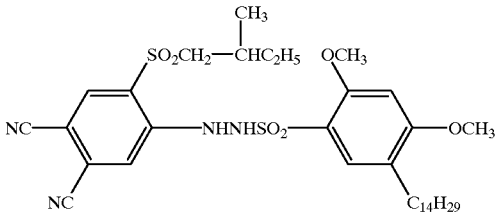
A-50
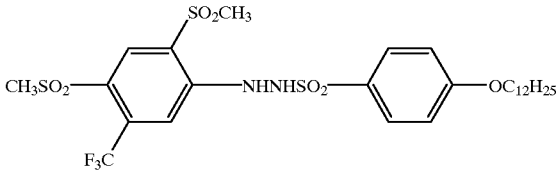
A-51
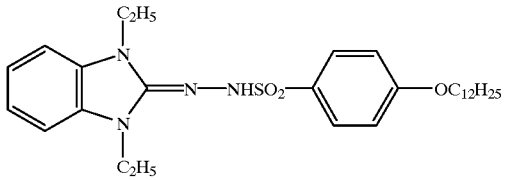
A-52
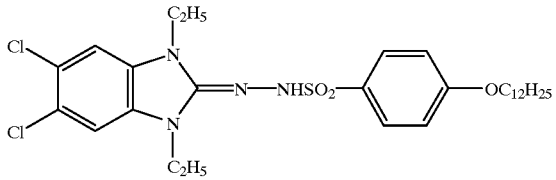
A-53
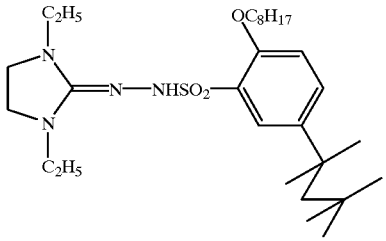
A-54
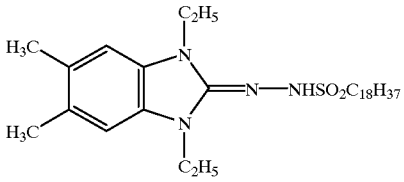
A-55
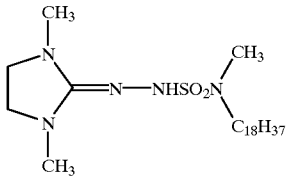
A-56
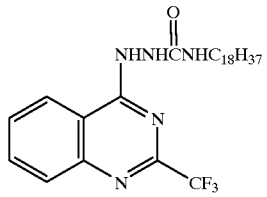
A-57
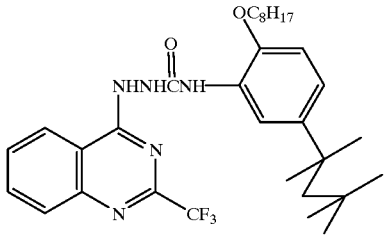
A-58
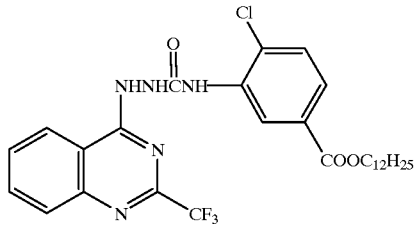

-continued
A-59
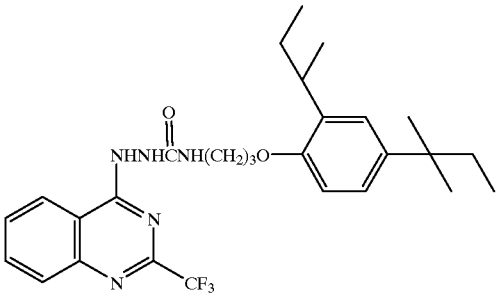
A-60
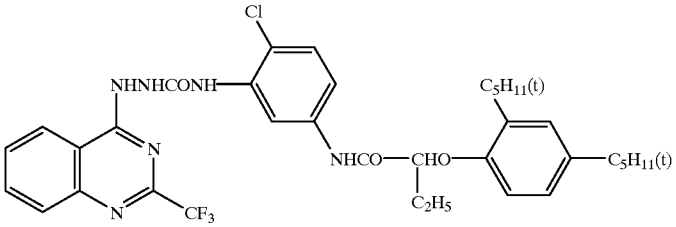
A-61
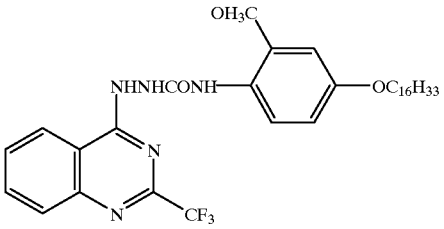
A-62
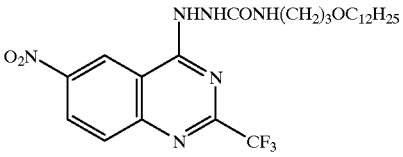
A-63
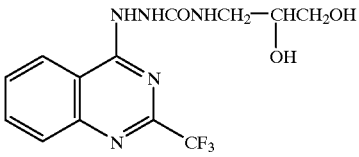
A-64
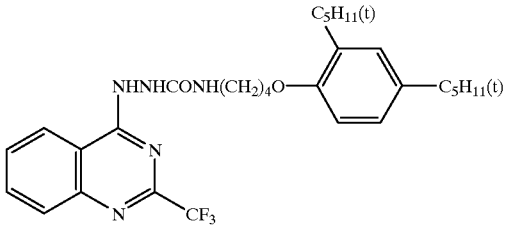
A-65
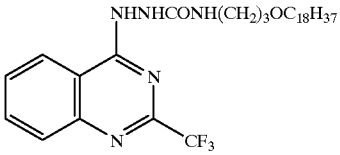
A-66
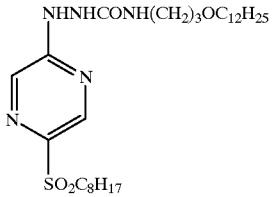
A-67
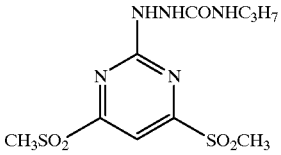
A-68
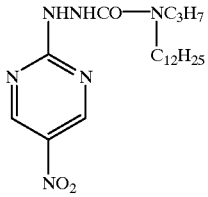

-continued
A-69
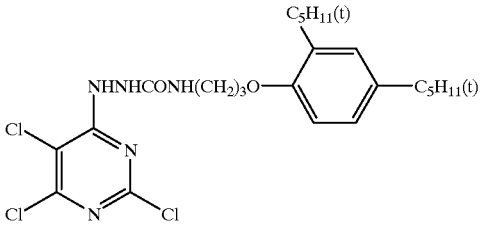
A-70
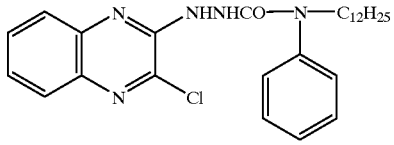
A-71
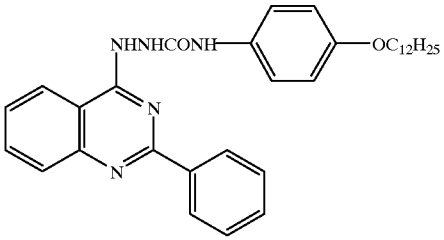
A-72
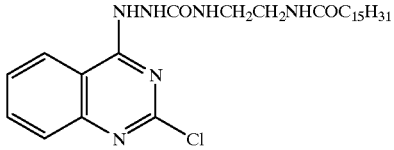
A-73
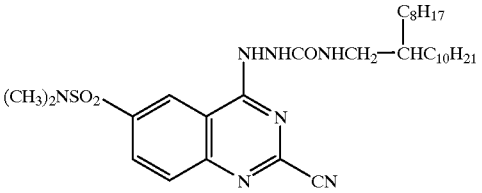
A-74
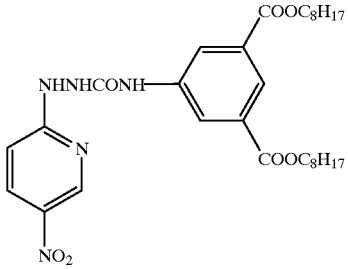
A-75
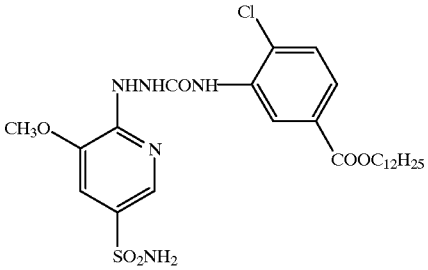
A-76
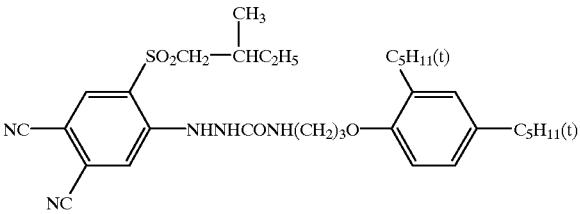
A-77
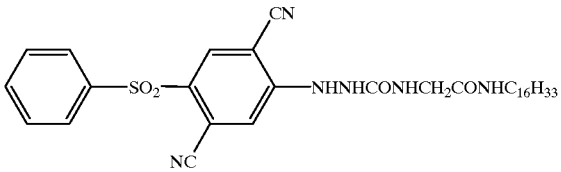
A-78
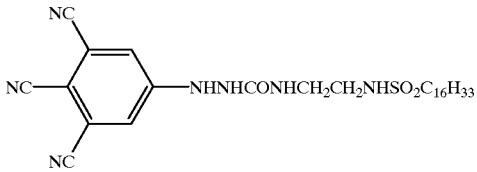

-continued
A-79
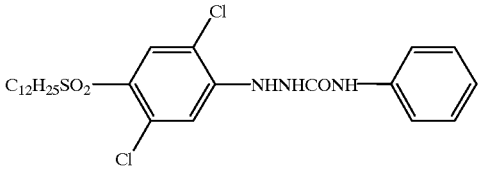
A-80
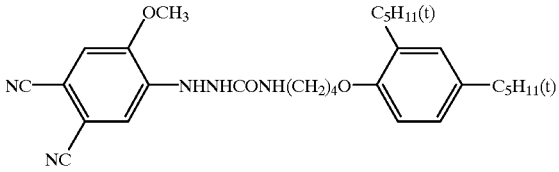
A-81
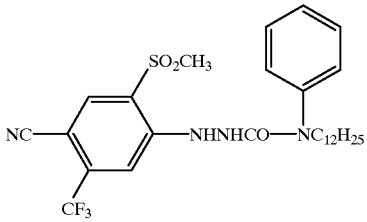
A-82
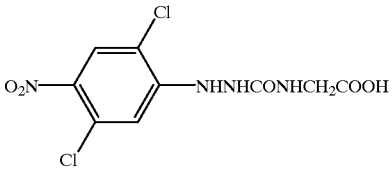
A-83
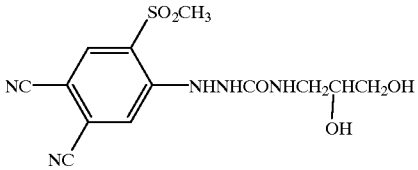
A-84
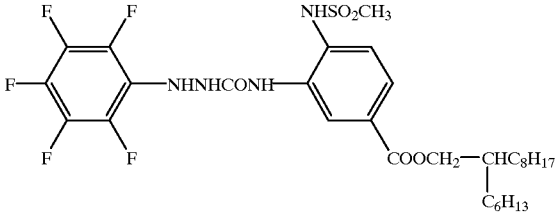
A-85
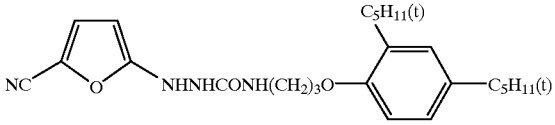
A-86
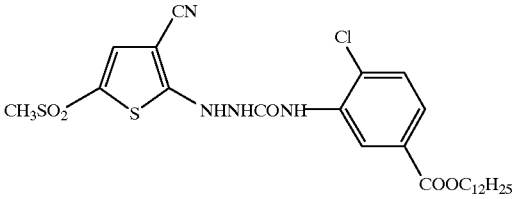
A-87
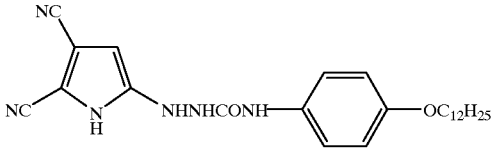
A-88
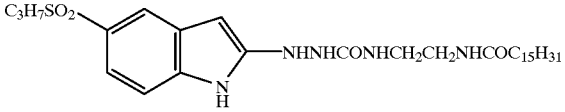
A-89
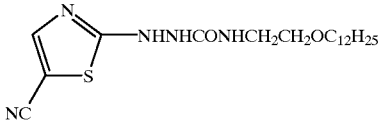
A-90
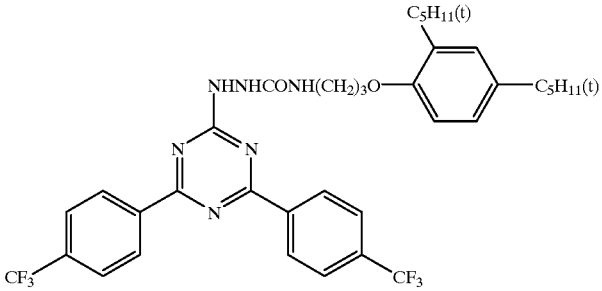

-continued
A-91
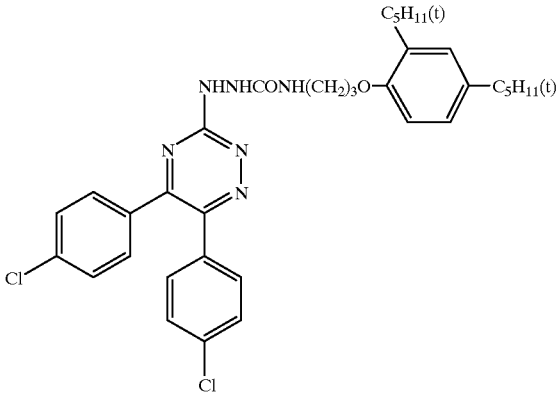
A-92
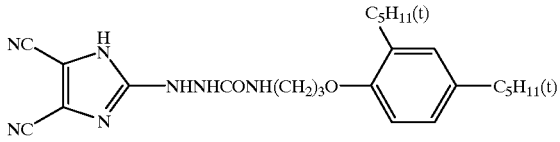
A-93
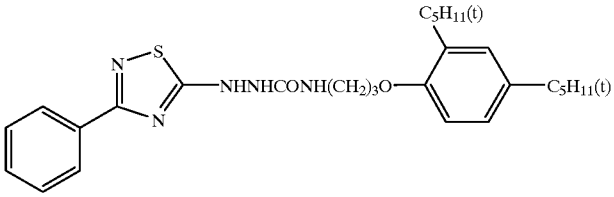
A-94
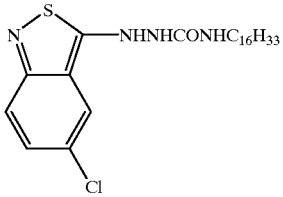
A-95
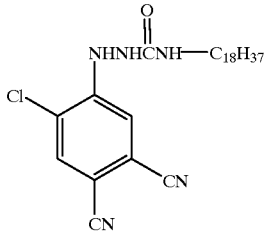
A-96
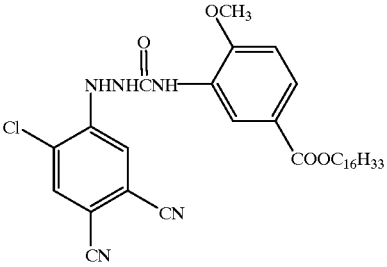
A-97
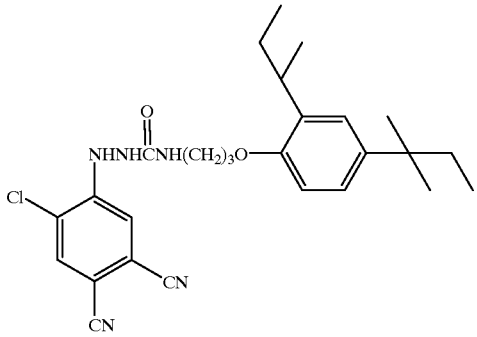
A-98
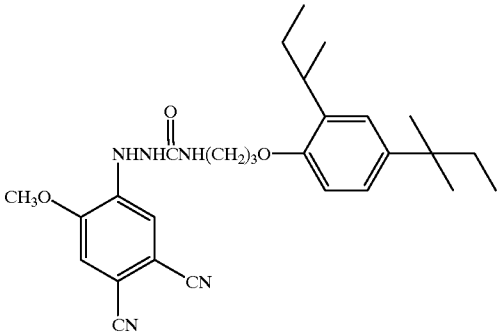
A-99
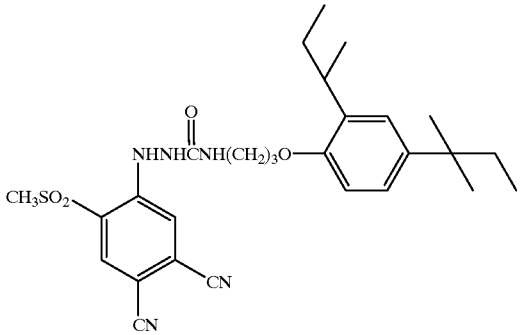

-continued
A-100
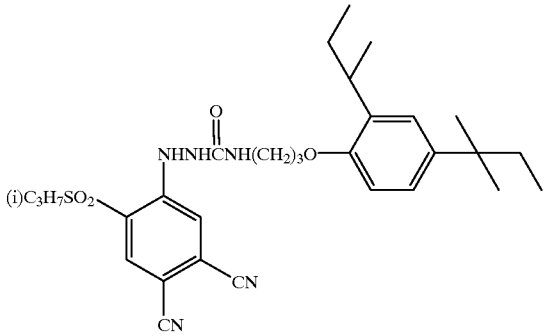
A-101
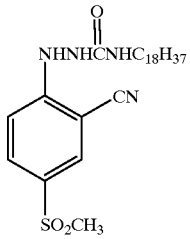
A-102
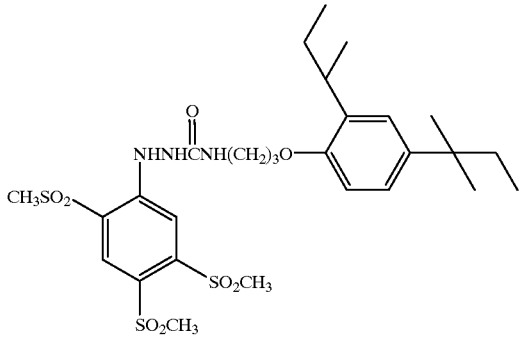
A-103
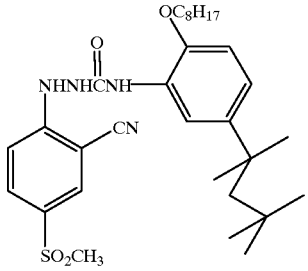
A-104
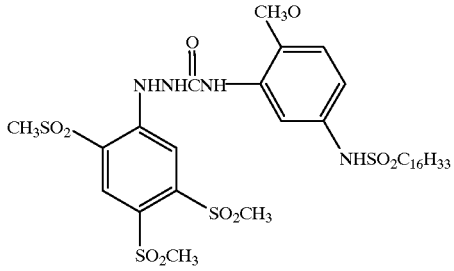
A-105
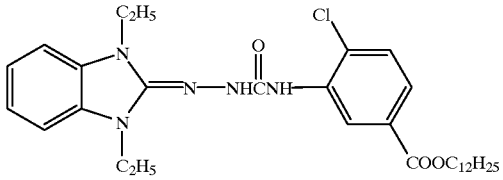
A-106
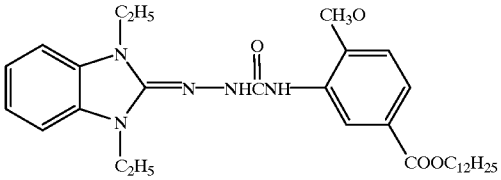
A-107
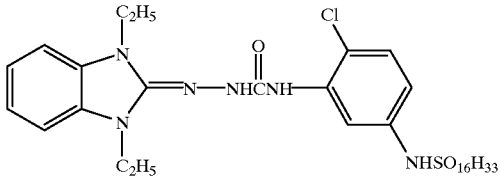
A-108
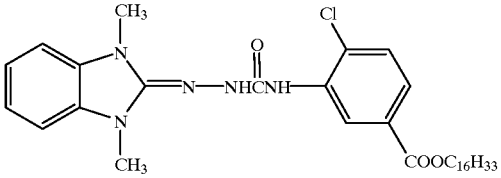
A-109
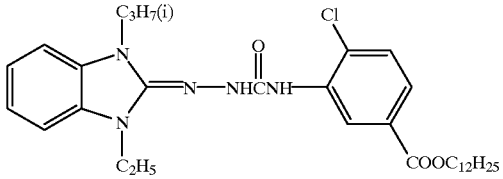
A-110
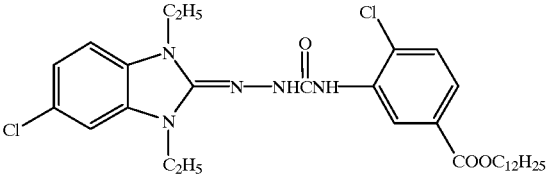
A-111
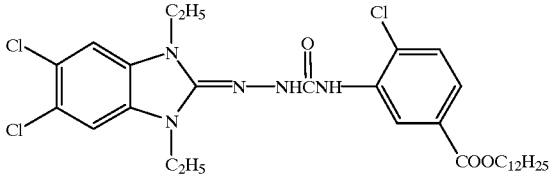

-continued

A-112

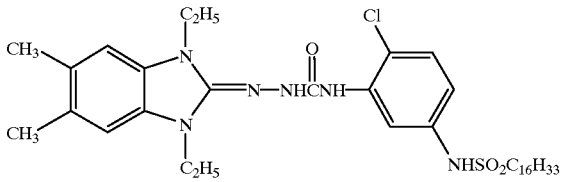

A-113

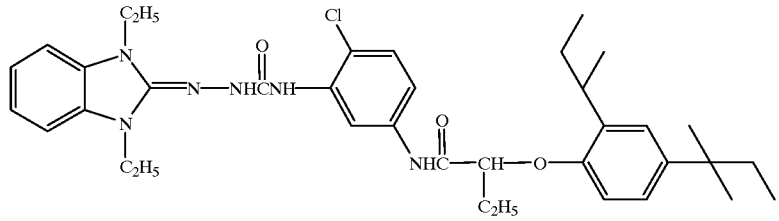

A-114

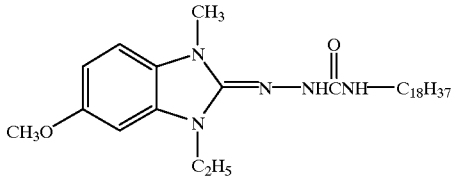

A-115

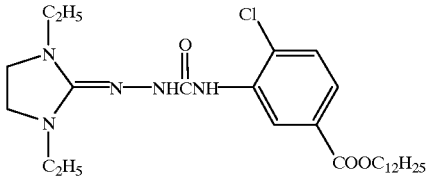

A-116

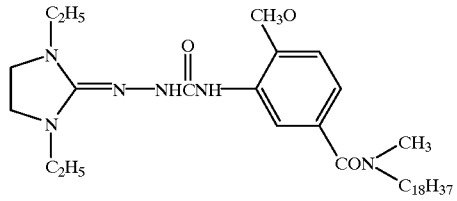

A-117

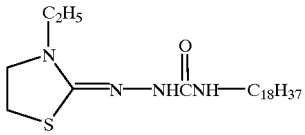

A-118

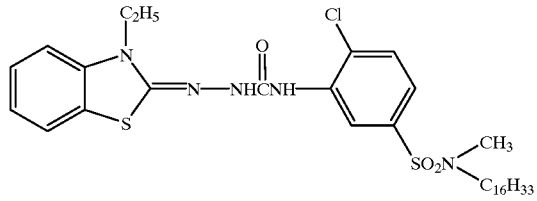

A-119

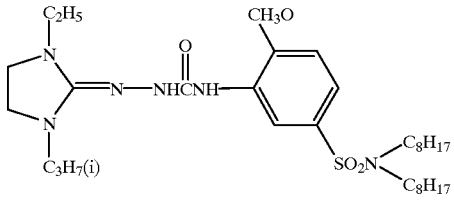

The developing agent is contained preferably in an amount of −0.05 to 10 mmol/m$^2$ (more preferably 0.1 to 5 mmol/m$^2$, and still more preferably 0.2 to 2.5 mmol/m$^2$) per layer.

Coupler

Next, a coupler will be described. The coupler used in the invention is referred to as a compound capable of forming a dye upon reaction with an oxidation product of a color developing agent. Preferred couplers used in the invention are those represented by he following formulas (Cp-1) to (Cp-12). These are generall called an active methylene, pyrazolone, pyrazoloazole or phenol naphthol coupler.

Formula Cp-1

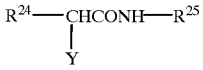

Formula Cp-2

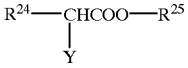

-continued

Formula Cp-3

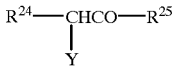

Formula Cp-4

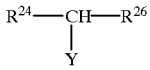

Formula Cp-5

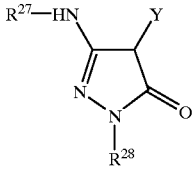

-continued

Formula Cp-6

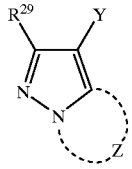

Formula Cp-7

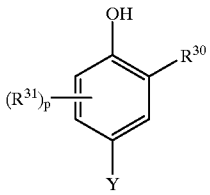

Formula Cp-8

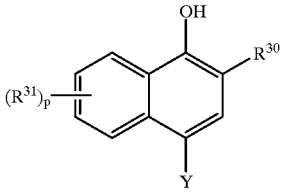

Formula Cp-9

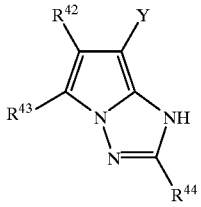

Formula Cp-10

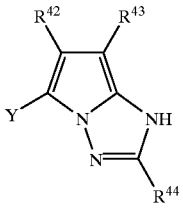

Formula Cp-11

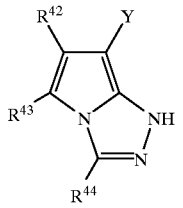

Formula Cp-12

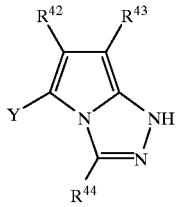

The compounds represented by formulas (Cp-1) to (Cp-4) are generally called active methylene type couplers, in which $R^{24}$ represents an acyl group, cyano, nitro, an aryl group, heterocyclic group, alkoxycarbinyl group, aryloxycarbonyl group, carbamoyl goup, sulfamoyl group, alkylsulfonyl group, and arylsulfonyl group, each of which may be substututed. $R^{25}$ represents an alkyl group, aryl group or heterocyclic group, each of which may be substituted. $R^{26}$ an aryl group or heterocyclic group, which may be substituted. Exemplary substutuents for $R^{24}$, $R^{25}$ and $R^{26}$ include an alkyl group, cycloalkyl group, alkenyl group, alkinyl group, aryl group, aryl group, heterocyclic group, alkoxy group, aryloxy group, cyano, halogen atom, acylamino group, sulfonamido group, carbamoyl group, sulfamoyl group, alkoxycarbonyl group, aryoxycarbonyl group, alkylamino group, arylamino group, hydroxy, and sulfo group. Preferred examples of $R^{24}$ include an acyl group, cyano, carmoyl group and alkoxycarbonyl group.

In formulas (Cp-1) to (Cp-4), Y represents a hydrogen atom or a group capable of being released upon coupling reaction. Examples of Y, as an anionic releasing group of two-equivalent coupler, include a halogen atom (e.g., chlorine, bromine), alkoxy group (e.g., methoxy, ethyl, butoxy), aryloxy group (e.g., pheoxy), alkylthio group (e.g., methylthio, ethylthio, butykthio), arylthio group (e.g., phenylthio, tolylthio), alkylcarbamoyl group (e.g., methylcarbamoyl, dimethylcarbamoyl, ethylcarbamoyl, diethylcarbamoyl, dibutylcarbamoyl, piperidylcarbamoyl, morpholylcarbamoyl), arylcarbamoyl (e.g., phenylcarbamoyl), methylphenylcarbamoyl, ethylphenylcarbamoyl, benzylphenylcarbamoyl), carbamoyl group, alkylsulfamoyl group (e.g.,methylsulfamoyl, dimethylsulfamoyl, ethylsulfamoyl, diethylsulfamoyl, dibutylsulfamoyl, piperidylsulfamoyl, morphorylsulfamoyl), arylsulfamoyl group (e.g., phenylsulfamoyl, methylphenylsulfamoyl, ethylphenylsulfamoyl, benzylphenylsulfamoyl), sulfamoyl group, cyano group, alkylsulfonyl group (e.g., methanesulfonyl, ethanesulfonyl), arylsulfonyl group (e.g., phenylsulfonyl, 4-chlorophenylsulfonyl, p-toluenesulfonyl), alkylcarbonyloxy group (e.g., acetyloxy, ptopionyloxy, butyloyloxy), arylcarbonyloxy group (e.g., benzoyloxy, toluyloxy, anusyloxy), and nitrogen-containing heterocyclic group (e.g., imidazolyl, benzotriazolyl). Examples of Y, as a cationic releasing group of four-equivalent coupler include a hydrogen atom, formyl group, carbamoyl group, substituted methylene group (in which examples of substituents include an aryl group, sulfamoyl group, carbamoyl group, alkoxy group, amino v and hydroxy), acyl group and sulfonyl group. In formulas (Cp-1) to (Cp-4), $R^{24}$ and $R^{25}$, or $R^{24}$ and $R^{26}$ may be combined with each other to form a ring.

Formula (Cp-5) represents a coupler generally called a 5-pyrazolone type magenta coupler, in which $R^{27}$ represents an alkyl group, aryl group, acyl group or carbamoyl group; $R^{28}$ represents a phenyl group or a phenyl group substituted by at least a hlaogen atom, alkyl group, cyano, alkoxy group, alkoxycarbonyl group or acylamino group; and Y is the same as defined in (Cp-1) to (Cp-4). Of the 5-pyrazolone type magenta couplers represented by formula (Cp-5) are preferably those, in which $R^{27}$ is an aryl or acy group and $R^{28}$ is a phenyl group substituted bu at least a halogen atom. Exemplary preferred $R^{27}$ include an aryl group such as phenyl, 2-chlorophenyl, 2-methoxyphenyl, 2-chloro-5-tetradecanamidophenyl, 2-chloro-5-(3-octadecenyl-1-succinimido)phenyl, 2-chloro-5-octadecylsulfonamidophenyl or 2-chloro-5-[2-(4-hydroxy-3-t-butylphenoxy)tetradecaneamido]pheny; and an acyl group such as acetyl, pivaloyl, tetradecanoyl, 2-(2,4-di-t-pentylpheoxy)acetyl, 2-(2,4-di-t-pentylphenoxy)butanoyl, benzoyl or 3-(2,4-di-t-amylphenoxyacetoamido)benzoyl, each of which may be substituted by a substituent, which is an organic substituent having a bonding attached to a carbon atom, oxygen atom, nitrogen atom or sulfur atom, or a halogen atom. R28 is preferably a substituted phenyl group, such as 2,4,6-trichlorophenyl, 2,5-dichlorophenyl or 2-chlorophenyl.

Formula (Cp-6) represents a pyrazoloazole type coupler, in which R29 represents a hydrogen atom or a substituent; Z represents an atomic group necessary to form a 5-membered azole ring (including condensed azole ring) containing 2 to 4 nitrogen atoms; and Y is the same as defined in (Cp-1) to (Cp-4). Of the pyrazoloazole type couplers represented by formula (Cp-6), imidazo[1,2-b] pyrazoles described in U.S. Pat. No. 4,500,630, pyrazolo[1, 5-b][1,2,4]triazoles described in U.S. Pat. No. 4,540,654, and pyrazolo[5,1-c][1,2,4]triazoles described in U.S. Pat. No. 3,725,067 are preferred in terms of absorption characteristics of the dye; and of these is preferred pyrazolo[1,5-b][1,2,4]triazole in terms of light fastness. Substituent R29 and substituent for the azole ring, which is represented by Y and Z, are detailed, for example, in U.S. Pat. No. 4,540,654, col. 2, line 41- to col. 8 line 27. Specifically, a pyrazoloazole coupler described in JP-A 61-65245, in which branched an alkyl group is directly attached to the 2-, 3- or 6-position of the pyrazoloazole group; a pyrazoloazole coupler described in JP-A 61-65245, in which a sulfonamido group is contained in the molecule; a pyrazoloazole coupler containing an alkoxyphenylsulfonamido ballast group, described in JP-A 61-147245; a pyrazoloazole coupler containing an alkoxy or aryloxy group at the 6-position, described in JP-A 62-209457 and 63-307453;a pyrazoloazole coupler containing a carbonamido group, described in JP-A 2-201443 are preferred.

Couplers represented by formulas (Cp-7) and (Cp-8) are those which are generally called phenol type coupler and naphthol type coupler, respectively. In the formulas, $R^{30}$ representsa hydrogen atom or a group selected from —$NHCOR^{32}$, —$SO_2NR^{32}R^{33}$, —$NHSO_2R^{32}$, —$NHCOR^{32}$, —$NHCONR^{32}R^{33}$ and —$NHSO_2NR^{32}R^{33}$, in which $R^{32}$ and$R^{33}$ each represent a hydrogen atom ot a substituent; $R^{31}$ represents a substituent; 1 is 0, 1 or 2; m is 0, 1, 2, 3 or 4; Y is the same as defined in (Cp-1) to (Cp-4); and $R^{31}$ to $R^{33}$ is the same as defined in $R^{24}$ to $R^{26}$.

Preferred examples of the phenol type coupler represented by formula (Co-7) include 2-alkylamino-5-alkylphenol type described in U.S. Pat. Nos. 2,369,929, 2,801,171, 2,772,162, 2,895,826 and 3,772,002; 2,5-diacylaminopheno; type, decribed in U.S. Pat. Nos. 2,772,162, 3,758,308, 4,126,396, 4,334,011 and 4,327,173, West German Patent 3,329,729, and JP-A 59-166956; and 2-phenylureidi-5-acylaminophenol type, described in U.S. Pat. Nos. 3,446, 622, 4,333,999, 4,451,559 and 4,427,767. Preferred examples of the naphthol type coupler represented by formula (Cp-8) include 2-carbamoyl-1-naphthol type, described in U.S. Pat. Nos. 2,474,293, 4,052,212, 4,146,396, 4,228,233 and 4,296,200; and 2-carbamoyl-5-amido-1-naphthol type described in U.S. Pat. No. 4,690,889.

Couplers represented by formulas (Cp-9) to (Cp-12) are those which are generally called a pyrrolotriazole coupler, in which $R^{42}$, $R^{43}$ and $R^{44}$ eacg represent a hydrogen atom or a substituent; Y is the same as defined in (Cp-1) to (Cp-4). Substituents for $R^{42}$, $R^{43}$ and $R^{44}$ are the same as those for $R^{24}$ to $R^{26}$. Preferred examples of the pyrrolotriazole type coupler include those described in European Patent 488, 248A1, 491,197A1, and 545,300, in which at least one of $R^{42}$ and $R^{43}$ is an electron-attractive group.

Further, couplers having a structure such as a condensed phenol, imidazole, pyrrole, 3-hydroxypyridine, active methylene, 5,5-condensed heterocyclic ring and 5,6-condensed heterocyclic ring are also employed. Examples of the condensed phenol type coupler include those described in U.S. Pat. Nos. 4,327,173, 4,564,586 and 4,904,575. The imidazole type couplers include those described in U.S. Pat. Nos. 4,818,672 and 5,051,347. The pyrrole type couplers include those described in JP-A 4-188137 and 4-190347. the 3-hydroxypyridine type couplers include those described in JP-A 1-315736. The active methylene type couplers include those described in U.S. Pat. Nos. 5,104,783 and 5,162,196. The 5,5-condensed heterocyclic ring type couplers include pyrrolopyrazole type couplers described in U.S. Pat. No. 5,164,289 and pyrroloimidazole type couplers described in JP-A 4-174429. The 5,6-condensed heterocyclic type couplers includepyrazolopyrimidine type couplers described in U.S. Pat. No. 4,950,585, pyrrolotrazine type couplers described in JP-A 4-204730, and couplers described in European Patent 556,700.

Besides couplers described above, there may also be employed West German Patent 3,819,051A and 3,823,049; U.S. Pat. Nos. 4,840,883, 5,024,930, 5,051,347 and 4,481, 268; European Patent 304,856A2, 329,036, 354,549A2, 374,781A2 and 379,110A2, 386,930A1; JP-A 63-141055, 64-32260, 64-32261, 2-297547, 2-44340, 2-110555, 3-7938, 3-160440, 3-172839, 4-172447, 4-179949, 4-182645, 4-184437, 4-188138, 4-188139, 4-194847, 4-204532, 4-204731 and 4-204732.

In silver halide photographic materials used in the invention are generally employed compounds called a yellow coupler, a magenta coupler and a cyan coupler. The compounds, which are generally employed in color photographic materials are those capable of forming, upon development with a p-phenylenediamine type color developing agent, dyes having spectral absorption maximums in the blue region (of the wavelengths of 350 to 500 nm), the green region (of the wavelength of 500 to 600 nm) and red region (of the wavelengths of 600 to 750 nm). However, in cases where developed with the developing agent represented by formulas I to V (specifically, formulas I to IV), the dye formed on coupling exhibits a different absorption maximum from the wavelength region described above. Therefore, the kind of a coupler to be used has to optimally be selected in accordance with the kind of a developing agent to be used. The photographic materials used in the invention are not always to be designed so that the formed dyes exhibit the absorption maximum in the wavelength regions described above. Thus the dye may have an absorption maximum in the UV or infrared region, and these region may be combined with the visible region.

Couplers used in the invention may contain a polymer chain as a ballast group. A four-equivalent coupler or two-equivalent coupler may be employed in accordance with the kind of the developing agent to be used. When a developing agent represented by formula I, II or III are employed, the use of four equivalent couplers is preferred. When a developing agent represented by formula IV or V, the use of a two-equivalent coupler is preferred. Exemplary examples of the four-equivalent and two-equivalent couplers are detailed in The Theory of the Photographic Process (4th Ed., T. H. James, Macmillan, 1977) page 291–334 and 354–361; JP-A 58-12353, 58-149046, 58-149047, 59-11114, 59-124399, 59-174835, 59-231539, 59-231540, 60-2951, 60-14242, 60-23474, 60-66349, 8-110608, 8-146552, 8-146578 and 9-204031; and literature and patents aforementioned.

The photographic materials used in the invention may contain functional couplers described below. Couplers used for correction of an unwanted absorption of the formed dye include yellow-colored cyan couplers and yellow-colored magenta couplers described in European Patent 456,257A1, magenta-colored cyan couplers described in U.S. Pat. No. 4,833,069, and colorless masking couplers represented by formula (2) in U.S. Pat. No. 4,837,136 or formula (A) of claim 1 of WO92/11575 (specifically, exemplified compounds at page 36–45). Examples of compounds (including couplers) which are capable of releasing a photographically useful group, include Compounds (I) to (IV) described in European Patent 378,236A1 at page 11; Compounds (I) described in European Patent 436,938A2 at page 7; Compounds (1) described in Japanese Patent Application 4-134523; Compounds (I), (II), and (III) described in European Patent 440,195A2 at page 6; compounds capable of releasing a ligand, which are represented by formula (1) of claim 1 of Japanese Patent Application 40325564; and Compounds represented by formula LIG-X, as described in U.S. Pat. No. 4,555,478, claim 1.

Couplers usable in the invention may be used alone or in combination, or in combination with other coupler(s). The coupler is preferably incorporated in a layer together with a developing agent or a silver halide emulsion. The amount to be incorporated is preferably 0.05 to 20 mols, more preferably 0.1 to 10 mols, and still more preferably 0.2 to 5 mols per mol of a developing agent; and 0.01 to 1 mol, and more preferably 0.02 to 0.6 mol per mol of silver halide. In these ranges can be obtained sufficient dye densities.

Hydrophobic additives such as a coupler or a developing agent may be incorporated in accordance with the known method, as described in U.S. Pat. No. 2,322,027. In this instance, a high boiling solvent is employed, optionally in combination with a low boiling solvent of a boiling point of 50 to 160° C., as described in U.S. Pat. Nos. 4,555,470, 4,536,466, 4,536,467, 4,587,206, 4,555,476 and 4,599,296; and JP-B 3-62256 (herein the term, JP-B means examined and published Japanese Patent). The coupler and high boiling solvent each are employed in combination. The amount of the high boiling solvent is preferably 10 g or less, more preferably 5 g or less, and still more preferably 0.1 to 1 g per g of the hydrophobic additive; and preferably 1 ml or less, more preferably 0.5 ml or less, and still more preferably 0.3 ml or less per g of binder. There are also applicable a dispersing method by use of a polymeric material, as described in JP-A 51-39853 and 51-59943; and an adding method in the form of a fine particle dispersion, as described in JP-A 62-30242. Compounds which are substantially insoluble in water may be incorporated in the form of fine particles dispersed in binder. The hydrophobic compound may be dispersed in a hydrophilic colloid using various surfactants, as described in JP-A 59-157636 at page (37)–(38) and the Research Disclosures afore-mentioned. There are also usable phosphoric acid ester type surfactants, as described in Japanese Patent Application 5-204325 and 6-19247 and West German Patent 1,932,299A.

Organic Silver Salt

In the invention, organic metal salts are employed as an oxidizing agent, together with photosensitive silver halide. Of organic metal salts, organic silver salts are preferably employed. Organic compounds forming a silver salt oxidizing agent include benzotriazoles, fatty acids and other compounds, as described in U.S. Pat. No. 4,500,626, cols. 52 to 53. Acetylenic silver salt described in U.S. Pat. No. 4,775,613 is also usable. The organic silver salts may be employed in combination. The organic silver salt is employed preferably in an amount of 0.01 to 10, and more preferably 0.05 to 3 mol per mol of the photosensitive silver halide. The total coating amount of silver halide and organic silver salts is preferably 0.05 to 10 g/m$^2$, and more preferably 0.1 to 4 g/m$^2$.

Antifoggant

A variety of antifoggants, stabilizers and their precursors can be employed in the photographic materials used in the invention. Exemplary examples thereof are described in the afore-mentioned Research Disclosures; U.S. Pat. Nos. 5,089,378, 4,500,627 and 4,614,702; JP-A 64-13564 at pages (7) to (9), (57) to (71) and (81) to (97); U.S. Pat. Nos. 4,775,610, 4,626,500 and 4,983,494; JP-A 62-174747, 62-239148, 1-150135, 2-110557 and 2-178650; RD 17643 (1978) at pages (24) to (25). The compound is incorporated preferably in an amount of $5\times10^{-6}$ to $1\times10^{-1}$ mol, and more preferably $1\times10^{-5}$ to $1\times10^{-2}$ mol per mol of silver.

Layer Arrangement

The photographic material used in the invention may be provided, between silver halide emulsion layers or as the uppermost or lowermost layer, with various non-photosensitive layer, such as a protective layer, sub-coating layer, interlayer, yellow filter layer or antihalation layer. On the opposite side of the support may also be provided various auxiliary layers such as backing layer. Examples thereof include a sublayer described in U.S. Pat. No. 5,051,335; an interlayer containing solid colorant described in JP-A 1-167838 and 61-20943; an interlayer containing a reducing agent or a DIR compound described in JP-A 1-120553, 5-34884 and 2-64634; an interlayer containing an electron transferring agent described in U.S. Pat. Nos. 5,017,454 and 5,139,919 and JP-A 2-235044; a protective layer containing a reducing agent described in JP-A 4-249245; or the combination of these layers.

Dye

In the photographic material used in the invention, dyes having absorption in various wavelength regions may be contained for the purpose of antiirradiation or antihalation. In conventional color photographic materials, colloidal silver has often been employed in a yellow filter layer or an antihalation layer. In this case, the photographic material, after development, is to be subjected to bleach to remove the colloidal silver. However, a photographic material which does not need the bleaching step is preferred in terms of simplicity od processing. Accordingly, instead of colloidal silver is preferred the use of a dye capable being decolorized, leached out or trabsferred, exhibiting little contribution to the color density after development. The dye being decolorized or removed during processing means that the residual amount of the dye after processing is preferably ⅓ or less, and more preferably 1/10 or less of the dye before being subjected to processing. The dye may be leached out or transferred into processing material, or changed to a colorless compound during processing. The dye may be incorporated into a silver halide emulsion layer or a non-photosensitive layer. To allow sensitivity to be compatible with sharpness, a dye which exhibits absorption in the same wavelength region as photosensitivity of a silver halide emulsion layer is preferably incorporated into a layer provided on the opposite side to a exposure light source of the silver halide emulsion layer.

There can be employed known dyes in the photographic material. Examples thereof include dyes soluble in a developing solution or alkaline solution or deys capable of being decolorized upon reaction with a developer component, sulfite ion or alkali, such as dyes described in European Patent 549,489A or exemplified F2 to F6 described in JP-A 7-152129. The dye may be employed in processing with a developer solution, and preferably employed in thermal-processing using a processing sheet.

In cases where using a processing solution, dyes having an absorption in the visible region described in JP-A 3-251840 at page 308 (exemplified dyes AI-1 to 11) and JP-A 6-3770 are preferably employed. JP-A 1-280750 discloses infrared-absorbing dyes, in which compounds represented by formulas (I), (II) and (III) at page 2, left lower column exhibit preferable absorption characteristics, no adverse effect on the photographic material and little residual dye stain. Examples of the preferred compounds include Compounds (1) to (45) described in the disclosure at page 3, left lower column to at page 5, left lower column.

The dye may be mordanted together with a mordant and binder. There can employed mordants and dyes known in the photographic art, including mordants described in U.S. Pat. No. 4,500,626, col. 58–59 and JP-A 61-88256 at page 32–41, 62 -244043 and 62-244036. Further, a compound capable of releasing a diffusible dye upon reaction with a reducing agent, and a reducing agent may be employed, in which a alkali-movable dye is released in development and leached out into a processing solution or transferred to a processing sheet. Examples thereof are described in U.S. Pat. Nos. 4,559,290 and 4,783,369; European Patent 220, 746A2; and KOKAI GIHO No. 87-6119 and Japanese Application No. 6-25980 at 0080 to 0081.

Leuco dyes may be employed. Exemplarily, JP-A 1-150132 discloses silver halide photographic materials containing a leuco dye which has been developed with an organic metal salt developer. A complex of the leuco dye and developer is decolorized with heating or an alkaline agent so that a combination of a leuco dye and a developer is preferred in thermal processing. Known leuco dyes can be employed, as described in Moriga & Yoshida, "Senryo to Yakuhin" (Dyes and Chemicals) Vol. 9, page 84; "Senryo-binran" (Handbook of Dyes) page 242 (Maruzen, 1970); R. Garner, Reports on the Progress of Appl. Chem. Vol. 56, 199 (1971); Senryo to Yakuhin (Dyes and Chemicals) Vol. 19, 239 (1974); Shikizai (Colorant) Vol. 62, 288 (1989); and "Senryo Kogyo" Vol. 32, 208. As a developer are employed acid clay type developers, phenol-formaldehyde resins, and organic metal salts.

Binder

Hydrophilic binder binders are employed in the component layers of the photographic materials used in the invention, for example, as described in the Research Disclosures described above and JP-A 64-13546 at page (71)–(75). Specifically, transparent or semi-transparent, hydrophilic binders are preferably employed. Exemplary examples thereof include naturally occurring substances including proteins such as gelatin and its derivatives and polysaccharides such as cellulose derivatives, starch, gum arabic, dextran and pullulan, and synthetic polymeric compounds such as polyvinyl alcohol, polyvinyl pyrrolidone, and polyacrylamide. There is also employed a highly water-absorbing polymer described in U.S. Pat. No. 4,960,681 and JP-A 62-245260, including a homopolymer of vinyl monomers containing —COOM or —$SO_3M$ (in which M is an alkali metal), and copolymers of these monomers or copolymer with other monomer (such as sodium methacrylate, ammonium methacrylate or potassium acrylate). The binders are employed alone or in combination; specifically, a combination of gelatin and the binder described above is preferred. Gelatin is selected from various types of gelatins, such as lime-treated gelatin, acid-treated gelatin and calcium-free gelatin and a combination thereof is also preferably employed. The coating amount of the binder is preferably 20 g/$m^2$ or less and more preferably 10 g/$m^2$ or less.

The photographic materials used in the invention is preferably hardened with a hardener. Hardeners are exemplarily described in U.S. Pat. Nos. 4,678,739 at col. 41, and 4,791,042; JP-A 59-116655, 62-245261, 61-18942, 61-249054, 61-245153 and 4-218044. Exemplary examples thereof include aldehyde type hardeners (such as formaldehyde), aziridine type hardeners, epoxy type hardeners, vinylsulfone type hardeners [such as N,N'-ethylene-bis(vinylsulfonylacetoamido)ethane], boric acid, metaboric acid, and polymer hardeners (such as compounds described in JP-A 62-234157). Of these hardeners, vinylsulfone type hardeners or chlorotriazine type hardeners are preferably employed alone or in combination. The hardener is employed preferably in an amount of 0.001 to 1 g, and more preferably 0.005 to 0.5 g per g of binder.

Support

Supports usable in the invention are synthetic plastic films including polyolefins such as polyethylene and polypropylene, polycarbonates, cellulose acetate, polyethylene terephthalate, polyethylenenaphthalates, and polyvinyl chloride. Polystyrenes having a syndiotactic structure are also preferably employed. These polymers can be polymerized in accordance with the methods described in JP-A 62-117708, 1-46912 and 1-178505. Further, supports usable in the invention include paper support such as photographic raw paper, paper for use in printing, baryta paper, and resin-coated paper; a support having a reflection layer provided on the plastic film described above; and supports described in JP-A 62-253195 (page 29–31). There are also preferably employed supports described in the RD. No. 17643 at page 28 and No. 18716 at page 647, right column to 648, left column, and No. 307105 at page 879. Syndiotactic polystyrene is also preferred. These polymers can be obtained by polymerization according to the method described in JP-A 62-117708, 1-46912 and 1-178505. There may be employed a support which has been subjected to thermal treatment at a temperature lower than Tg to prevent roo-set curl. To enhance adhesion between the support and subbed layer, the support may be subjected to surface treatment, including grow discharge treatment, UV exposure treatment, corona discharge treatment and flame treatment. There may also employed a support described in Known Techniques (Mar. 22, 1991, published by Astech Corp.) at pages 44 to 149. Transparent supports such as polyethylene dinaphthalenedicarboxylate and those having thereon transparent magnetic particle coat. Supports usable in the photographic materials used in the invention are detailed in RD-17643 at page 28, RD-308119 at page 1009 and Product Licensing Index Vol. 92, page 108, Item "Support". In cases where the photographic material is subjected to thermal processing, the used support needs to have heat-resistance to the processing temperature.

Magnetic Recording Layer

A support having a magnetic recording layer may be employed to record picture-taking information, as described in JP-A 4-124645, 5-40321 and 6-35092, and Japanese Patent Application No. 5-58221 and 5-106979. The magnetic recording layer is formed by coating an aqueous or organic solvent type coating solution containing magnetic particles dispersed in binder. Examples of magnetic particles include ferromagnetic iron oxide such as $\gamma Fe_2O_3$, Co-coated Fe2O3, Co-coated magnetite, Co-containing magnetite, ferromagnetic metals, ferromagnetic alloy, hexagonal system Ba ferrite, Sr ferrite, Pb ferrite and Ca ferrite. Of these, Co-coated ferromagnetic iron oxide such as $\gamma Fe_2O_3$ is preferred. Any form is acceptable, such as needle-like or rice grain-like form, or spherical, cubic or tabular form. The specific surface area is preferably 20 $m^2/g$ or more , more preferably 30 $m^2/g$, based on SBET. The saturation magnetization of a ferromagnetic material (σs) is preferably $3.0\times10^4$ to $3.0\times10^5$ A/m, and more preferably $4.0\times10^4$ to $2.5\times10^5$ A/m. Ferromagnetic particles may be surface-treated with silica and/or alumina, or organic material. Ferromagnetic particles may be surface-treated with a silane coupling agent or titanium coupling agent, as described in JP-A 6-161032. There may also be employed magnetic particles, the surface of which is treated with inorganic or organic material, as described in JP-A 4-259911 and 5-81652.

Binders used with magnetic particles include thermoplastic resin, thermo-setting resin, radiation-hardenable resin, reaction type resin, acid-, alkali- or biodegradable polymer, natural polymers (e.g., cellulose derivatives, saccharide derivatives) and mixture thereof. The Tg of the resins described above preferably −40° C. to 300° C., and the weight-averaged mean molecular weight is preferably 2,000 to 1,000,000. Examples of resins include vinyl type copolymer; cellulose derivatives such as cellulose diacetate, cellulose triacetate, cellulose acetate-propionate, cellulose acetate-butylate, and cellulose tripropionate; acryl resins; polyvinyl acetals; and gelatin is also preferred. Specifically, cellulose (tri)acetate is preferred. The may be hardened using epoxy type, aziridine type or isocyanate type hardeners. Examples of the isocyanate type hardener include isocyanates such as tolylene diisocyanate, 4,4'-diphenylenemethaneisocyanate, hexamethylene diisocyanate and xylylene diisocyanate; by-product from these isocyanates and polyalcohols (e.g., reaction product from 3 mol of tolylene diisocyanate and 1 mol of trimethylol propane) and polyisocyanate produced by condensation of these isocyanates, as described in JP-A 6-59357.

The magnetic material is dispersed in binder in such a manner as described in JP-A 6-35092, using kneader, pin type mill or annular type mill. Dispersing agents described in 5-88283 and other known dispersing agents may be applicable. The thickness of the magnetic recording layer is preferably 0.1 to 10 μm, more preferably 0.2 to 5 μm, and more preferably 0.3 to 3 μm. The weight ratio of magnetic particles to binder is preferably 0.5:100 to 60:100, and more preferably 1:100 to 30:100. The coating weight of magnetic particles is preferably 0.005 to 3 $g/m^2$, more preferably 0.01 to 2 $g/m^2$ and still more preferably 0.02 to 0.5 $g/m^2$. The transmission yellow density of the magnetic recording layer is preferably 0.01 to 0.50, more preferably 0.03 to 0.20, and still more preferably 0.04 to 0.15. The magnetic recording layer may be coated or printed overall or in a stripe form on the back side of the photographic support. The magnetic recording layer can be coated using air doctor, blade, air knife, squeezing, immersion, reverse roll, transfer roll, gravure, kiss, casting, spraying, dipping, bar, and extrusion; and coating solutions described in JP-A 5-341436 are preferred.

The magnetic recording layer may further have function of lubrication enhancement, curl adjustment, antistatic, anti-adhesion or head cleaning. A functional layer may separately be provided to add such function. At least one kind of particles is an abrasive comprised of non-spherical inorganic particles having Moose hardness of 5 or more. The non-spherical inorganic particles are preferably oxides such as aluminum oxide, chromium oxide, silicon dioxide or titanium oxide; carbides such as silicon carbide or titanium carbide; and fine powdery particles such as diamond. The abrasive may be surface-treated with a silane coupling agent or titanium coupling agent. The particles may be incorporated into the magnetic recording layer or coated over the magnetic recording layer (e.g., protective layer or lubricating layer). In this case, binders described above are usable, and the binder is preferably the same as used in the magnetic recording layer. Photographic materials having a magnetic recording layer are described in U.S. Pat. Nos. 5,336,589, 5,250,404, 5,229,259 and 5,215,874; and European Patent 466,130.

Polyester supports used in photographic materials having the magnetic recording layer will be further described. In this regard, details including photographic materials, processing, cartridge and exemplary embodiments are described Kokai Giho No. 94-6023 (Mar. 15, 1994, published by Hatsumei Kyokai). Polyester is formed of a diol and an aromatic dicarboxylic acid. Aromatic dicarboxylic acids include 2,6-, 1,5-. 1,4- or 2.7-naphthalenedicarboxylic acid, terephthalic acid, isophthalic acid and phthalic acid. Diols include diethylene glycol, triethylene glycol, cyclohexane dimethanol, bisphenol A, and bisphenol. Examples of the polymer include homopolymers, such as polyethylene terephthalate, polyethylene naphthalate, and polycyclohexane dimethanol terephthalate. Of these is preferred a polyester containing 50 to 100 mol % 2,6-naphthalenedicarboxylic acid. Specifically, polethylene-2,6-naphthalate is preferred. The mean molecular weight is 5,000 to 200,000. The Tg of the polyester is preferably 50° C. or higher, more preferably 90° C. or higher.

The polyester support is subjected to thermal treatment at a temperature of not lower than 40° C. and not higher than Tg, and more preferably between Tg minus 20° C. and Tg. to lessen roll-set curl. The thermal treatment may be run at a constant temperature within this range or with cooling. The thermal treatment time is preferably from 0.1 to 1500 hrs., and more preferably 0.5 to 200 hrs. The thermal treatment may be carried out in a roll form or with transporting in a web-form. The surface may be roughened (for example, by coating conductive inorganic fine particles such as $SnO_2$ or $Sb_2O_5$) to improve the surface state. It is desirable to provide a knurl at the edge portions to raise the edge portion for the purpose of preventing transfer of the cutting edge of tail ends. The thermal treatment may be conducted at any time after film-making of the support, after surface treatment, after back-coating (e.g., of an antistatic agent or lubricant) or after sub-coating. Preferably, it is conducted after antistatic coating. The polyester may be compounded with a UV absorbent. To prevent light piping, commercially available dyes or colorants may be compounded, such as Diaresin available from Mitsubishi Kasei Corp. or Karayaset available from Nihon Kayaku Co. Ltd.

Activator Processing

One of preferred embodiments of processing photographic materials is activator processing The activator processing refers to a processing method in which a color developing agent is allowed to be occluded in a photographic material and the photographic material is developed with a processing solution containing no developing agent. In this case, the processing solution contains no color developing agent but contains other components [e.g., alkali, auxiliary developing agent such as a compound represented by formula (ETA-I or II) described below]. The activator processing is exemplarily described in European Patent 545,491A1 and 565,165A1. The pH of the activator processing solution is preferably 9 or more, and more preferably 10 or more.

Auxiliary Developing Agent

When the photographic material is subjected to the activator processing, an auxiliary developing agent is preferably employed. The auxiliary developing agent is a substance promoting electron transfer of from a developing agent to silver halide in the process of developing silver halide. The auxiliary developing agent may be added to an alkaline solution or incorporated into the photographic material. Processing with an alkaline solution containing an auxiliary developing agent is described in RD No. 17643 page 28–29, RD No. 18716 at page 651 left to right column, and RD No. 307105 at page 880–881. Preferred auxiliary developing agents used in the invention are represented by the follwing formula (ETA-I) or (ETA-II), which are electron releasing compounds obeying Kendall-Pertz law. Of these, the compounds of (ETA-1) is preferred.

Formula (ETA-I)

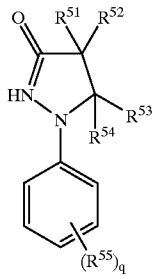

Formula (ETA-II)

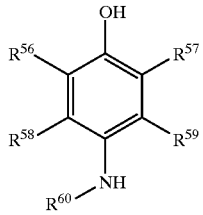

In the formula (ETA-I) and (ETA-II), $R^{51}$ to $R^{54}$ each represent a hydrogen atom, an alkyl group, cycloalkyl group, alkenyl group, aryl group, or heterocyclic group. R55 to R59 each represent a hydrogen atom, halogen atom, cyano, alkyl group, cycloalkyl group, alkenyl group, aryl group, heterocyclic group, alkoxy group, cycloalkyloxy group, aryloxy group, heterocyclic-oxy group, silyloxy group, acyloxy group, amino group, anilino group, heterocyclic-amino group, alkylthio group, arylthio group, heterocyclic-thio group, silyl group, hydroxy, nitro, alkoxycarbonyl group, cycloalkyloxycarbonyloxy group, aryloxycarbonyloxy group, carbamoyloxy group, sulfamoyloxy group, alkanesulfonyloxy group, arenesulfonyloxy group, acyl group, alkoxycarbonyl group, cycloalkyloxycarbonyl group, aryloxycarbonyl group, carbamoyl group, carbonamido group, ureido group, imido group, alkoxycarbonylamino group, aryloxycarbonylamino group, sulfonamido group, sulfamoylamino group, alkylsulfinyl group, arenesulfinyl group, alkanesufonyl group, arenesulfonyl group, sulfamoyl group. sulfo, phosphinoyl group or phosphinoylamino group. In the formulas, q is an integer of 0 to 5, provided that when q is 2 or more, $R^{55}$s may be different from each other; $R^{60}$ represents an alkyl group or aryl group. Exemplary examples of the compounds represented by formula (ETA-I) or (ETA-II) are described in Japanese Patent Application No. 10-44518 at page 26 to 30 including compounds (ETA-1) to (ETA-32).

In cases where the auxiliary developing agent is allowed to be occluded in the photographic material, the auxiliary developing agent may be contained in the form of a precursor thereof to enhance storage stability of the photographic material. Examples of the precursor are described in JP-A 1-138556. The auxiliary developing agent is dissolved in water or an appropriate solvent such as alcohols, acetone, dimethylformamide, and glycols. Alternatively, the compound may be contained in a solid fine particle dispersion, or by dissolving in a high boiling solvent such as tricresyl phosphate and dispersing in a binder. The auxiliary developing agent precursor may be used in combination of two or more precursors or with an auxiliary developing agent.

Thermal Development

One of the preferred embodiments of processing photographic materials used in the invention is thermal development. In thermal development preferably employed is a processing material different from conventional photographic materials. As one embodiment of the processing material is a sheet comprising a support having thereon a processing layer containing a base and/or base precursor. The processing layer preferably comprises a hydrophilic binder. After being imagewise exposed, the photosensitive layer of the photographic material is laminated to the processing layer of the processing material and then subjected to heating to form images. It is preferred that water in an amount of 1/10 to 1 times the water necessary for the maximum swelling of all the layers of the photographic material and processing material is supplied to the photographic material or the processing material, both materials are laminated with each other and heated to achieve thermal development. The auxiliary developing agent described above may optionally be occluded into the photographic material or processing material, or it may be coated with water.

Thermal processing of photographic materials is well known in the photographic art. Thermally processable photographic materials and processing thereof are described in "Shashinkogaku no Kiso (Fundamentals of Photographic Engineering)" pages 553–555 (1970, pulished by Corona Corp.); Nebletts, Handbook of Photography and Reprography 7th Ed. page 32–33 (Van Nostrand and Reinhold Co.); U.S. Pat. Nos. 3,152,904, 3,301,678, 3,392,020 and 3,457,075; British Patent 1,131,108 and 1,167,777; and Research Discolosure Vol. 170, 17029, page 9–15 (June, 1978).The heating temperature in the development process is preferably 50 to 250° C., and more preferably 60 to 150° C.

A thermal solvent may be incorporated into the photographic material to promote thermal development. The thermal solvent is a compound capable of being melted on heating and exhibiting action of promoting image formation. The thermal solvent is preferably white solid at ordinary temperature and less volatile on heating. The melting point thereof is preferably 70 to 170° C. Exemplary examples of thermal solvents are polar organic compounds described in U.S. Pat. Nos. 3,347,675 and 3,667,959, including amide derivatives (e.g., benzamide), urea derivatives (e.g., methylurea, ethylene urea), sulfonamide derivatives (e.g., compounds described in JP-B 1-40974 and 4-13701), polyols and sorvitans, and polyethylene glycols. Further examples of the thermal solvent compounds are descried in U.S. Pat. Nos. 3,347,675, 3,438,776, 3,666,477, 3,667,959; RD 17643; JP-A 51-19525, 53-24829, 53-60223, 58-118640, 58-198038, 59-68730, 59-84236, 59-229556, 60-14241, 60-191251, 60-232547, 61-52643, 62-42153, 62-44737, 62-78554, 62-136645, 62-139545, 63-53548, 63-161446, 1-224751, 1-227150, 2-863, 2-120739 and 2-123354. Furthermore preferred examples of the thermal solvents include compounds, TS-1 to TS-21 described in JP-A 2-297548, page 8 upper left column to page 9 upper left column. The thermal solvent may be used alone or in combination thereof.

In the photographic material and/or processing material used in the invention, a base or its precursor is preferably employed to promote silver development or dye forming reaction. Examples of the base precursor include a salt of an organic acid capable of being decarboxylated on heating and base, and a compound capable of releasing an amine on intramolecular nucleophilic reaction, Lossen rearrangement or Beckmann rearrangement, as described in U.S. Pat. Nos. 4,514,493 and 4,657,848, and Kochi Gijutsu No. 5, page 55–86 (Mar. 22, 1991, published by Astech Corp.). There is also preferably employed a technique of producing a base by the combination of a sparingly water-soluble basic metal compound with a compound capable of forming a complex together with water and the metal ion constituting the basic metal compound as medium. The method of producing the base is described in European Patent 210,660 and U.S. Pat. No. 4,740,445. In cases where this method is applied to the present invention, it is preferred that the sparingly water-soluble basic metal compound be incorporated in the photographic material, and the compound capable of forming a complex together with water and the metal ion constituting the basic metal compound be added to the processing material, thereby leading to enhance storage stability of the photographic material.

Processing Material

In addition to containing the base and/or its precursor, the processing material may further have a function of shielding from air at the time of thermal development, preventing volatiles of components from the photographic material, supplying processing components other than the base, or removing unwanted photographic component(s) in the photographic material after processing, or removing unnecessary component material(s) produced during development. Further, the processing material may have a desilvering function. For example, if at least a part of silver halide and/or developed silver is solubilized when an imagewise exposed photographic material and a processing material are laminated to each other prior to processing, a silver halide solvent may be incorporated into the processing material as a fixer.

In the processing material may be employed the same support and binder as in photographic materials. A mordant may be incorporated into the processing material to remove the dye described above. Mordants known in the photographic art can be employed, as described in JP-A 61-88256 page 32–41. JP-A 62-244043 and 62-244036. There may also be employed a polymeric compound capable of accepting a dye. The thermal solvent may be incorporated in the processing material.

The base or its precursor is contained in the processing layer og the processing material. The base includes organic and inorganic bases. Examples of the inorganic bases include alkali metal or alkali earth metal hydroxides (e.g., potassium hydroxide, sodium hydroxide, lithium hydroxide, calcium hydroxide, magnesium hydroxide), phosphates (e.g., dipotassium hydrogen phosphate, disodium hydrogen phosphate, ammonium•sodium hydrogen phosphate, second or third calcium hydrogen phosphate), carbonates (e.g., potassium carbonate, sodium carbonate, sodium hydrogen carbonate, magnesium carbonate), borates (e.g., potassium borate, sodium borate, sodium metaborate), organic acid salts (potassium acetate, sodium acetate, potassiumoxalate, sodium oxalate, potassium tartratem sodium tartrate, sodium malatesodium palmitate, sodium stearate), alkali metal or alkali earth metal acetylides described in JP-A 63-25208.

Examples of organic bases include ammonia, liphatic or aromatic amines (e.g., methylamine, ethylamine, butylamine, n-hexykamine, cyclohexylamine, 2-ethylhexylamine, allylamine, ethylenediamine, 1,4-diaminobutane, hexamethlenediamine, aniline, anisiline, p-toluidine, α-naphthylamine, m-phenylenediamine, 1,8-diaminonaphthalene, benzylamine, phenethylamine, ethanolamine, taurine), secondary amines (e.g., dimethylamine, diethylamine, dibutylamine, diallylamine, N-methylaniline, N-methylbenzylamine, N-methlethanolamine, diethanolamine), tertiary amines (e.g., N-methylmorphorine, N-hydroxyethylmorphorine, N-methylpiperidine, N-hydroxyethylpiperidine, N,N'-dimethylpiperadine, N,N'-dihydroxyethylpiperadine, diazacyalo[2,2,2]octan, N,N-dimethylethanolamine, N,N-dimethylpronolamine, N-methyldiethanolamine, N-methyldipropanolamine, triethanolamine, N,N,N',N'-tetramethylethylenediamine, N,N,N',N'-tetrahydroxyethylethylenediamine N,N,N',N'-tetramethyltrimethylenediamine, N-methylpirolidine), polyamines (diethylenetriamine, triethylenetetraamine, polyethyleneimine, polyallylamine, polyviny lbenzylamine, poly-(N,N-diethylaminoethylmethacrylate), poly-(N,N-dimethylvinylbenzylamine), hydroxyamines (e.g., hydroxyamine, N-hydroxy-N-methylaniline), heterocyclic amine (e.g., pyridine, lutidine, imidazole, aminopyridine, N,N-dimethylaminopyridine, indole, quinoline, isoquinoline, poly-vinylpyridine, poly-2-vinylpyridine), amidines (e.g., monoamidine such as acetoamidine, imidazoline, 2-methylimidazole, 1,4,5,6-tetrahydroxypyrimidine, 2-methyl-1,4,5,6-tetrahydroxypyrimidine, 2-phenyl-1,4,5,6-tetrahydroxypyrimidine, iminopiperazine, diazabicyclononene, diazacycloundecene (DBU)), bis, tris or tetraamidine, guanizines (e.g., water-soluble monoguanizine such as guanizine, dimethylguanidine, tetramethylguanizine, 2-amino-1,4,5-tetrahydoxypyrimidine), water-insoluble mono or bisguanidine, bis, tris or tetraguanidine, quaternaryammonium hydroxides (e.g., tetramethylammonium hydroxide, tetraethylammonium hydroxide, tetrabutylammonium hydroxide, tetrabutylammonium hydroxide, trimethylammonium hydroxide, trioctylmethylammonium hydroxide, and methylpyridinium hydroxide).

Examples of the compound capable of forming a complex with a metal ion constituting the sparing water-soluble basic metal compound, include aminocarboxylic acids such as ethylenediaminetetraacetic acid, nitrilotriacetc acid, diethylenetriaminepentaacetic acid, and their salts; aminophosphonic acids and their salts; pyridylcarboxylic acids such as 2-picolinic acid, pyridine-2,6-dicarboxylic acid, 5-ethyl-2-picolinic acid, and their salts; iminodicarboxylic acids such as benzyliminodiacetic acid and α-picolyliminodiacetic acid, and their salts. The compound capable of forming a complex is preferably in the form of a salt neutralized with an organic base such as guanidine or an alkali metal such as potassium. The base, base precursor, or complex-forming compound is incorporated in an amount of 0.1 to 20 g/m$^2$, and more preferably 0.5 to 10 g/m$^2$. The sparingly water-soluble basic metal compound is preferably incorporated into the photographic material in the form of a metal hydroxide or a metal oxide; and specifically, zinc hydroxide or zinc oxide is preferred.

In the thermal processing of photographic materials, a small amount of water is preferably used to promote development, transfer of processing materials, or diffusion of unwanted materials. Specifically, in cases where the base is allowed to be produced by using the combination of a sparingly water-soluble basic metal compound and a compound capable of forming the metal ion of the basic compound, the use of water is indispensable. There may be employed water containing an inorganic alkali metal salt, organic salt, low boiling solvent, surfactant, antifoggant, a compound which is capable of forming a complex with a sparing water-soluble metal compound, antimold and antifungus. Any water may be employed, including distilled water, tap water, well water and mineral water. In an apparatus for thermally processing photographic materials, water may not be reused or may be cycled and repeatedly reused. In the latter case, water is to contain components leached out of photographic or processing materials. An apparatus or water described in JP-A 63-144354, 63-144355, 62-38460 and 3-210555 may be employed. Water may be provided to both photographic material and processing material. The water amount to be used is preferably from 1/10 to 1 times the amount necessary to allow the total layers of the photographic and processing materials to maximally swell. Preferred examples of the method for providing water are described in JP-A 62-253159 at page (5) and 63-85544. There may be employed a method in which a solvent is confined in microcapsules or a method in which water is included, in the form of a hydrate, in the photographic or processing material. Water to be provide is preferably at a temperature of 30 to 60° C.

Thermally Developing Apparatus

Photographic materials used in the invention can be thermally developed applying known heating means, such as a system of bringing into contact with a heated heat-block or a plane heater, a system of bringing into contact with a heated roller or a heated drum, a system of bringing into contact with an infrared or far-infrared lamp heater, a system of allowing to pass through environment maintained at high temperature, and a system of using high-frequency heating. There may be applied a system in which a layer of exothermic conductive substance such as carbon black is provided on the back-side of a photographoc material or image receiving material and electric current is allowed to flow to produce heat. The exothermic materials described in JP-A 61-145544 may be employed. To the method of laminating a photographic material and a processing material by opposing the photsensitive layer to the processing layer are applicable the method described in JP-A 62-253159 and 61-147244 at page 27. The heating temperature is preferably 70 to 100° C.

Various types of thermal processing apparatuses can be employed in processing photographic materials used in the invention, as described in JP-A 59-75247, 59-177547, 59-18135360-18951, 62-25944, 4-277517, 4-243072, 4-244693, 6-164421 and 6-164422. Examples of a commercially available apparatus include Pictrostat 100/200/300/330/50, Pictrography 3000/200 (all of which are available from Fuji Film Co. Ltd.).

Thermal processing (specifically, bleaching and fixing)

In the thermal processing, a development arrestor is contained in a processing member and function of the development arrestor is allowed to concurrently proceed with development. The development arrestor is a compound capable of neutralizing or reacting a base contained in the layer after completing optimal development to reduce the base concentration to stop development, or a compound capable of acting silver or a silver salt to retard development. Examples thereof include an acid precursor capable of releasing acid on heating, an electrophilic compound capable of causing substitution reaction with a coexisting base on heating, and a nitrogen containing heterocyclic compound or mercapto containing compound and their precursors. Details thereof are described in JP-A 62-253159 at page 31–32. A combination of a mercaptocarboxylic acid zinc salt contained in a photographic material and a complex-forming compound contained in a processing material is advantageously employed, as described in Japanese Patent Application No. 6-190529. Similarly, a print-out preventing agent for silver halide, which is contained in a photographic material, may be allowed to concurrently effectuate its function with development. Examples of the print-out preventing agent include a monohalogen compound described in JP-B 54-164, trihalogen compound described in JP-A 53-46020, a compound containing a halogen attached to an aliphatic carbon atom, as described in JP-A 48-45228, and a polyhalogen compound such as tetrabromxylene described in JP-B 57-8454. Development inhibitors such as 1-phenyl-5-mercaptotetrazole described in British Patent 1,005,144 are also useful. Further, a viologen compound described in Japanese Patent Application No. 6-337531 is useful. The amount of the print-out preventing agent is preferably used in an amount of $10^{-4}$ to 1 mole/mol Ag, and more preferably $10^{-3}$ to $10^{-1}$ mol/mol Ag.

To remove developed silver produced in the photographic material during thermal development, an oxidizing agent capable of bleaching the silver may be contained in the processing material to allow it to react during thermal development. Alternatively developed silver can be removed by laminating a developed photographic material and a second material containing a silver-oxidizing agent. However, bleaching after development is preferred in terms of simplicity in processing.

Conventionally used silver bleaching agents can be employed as a bleaching agent usable in the processing material. Examples thereof are described in U.S. Pat. Nos. 1,315,464 and 1,946,640; and Phtographic Chemistry vol. 2, chapter 30, Foundation Press, London England. The bleaching agent oxidizes photographic silver images to make them soluble. Useful silver bleaching agents include alkali metal bichromates and alkali metal ferricyanates. Preferred bleaching agents are water-soluble, including ninhydrine, indanedione, hexaketocyclohexane, 2,4-dinitrobenzoic acid, bemzoquinone, benzenesulfonic acid, and 2,5-dinitrobenzoic acid. Organic metal complexes are also useful, including cyclohexyldialkylaminotetraacetic acid ferric salt, ethylenediaminetetraacetic acid ferric salt and ferric citrate. The same binder, support and additive as used in the processing material used for developing the photographic material (i.e., first processing material) are usable in the second processing material. The coating amount of a bleaching agent, depending of the silver coverage of the photographic material to be laminated, is preferably within the range of 0.01 to 10 mole per mole of coating silver, more preferably 0.1 to 3 mole/mole of silver and still more preferably 0.1 to 2 mol/mole of silver.

A compound capable of fixing may be incorporated in a processing material to remove unwanted silver halide after image formation. One of such systems is that physical development nuclei and a silver halide solvent are allowed to be included in a processing material, and silver halide contained in a photographic material is solubilized during heating and fixed in the processing material. In this case, solubilized silver salt is diffused from the photographic material to the physical development nuclei and reduced to form physically developed silver therein. Physical development nuclei known in the photographic art are usable, including heavy metals such as zinc, mercury, lead, cadmium, iron, chromium, nickel, tin, cobalt, copper and ruthenium; noble metals such as palladium, platinum, silver and gold; and colloidal particles of chalcogen compounds such as sulfur, selenium and tellurium. Physical development nuclei can be prepared in such manner that corresponding metal ions are reduced with a reducing agent such as ascorbic acid, sodium boron hydride or hydroquinone to form metal colloid dispersion, or are mixed with an aqueous-soluble sulfide, selenide or telluride solution to form a colloidal dispersion of metal sulfide, metal selenide or metal telluride. It is preferred that the dispersion is formed in a hydrophilic binder such as gelatin. Preparation of colloidal silver is described in U.S. Pat. No. 2,688,601. Desalting known in the preparation of silver halide emulsions may optionally be conducted to remove soluble salts. The size of the physical development nuclei is preferably 2 to 200 nm in diameter. The physical development nuclei are conventionally contained in the processing material in an amount of $10^{-3}$ to 100 mg/m$^2$, and more preferably $10^{-2}$ to 10 mg/m$^2$. The physical development nuclei may separately be prepare and added to a coating solution. Alternatively, the physical development nuclei may be prepared by reacting silver nitrate and sodium sulfide, or gold chloride and a reducing agent in a coating solution containing ahydrophilic binder. As the physical development nuclei is preferably employed silver, silver sulfide or palladium sulfide.

To fix silver halide in such a manner as decribed above, a reducing agent necessarily be present to cause physical development in the layer containing physical development nuclei. A non-diffusable reducing agent is to be contained in said the layer, but a diffusable reducing agent may be contained in any layer of the photographic materia and processing material. As the reducjg agent having such a function are preferably employed auxiliary developing agents afore-mentioned.

Silver halide may be fixed without using physical development nuclei and a reducing agent. In this case, it is desirable that silver halide be converted to non-photosensitive silver salt with a silver halide solvent.

In either case are employed silver halide solvents known in the photographic art. Specifically, compounds known as a fixing agent are preferably employed.

Examples of silver halide solvents usable in the invention include thiosulfates, sulfites, thiocyanates, thioether compounds, mercapto compounds, thiouracils, nitrogen and sulfide group containing heterocyclic compounds described JP-A 4-365037 at page 11–21, JP-A 5-66540 at page 1088–1092; mesoion type compounds, nitrogen containing heterocyclic compounds such as tetrazaindenes, uracils and benzotriazoles; hydantoins.

Examples of silver halide solvents usable in the invention include thiosulfates, sulfites, thiocyanates, thioether compounds such as 1,8-di-3,6-dithiaoctane, 2,2'-thiodiethanol and 6,9-dioxa-3,12-dithiatetradecane-1,14-diol as described in JP-b 48-11386, 5- or 6-membered imido-ring compounds such as hydantoin, mercapto compounds, thiouracils, nitrogen and sulfide group containing heterocyclic compounds described JP-A 4-365037 at page 11–21, JP-A 5-66540 at page 1088–1092; mesoion type compounds, nitrogen containing heterocyclic compounds such as tetrazaindenes, uracils and benzotriazoles, and compounds represented by general formula (I) described in JP-A 53-144319. There are also preferred trimethylazolium thiorate or mesoion thiorate compounds described Analytica Chemica Acta vol. 248 page 604–614 (1991). Compounds capable of fixing silver halide and stabilize, as described in Japanese Patent Application No. 6-206331 are usable as a silver halide solvent. Of the compounds described above, sulfites and 5- or 6-membered imido-ring containing compounds such as uracil and hydantoin are specifically preferred. Specifically, when uracil or hydantoin is added in a potassium salt, reduction in glossiness of the processing material during storage is improved.

The silver halide solvent to be contained in the processing layer is preferably 0.01 to 100 mmole/m$^2$, more preferably 0.1 to 50 mmole/m$^2$, and still more preferably 1 to 30 mmole/m$^2$. The molar ratio of the solvent to the coating silver amount is preferably from 1/20 to 20, more preferably from 1/10 to 10, still more preferably from 1/3 to 3. The silver halide solvent may be dissolved in water or a solvent such as methanol, ethanol, acetone, dimethylformamide or methylpropyl glycol, or an alkaline or acidic solution; or may be added in the form of a solid particle dispersion.

The processing material used in the invention may have at least a timing layer. The timing layer has a function of retarding bleaching reaction and fixing reaction until desired reaction of silver halide and a developing agent, and further with a coupler are substantially completed. The timing layer is comprised of gelatin, polyvinyl alcohol or polyvinyl alcohol-polyvinyl acetate. This layer may be a barrier timing layer described in U.S. Pat. Nos. 4,056,394, 4,061,496 and 4,229,516.

In the thermal processing in the invention, two or more function-separated processing materials, such as a processing material for thermal developing and a processing material for bleaching and/or fixing (hereinafter, referred to as a second processing material), each may successively be laminated with a photographic material to be subjected to heating treatment, wherein the processing material for developing preferably has no compound capable of bleaching or fixing. After laminated with the processing material for developing to be heated, the photographic material and the second processing material are laminated preferably by opposing a photosensitive layer to a processing layer. In this case, water is given in advance to the photographic material or the processing material, in an amount of 0.1 to 1 times the amount necessary to swell the total layers except for backing layer(s) of both materials. Bleaching or fixing is conducted by heating at a temperature of 40 to 100° C. for 5 to 60 sec. at this state. The amount or kind of water, and a method of providing water or laminating the photographic material and processing material are the same as in the processing material for developing.

In cases where processed photographic materials are used for storage or enjoyment over a long period of time, bleaching and fixing treatments described above are preferred. However, in cases where after processed, the photographic material is immediately read with a scanner to be transformed to electronic images, the bleaching and fixing treatments are not necessarily needed. It is conventionally preferred to be subjected to the fixing treatment, because remaining silver halide has absorption in the visible region, which becomes a noise source in reading with a scanner, adversely affecting electronic images. To conduct simple development without fixing treatment, the use of thin tabular silver halide grains or silver chloride grains is preferred. The use of silver chloride grains is specifically preferred.

Other Adjuvants

Various types of surfactants may be employed in the photographic or processing material for the purpose of coating aid, anti-peeling, lubrication improvement, antistatic and development acceleration. Exemplary examples of the surfactants are described in Kochi Gijutsu (Mar. 22, 1991, published by Astech Corp.) at page 136–138; and JP-A 62-173463 and 62-183457. Organic fluoro compounds may be incorporated in the photographic material to achieve an improvement in anti-slippage, antistatic, or peeling property. Exemplary examples of the organic fluorine compounds are described in JP-B 57-9053, and JP-A 61-20944 and 62-135826, including fluorine-containing surfactants, hydrophobic fluoro-compounds such as oily fluoro-compounds, e.g., fluorine oil, or solid fluoro-compound resins, e.g., tetrafluoroethylene resin.

The photographic material and processing materials used in the invention preferably is to be lubricate. A lubricant may be incorporated in both of the photosensitive layer-side and the backing layer-side. Preferred lubrication is from 0.01 to 0.25 in terms of a coefficient of kinetic friction, which is measure by sliding a stainless steel ball of 5 mm in diameter at a speed of 60 cm/min. in an atmosphere of 25° C. and 60% RH. In this case, even when changed to the photosensitive layer-side, the observed values are at a similar level. Usable lubricants include polyorganosiloxane such as polydimethylsiloxane, polydiethylsiloxane, polystyrylmethylsiloxane or polymethylphenylsiloxane; higher fatty acid amide; higher fatty acid metal salt; and an ester of a higher fatty acid and a higher alcohol. The lubricant is preferably incorporated into an emulsion layer or a backing layer. Specifically, polydimethylsiloxane and an ester having a long chain alkyl group are preferred.

Antistatic agents are preferably employed in the photographic and processing materials. Examples of preferred antistatic agents include a polymer containing a carboxylic acid group or its salt, or a sulfonic acid salt group; cationic polymer; and ionic surfactant compounds. More preferred antistatic agents include crystalline metal oxide selected from the group of ZnO, $TiO_2$, $SnO_2$, $Al_2O_3$, $In_2O_3$, $SiO_2$, MgO, BaO, $MoO_3$ and $V_2O_5$, including their composite oxides (containing Sb, P, B, Ins, Si or C), each of which has a volume resistance of not more than $10^7\Omega\cdot$cm (more preferably, not more than $10^5\Omega\cdot$cm) and a particle size of 0.001 to 1.0 $\mu$m, in the form of fine particles or sol. The antistatic agent is preferably incorporated in the photographic material, in an amount of 5 to 500 mg/m$^2$, and more preferably 10 to 350 mg/m$^2$. The weight ratio of the conductive crystalline oxide or its composite oxide to a binder is preferably 1/300 to 100/1, and more preferably 1/100 to 100/5.

In the layer of the photographic or processing material (including a backing layer), a polymer latex may be incorporated to improve a physical property of the layer, such as dimensional stability, anti-curl, prevention of adhesion, anti-cracking of the layer and prevention or pressure resistance. Exemplarily, there can be employed polymer latexes described in JP-A 62-245258, 62-136648 and 62-110066. Specifically, the use of a polymer latex having a low glass transition point (preferably, 40° C. or lower) in a mordant layer prevents cracking of the mordant layer, and the use of a polymer latex having a higher glass transition point in the backing layer leads to anti-curling effects.

Matting agents are preferably employed in the photographic or processing material. The matting agent may be incorporated in either one of the emulsion layer-side or the backing layer-side, and preferably in the outermost layer of the emulsion layer-side. The matting agent may be soluble or insoluble in a processing solution, and the combined use of soluble and insoluble polymer latexes is preferred. Preferred examples thereof include particles of polymethyl methacrylate, poly(methyl methacrylate/methacrylic acid) of 9/1 or 5/5 (in molar ratio), and polystyrene. The particle size is preferably 0.8 to 10 $\mu$m and the size distribution is preferably narrow. At least 90% of the total grain number is preferably with the range of 0.9 to 1.1 times. It is preferred to allow fine particles of less than 0.8 $\mu$m to be concurrently incorporated to enhance matting property, such as polymethyl methacrylate (of 0.2 $\mu$m), poly(methyl methacrylate/methacrylic acid) of 9/1 in molar ratio, polystyrene particles (of 0.25 $\mu$m), and colloidal silica (of 0.03 $\mu$m). Further, benzoguanamine resin beads, polycarbonate resin beads and As resin beads are also included, as described in JP-A 63-274944 and 63-274952. Furthermore, compounds described in Research Disclosures are also employed.

Next, film patrone to load photographic material will be described. Main material of patrones used in the invention may be metals or snthetic plastic. Preferred examples of the plastic material include polystyrene, polyethylene, polypropylene and polyphenyl ether. The patrone may contain various kinds of antistatic agents, such as carbon black, metal oxide particles, nonionic, anionic or cationic surfactans and plymers. Static-free patrones are described in JP-A 1-312537 and 1-312538. Specifically, patrones having resistance of not more than $10^{12}\Omega$ at 25° C. and 25% RH. Patrones are conventionally prepared using plastic compounded with carbon black or a colorant for lighttightness. The patrone size may be the present 135-size as such or the cartridge of the 135 size may be changed from 25 mm to 22 mm in diameter. The case volume of the patrone is preferably not more than 30 cm$^3$, and more preferably not more than 25 cm$^3$. The weight of plastic used in the patrone or patrone case is preferably 5 to 15 g.

The patrone used in the invention may be those, in which film is advanced by rotating a spool. Alternatively, the patrone may have such structure that the top of the film, which is loaded inside the patrone, is allowed to advance from the port portion by rotating a spool shaft in the direction of advancing the film. These are described in U.S. Pat. Nos. 4,834,306 and 5,226,613.

Photographic materials used in the invention may be loaded in a commercially available lens-fitted film unit.

EXAMPLES

The present invention will be further described based on examples, but embodiments of the invention are not limited to these examples.

Example 1

A day light-balanced color film sample 101 was prepared in the following manner.

Preparation of Sample 101

The following layers having the composition described below were coated on a subbed cellulose triacetate film support in this order from the support to prepare a multi-layered color photographic material Sample 101.

In the following examples, the addition amount in the silver halide photographic material was expressed in g per m$^2$, unless otherwise noted. The coating amount of silver halide or colloidal silver was represented by equivalent converted to silver. The grain diameter was represented by equivalent cubic edge length. With respect to a sensitizing dye, it was expressed in mol per mol of silver halide contained in the same layer.

| 1st Layer; Antihalation Layer | |
|---|---|
| Black colloidal silver | 0.15 |
| UV absorbent (UV-1) | 0.30 |

-continued

| | |
|---|---|
| High boiling solvent (Oil-1) | 0.16 |
| Gelatin | 1.64 |
| 2nd Layer; Interlayer | |
| Gelatin | 0.80 |
| 3rd layer; Low speed red-sensitive layer | |
| Silver iodobromide emulsion (average grain diameter, 0.20 μm) | 0.44 |
| Silver iodobromide emulsion (average grain diameter, 0.40 μm) | 0.11 |
| Sensitizing dye (SD-1) | $2.6 \times 10^{-5}$ |
| Sensitizing dye (SD-2) | $2.6 \times 10^{-5}$ |
| Sensitizing dye (SD-3) | $3.1 \times 10^{-4}$ |
| Sensitizing dye (SD-4) | $2.3 \times 10^{-5}$ |
| Sensitizing dye (SD-5) | $2.8 \times 10^{-4}$ |
| Cyan coupler (C-1) | 0.35 |
| Colored cyan coupler (CC-1) | 0.065 |
| Compound (GA-1) | $2.0 \times 10^{-3}$ |
| High boiling solvent (Oil-1) | 0.33 |
| Gelatin | 0.73 |
| 4th Layer; Medium Speed Red-sensitive Layer | |
| Silver iodobromide emulsion (average grain diameter, 0.40 μm) | 0.39 |
| Sensitizing dye (SD-1) | $1.3 \times 10^{-4}$ |
| Sensitizing dye (SD-2) | $1.3 \times 10^{-4}$ |
| Sensitizing dye (SD-3) | $2.5 \times 10^{-4}$ |
| Sensitizing dye (SD-4) | $1.8 \times 10^{-5}$ |
| Cyan coupler (C-1) | 0.24 |
| Colored cyan coupler (CC-1) | 0.040 |
| DIR compound (D-1) | 0.025 |
| Compound (GA-1) | $1.0 \times 10^{-3}$ |
| High boiling solvent (Oil-1) | 0.30 |
| Gelatin | 0.59 |
| 5th Layer; High Speed Red-sensitive Layer | |
| Silver iodobromide emulsion (average grain diameter, 0.55 μm) | 0.91 |
| Sensitizing dye (SD-1) | $8.5 \times 10^{-5}$ |
| Sensitizing dye (SD-2) | $9.1 \times 10^{-5}$ |
| Sensitizing dye (SD-3) | $1.7 \times 10^{-4}$ |
| Sensitizing dye (SD-4) | $2.3 \times 10^{-5}$ |
| Cyan coupler (C-2) | 0.10 |
| Colored cyan coupler (CC-1) | 0.014 |
| DIR compound (D-1) | $7.5 \times 10^{-3}$ |
| Compound (GA-1) | $1.4 \times 10^{-3}$ |
| High boiling solvent (Oil-1) | 0.12 |
| Gelatin | 0.53 |
| 6th Layer; Interlayer | |
| Gelatin | 1.14 |
| 7th Layer; Low Speed Green-sensitive Layer | |
| Silver iodobromide emulsion (average grain diameter, 0.40 μm) | 0.32 |
| Silver iodobromide emulsion (average grain diameter, 0.30 μm) | 0.74 |
| Sensitizing dye (SD-6) | $5.5 \times 10^{-4}$ |
| Sensitizing dye (SD-1) | $5.2 \times 10^{-5}$ |
| Sensitizing dye (SD-11) | $4.8 \times 10^{-5}$ |
| Magenta coupler (M-1) | 0.15 |
| Magenta coupler (M-2) | 0.37 |
| Colored magenta coupler (CM-1) | 0.20 |
| DIR compound (D-2) | 0.020 |
| Coinpound (GA-1) | $4.0 \times 10^{-3}$ |
| High boiling solvent (Oil-2) | 0.65 |
| Gelatin | 1.65 |
| 8th Layer; High Speed Green-sensitive Layer | |
| Silver iodobromide emulsion (average grain diameter, 0.62 ∞m) | 0.79 |
| Sensitizing dye (SD-7) | $1.4 \times 10^{-4}$ |
| Sensitizing dye (SD-8) | $1.5 \times 10^{-4}$ |
| Sensitizing dye (SD-9) | $1.4 \times 10^{-4}$ |
| Sensitizing dye (SD-11) | $7.1 \times 10^{-5}$ |
| Magenta coupler (M-2) | 0.065 |
| Magenta coupler (M-3) | 0.025 |
| Colored magenta coupler (CM-2) | 0.025 |

-continued

| | |
|---|---|
| DIR compound (D-3) | $7.0 \times 10^{-4}$ |
| Compound (GA-1) | $1.8 \times 10^{-3}$ |
| High boiling solvent (Oil-2) | 0.15 |
| Gelatin | 0.46 |
| 9th Layer; Yellow Filter Layer | |
| Yellow colloidal silver | 0.10 |
| Compound (SC-1) | 0.14 |
| Compound (FS-1) | 0.20 |
| High boiling solvent (Oil-2) | 0.18 |
| Gelatin | 1.20 |
| 10th Layer; Low Speed Blue-sensitive Layer | |
| Silver iodobromide emulsion (average grain diameter, 0.40 μm) | 0.17 |
| Silver iodobromide emulsion (average grain diameter, 0.30 μm) | 0.20 |
| Sensitizing dye (SD-10) | $5.4 \times 10^{-4}$ |
| Sensitizing dye (SD-11) | $2.0 \times 10^{-4}$ |
| Yellow coupler (Y-1) | 0.62 |
| Yellow coupler (Y-2) | 0.31 |
| Compound (GA-1) | $4.5 \times 10^{-3}$ |
| High boiling solvent (Oil-2) | 0.20 |
| Gelatin | 1.27 |
| 11th Layer; High Speed Blue-sensitive Layer | |
| Silver iodobromide emulsion (average grain diameter, 0.65 μm) | 0.66 |
| Yellow coupler (Y-1) | 0.10 |
| Compound (GA-1) | $2.0 \times 10^{-3}$ |
| High boiling solvent (Oil-2) | 0.04 |
| Gelatin | 0.57 |
| 12th Layer; First Protective Layer | 0.30 |
| Silver iodobromide emulsion (Av. grain size of 0.04 μm, 4 mol % iodide) | |
| UV absorbent (UV-2) | 0.030 |
| UV absorbent (UV-3) | 0.015 |
| UV absorbent (UV-4) | 0.015 |
| UV absorbent (UV-5) | 0.015 |
| UV absorbent (UV-6) | 0.10 |
| Compound (FS-1) | 0.25 |
| High boiling solvent (Oil-1) | 0.07 |
| High boiling solvent (Oil-3) | 0.07 |
| Gelatin | 1.04 |
| 13th Layer; Second Protective Layer | |
| Alkali-soluble matting agent (Av. 2 μm) | 0.15 |
| Polymethylmethacrylate (AV. 3 μm) | 0.04 |
| Lubricant (WAX-1) | 0.04 |
| Gelatin | 0.55 |

In addition to the above composition were added coating aid compounds (SU-1, and 2), viscosity-adjusting agent, hardener (H-1 and 2), dyes (AI-1 and 2), stabilizer (ST-1), fog restrainer (AF-1) and antimold (DI-1).

The structure of each of the compounds used in the sample is as follows:

Oil-1: Di(2-ethylhexyl)phthalate

Oil-2: Tricresyl phosphate

Oil-3: Dibutyl phthalate

GA-1: Dodecyl gallate

SC-1: 2-Methyl-5-octadecylhydroquinone

FS-1: 1-(3-Sulfophenyl)-3-methyl-5-imino-2-pyrazoline

SU-1: Dioctyl sulfosuccinate sodium salt

SU-2: Sodium tri-i-propylnaphthalene sulfonate

H-1: 2,4-Dichloro-6-hydroxy-s-triazine sodium salt

H-2: Bis(vinylsulfonylmethyl) ether

ST-1: 4-Hydroxy-6-methyl-1,3,3a,7-tetrazaindene

Af-1: 1-Phenyl-5-mercaptotetrazole

C-1
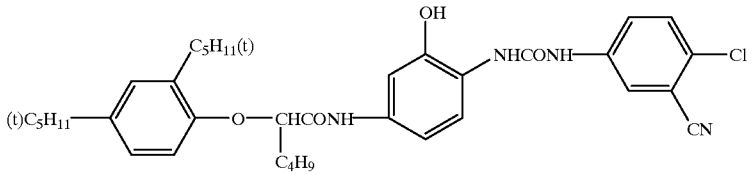
C-2
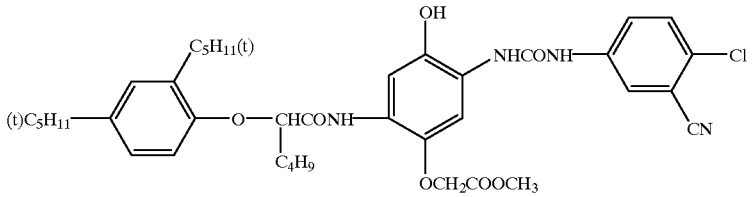
M-1
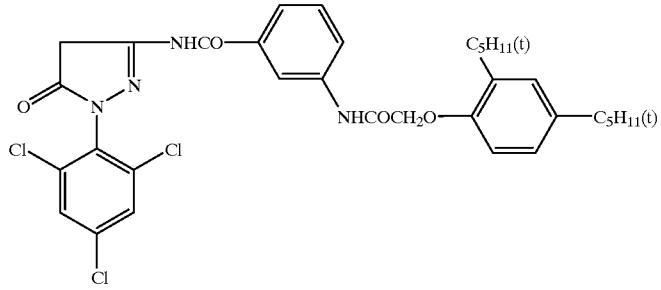
M-2
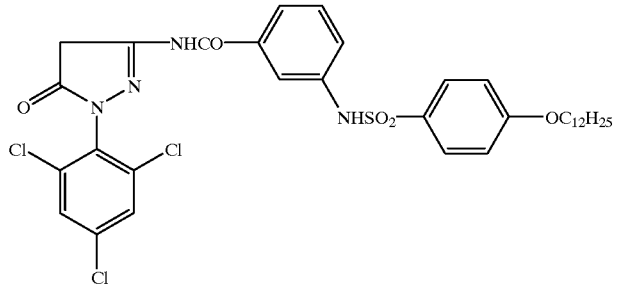
M-3
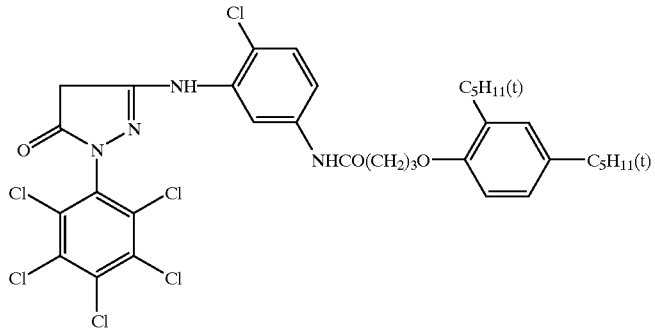

-continued
Y-1
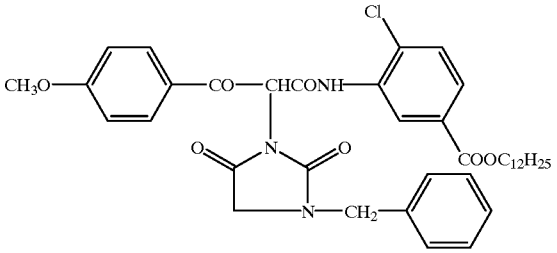
Y-2
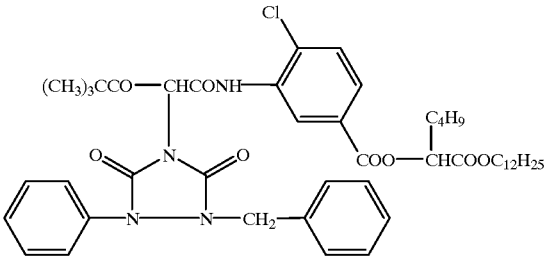
CC-1
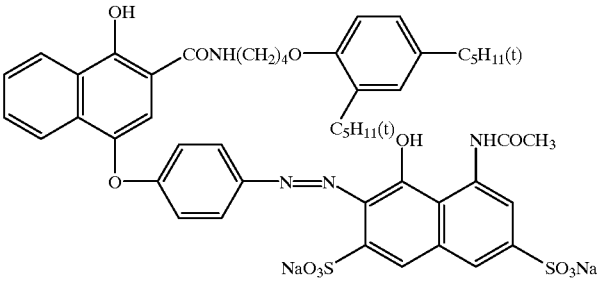
CM-1
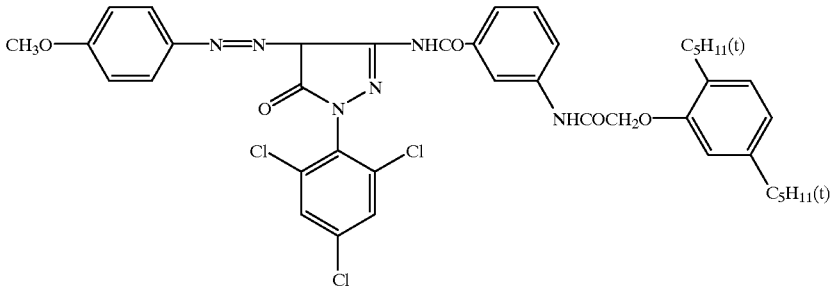
CM-2
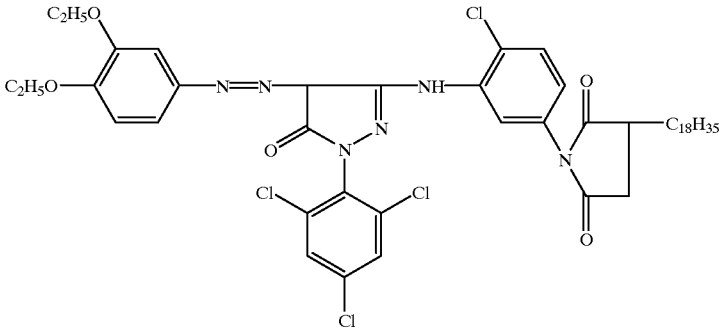

-continued
D-1
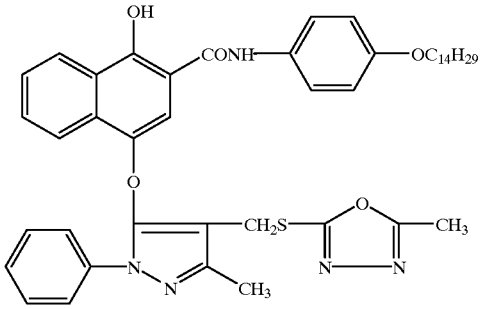
D-2
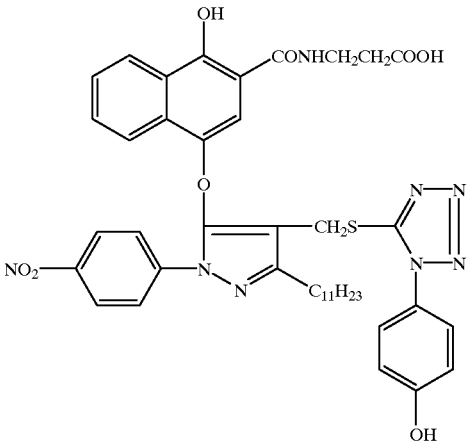
D-3
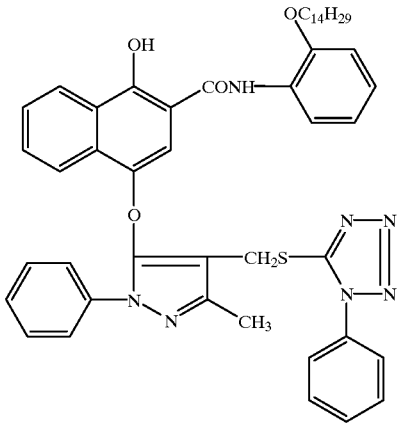
UV absorbent
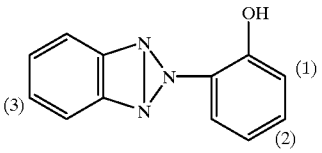
| | (1) | (2) | (3) |
|---|---|---|---|
| UV-1 | —$C_{12}H_{25}$ | —$CH_3$ | —H |
| UV-2 | —H | -(t)$C_4H_9$ | —H |
| UV-3 | -(t)$C_4H_9$ | -(t)$C_4H_9$ | —H |
| UV-4 | -(t)$C_4H_9$ | —$CH_3$ | —Cl |
| UV-5 | -(t)$C_4H_9$ | -(t)$C_4H_9$ | —Cl |

-continued
UV-6
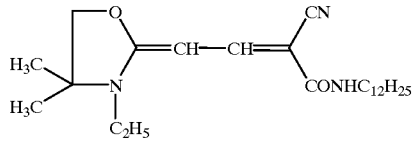
SD-1
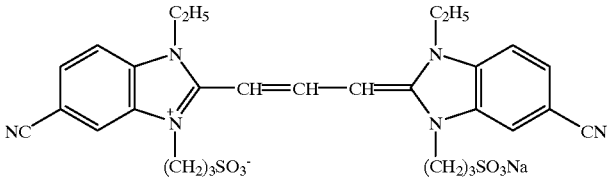
SD-2
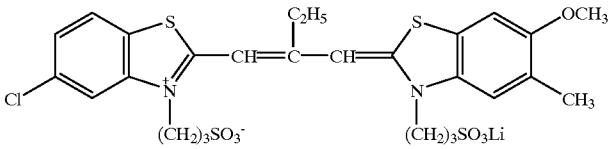
SD-3
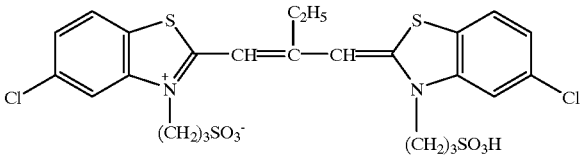
SD-4
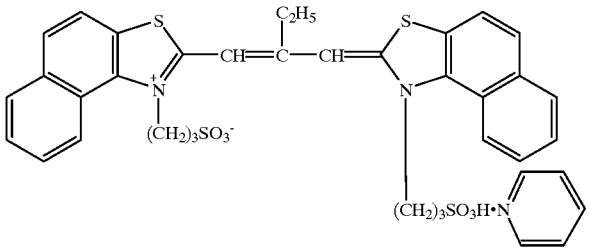
SD-5
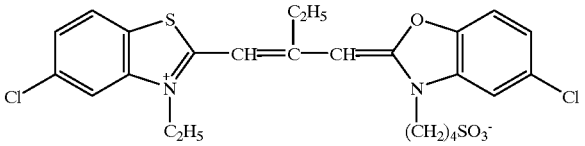
SD-6
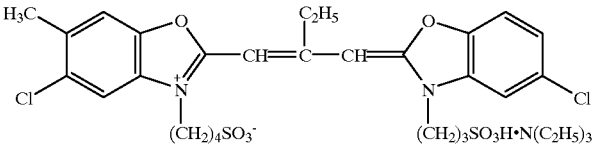
SD-7
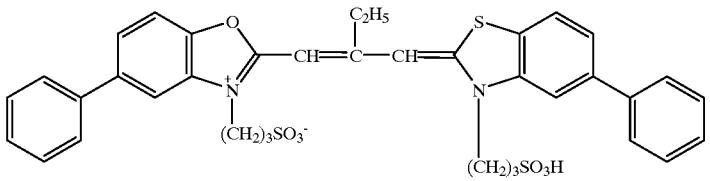

-continued
SD-8
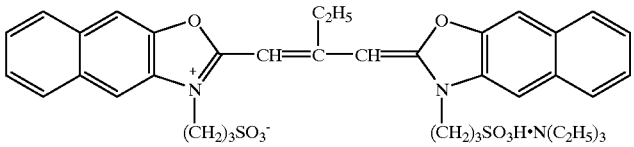
SD-9
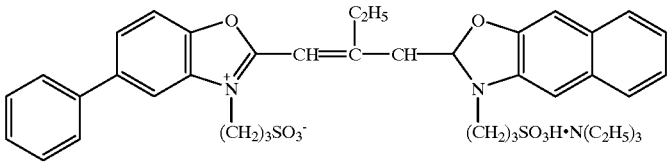
SD-10
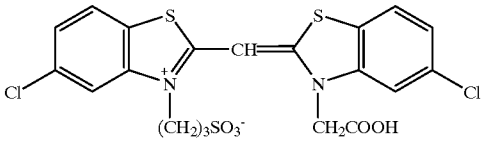
SD-11
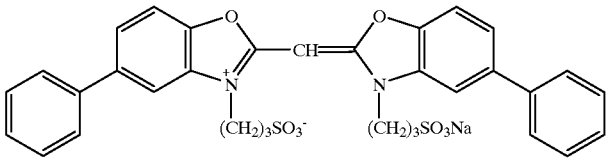
AI-1
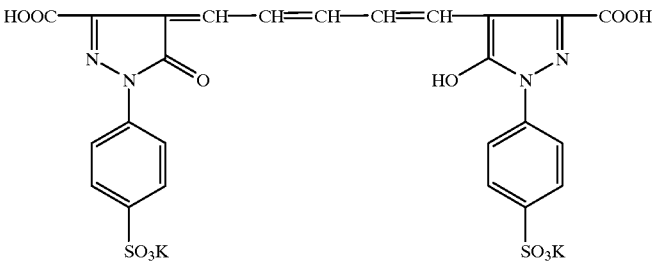
AI-2
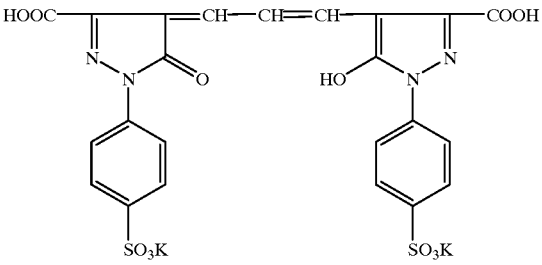
WAX-1
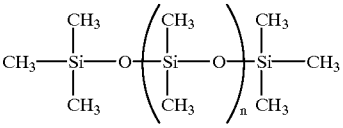
Weight-averaged molexular weight MW: 3,000

-continued

DI-1

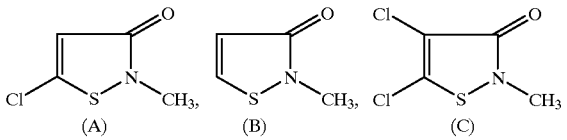

(A) (B) (C)

A:B:C = 50:46:4 (molar ratio)

Preparation of Sample 102

Photographic material Sample 102 was prepared in the same manner as Sample 1-1, except that silver halide emulsions were changed as below:

| | |
|---|---|
| 3rd layer; Low speed red-sensitive layer | |
| Silver iodobromide emulsion (average grain diameter, 0.20 μm) | 1.10 |
| Silver iodobromide emulsion (average grain diameter, 0.40 μm) | 0.275 |
| 4th Layer; Medium Speed Red-sensitive Layer | |
| Silver iodobromide emulsion (average grain diameter, 0.40 μm) | 0.975 |
| 5th Layer; High Speed Red-sensitive Layer | |
| Silver iodobromide emulsion (average grain diameter, 0.55 μm) | 2.275 |
| 7th Layer; Low Speed Green-sensitive Layer | |
| Silver iodobromide emulsion (average grain diameter, 0.40 μm) | 0.8 |
| Silver iodobromide emulsion (average grain diameter, 0.30 μm) | 1.85 |
| 8th Layer; High Speed Green-sensitive Layer | |
| Silver iodobromide emulsion (average grain diameter, 0.62 μm) | 1.975 |
| 10th Layer; Low Speed Blue-sensitive Layer | |
| Silver iodobromide emulsion (average grain diameter, 0.40 μm) | 0.425 |
| Silver iodobromide emulsion (average grain diameter, 0.30 μm) | 0.5 |
| 11th Layer; High Speed Blue-sensitive Layer | |
| Silver iodobromide emulsion (average grain diameter, 0.65 μm) | 1.65 |

Preparation of Sample 103

Photographic material Sample 103 was prepared in the same manner as Sample 1-1, except that silver halide emulsions were changed as below:

| | |
|---|---|
| 3rd layer; Low speed red-sensitive layer | |
| Silver iodobromide emulsion (average grain diameter, 0.20 μm) | 1.54 |
| Silver iodobromide emulsion (average grain diameter, 0.40 μm) | 0.385 |
| 4th Layer; Medium Speed Red-sensitive Layer | |
| Silver iodobromide emulsion (average grain diameter, 0.40 μm) | 1.365 |
| 5th Layer; High Speed Red-sensitive Layer | |
| Silver iodobromide emulsion (average grain diameter, 0.55 μm) | 3.185 |

-continued

| | |
|---|---|
| 7th Layer; Low Speed Green-sensitive Layer | |
| Silver iodobromide emulsion (average grain diameter, 0.40 μm) | 1.12 |
| Silver iodobromide emulsion (average grain diameter, 0.30 μm) | 2.59 |
| 8th Layer; High Speed Green-sensitive Layer | |
| Silver iodobromide emulsion (average grain diameter, 0.62 μm) | 2.765 |
| 10th Layer; Low Speed Blue-sensitive Layer | |
| Silver iodobromide emulsion (average grain diameter, 0.40 μm) | 0.595 |
| Silver iodobromide emulsion (average grain diameter, 0.30 μm) | 0.70 |
| 11th Layer; High Speed Blue-sensitive Layer | |
| Silver iodobromide emulsion (average grain diameter, 0.65 μm) | 2.31 |

Thus prepared photographic materials (Samples 101, 102 and 103) each were cut to the conventional 35 mm negative film size, perforated and loaded in Hexar Camera (available from Konica Corp.); then, five landscape scenes and five portraits were photographed using the camera. Each photographed sample was processed using automatic processor for use in color negative film, CL-KP-50QA (available from Konica Corp.), which was modified to be tranported at a two times speed, according to the following three processing conditions.

Processing A (standard process)

| Step | Time | Temperature |
|---|---|---|
| Color developing | 100 sec. | 42° C. |
| Bleaching | 24 sec. | 38° C. |
| Fixing-1 | 24 sec. | 38° C. |
| Fixing-2 | 24 sec. | 38° C. |
| Stabilizing-1 | 16 sec. | 38° C. |
| Stabilizing-2 | 16 sec. | 38° C. |
| Stabilizing-3 | 15 sec. | 38° C. |
| Total | 3.65 min. | |
| Processing B | | |
| Color developing | 100 sec. | 42° C. |
| Bleaching | 12 sec. | 38° C. |
| Fixing-1 | 12 sec. | 38° C. |
| Fixing-2 | 12 sec. | 38° C. |
| Stabilizing-1 | 16 sec. | 38° C. |
| Stabilizing-2 | 16 sec. | 38° C. |
| Stabilizing-3 | 15 sec. | 38° C. |
| Total | 3.05 min. | |
| Processing C (standard process) | | |
| Color developing | 100 sec. | 42° C. |
| Fixing-1 | 12 sec. | 38° C. |

-continued

| Step | Time | Temperature |
|---|---|---|
| Fixing-2 | 12 sec. | 38° C. |
| Stabilizing-1 | 16 sec. | 38° C. |
| Stabilizing-2 | 16 sec. | 38° C. |
| Stabilizing-3 | 15 sec. | 38° C. |
| Total | 2.85 min. | |

Processing Solution Formula

Coloe developing solution

| | |
|---|---|
| Sodium sulfite | 6.0 g |
| Potassiumcarbonate | 35.0 g |
| N,N-bis(sulfoethyl)hydroxyamine sodium | 8.0 g |
| Pentasodium dietyletriaminepentaacetate | 5.0 g |
| Sodium bromide | $1.1 \times 10^{-2}$ mol/l |
| Polyvinyl pyrrolidone or copolymer | 3.0 g |
| Potassium iodide | $1.2 \times 10^{-5}$ mol/l |
| 4-Amino-3-methyl-N-(,3-hydroxyethyl)-aniline sulfate (exemplified C-3) | 0.035 mol/l |

Water was added to make 1 liter in total, and the pH was adjusted to 10.3 with potassium hydroxide or 50% sulfuric acid.

Bleaching solution

| | |
|---|---|
| Ammonium iron (III) 1,3-diamino-propanetetraacetic acid | 160 g |
| 1,3-Propylenediaminetetraacetic acid | 7 g |
| Ammonium bromide | 60 g |
| Maleic acid | 90 g |

Water was added to make 1 liter in total and the pH was adjusted to 3.0 with ammoniacal water or 50% sulfuric acid.

Fixing solution

| | |
|---|---|
| Ammonium thiocyanate | 130 g |
| Sodium thiosulfate | 20 g |
| Sodium sulfite | 10 g |
| Potassium carbonate | 2 g |
| Sodium ethylenediaminetetraacetate | 2 g |

Water was added to make 1 liter in total and the pH was adjusted to 6.5 with ammoniacal water or 50% sulfuric acid.

Stabilizing solution

| | |
|---|---|
| m-Hydroxybenzaldehyde | 1.5 g |
| Sodium ethylenediaminetetraacetate | 0.2 g |
| Potassium carbonate | 0.2 g |
| β-cyclodextrin | 0.2 g |
| Potassium hydroxide | 0.03 g |

Water was added to make 1 liter in total.

Reading

There were employed a monochromatic CCD camera, an EDC 1000U (having ⅔ inch CCD with 1134×972 pixels) available from ELECTRIM Corp. (Princeton, N.J.), and a lens, Nikkor 60 mm F2.8 available from Nikon Corp. Photographic materials processed according to the photographic processing described above were mounted and set into a slide mount holder (produced by Nikon Corp.) which was attached to the top of the lens. Wratten filters 89B, No. 26*, No. 99* and No. 98* were mounted on a filter wheel and photographing was conducted through each of the filters, while a 500 W incandescent lamp, which was conventionally used for drying, was used as a light source (*: which was used in combination with an infrared cut filter, DR 550 available from Kenko Corp.). Obtained images were subjected to image synthesis processing and silver image-removing processing using Photoshop available from Adobe Corp.

Preparation of Print

Thereafter, using negative film samples, which were subjected to the treatment of removing any remaining silver or not, and a Digital Mini-lab System QD-21 available from Konica Corp., silver salt photographic prints were prepared.

Sensory Examination

Sensory examination of the thus-prepared print samples were made by a panel of ten persons. The prints were evaluated mainly with respect to granularity, based on the following five grades:

5: no perceptible granulation was observed, exhibiting clean and sharp image,

4: partially granulation was observed, but with no perceptible effect on sharpness, 3: slight overall granulation was observed but at an acceptable level for usual practice, 2: marked granulation was observed in some areas and deteriorated sharpness was noticed, and 1: marked and overall granulation was observed in the frame, resulting in an unpleasant print.

Further, the sensory examination results of printed images were evaluated with respect to differences in an average of the sensory examination between a sample having been subjected to the image processing and one not having been subjected to the image processing, or a ratio thereof, based on the following criteria:

| | Difference | Ratio |
|---|---|---|
| A | More than 2.0 | More than 2.0 |
| B | 2.0–1.0 | 2.0–1.0 |
| C | Less than 1.0 | Less than 1.0 |

in which C indicates no effect even when subjected to the image processing; B indicates the image processing being effective; and A indicates excellent exhibited effects.

TABLE 1

| Experiment No. | Photographic material | Processing | Proc. time (min) | Residual silver in Dmax (g/m²) | Residual silver (%) | Image processing Yes | Image processing No | Image processing Ratio | Evaluation |
|---|---|---|---|---|---|---|---|---|---|
| 101 (Comp.) | 101 | A | 3.65 | 0.05 | 2.50 | 4.5 | 4.5 | 1.00 | C |
| 102 (Comp.) | 102 | A | 3.65 | 0.21 | 4.20 | 4.3 | 3.7 | 1.16 | C |

TABLE 1-continued

| Experiment No. | Photographic material | Processing | Proc. time (min) | Residual silver in Dmax ($g/m^2$) | Residual silver (%) | Image processing Yes | Image processing No | Image processing Ratio | Evaluation |
|---|---|---|---|---|---|---|---|---|---|
| 103 (Inv.) | 103 | A | 3.65 | 0.41 | 5.86 | 3.9 | 2.5 | 1.56 | B |
| 104 (Inv.) | 101 | B | 3.05 | 0.69 | 34.50 | 4.6 | 3.3 | 1.39 | B |
| 105 (Inv.) | 102 | B | 3.05 | 1.76 | 35.20 | 4.2 | 2.8 | 1.50 | B |
| 106 (Inv.) | 103 | B | 3.05 | 2.54 | 36.29 | 3.8 | 1.9 | 2.00 | A |
| 107 (Inv.) | 101 | C | 2.85 | 1.97 | 98.50 | 4 | 2.6 | 1.54 | B |
| 108 (Inv.) | 102 | C | 2.85 | 4.96 | 99.20 | 3.8 | 1.5 | 2.53 | A |
| 109 (Inv.) | 103 | C | 2.85 | 6.98 | 99.71 | 3.5 | 1.2 | 2.92 | A |

As can be seen from Table 1, sample prints which were obtained after subjecting them to the image processing to remove residual silver using infrared image information, exhibited superior image quality, compared to those which were obtained without image processing. Even in any one of Processing B, in which the processing time was shortened and Processing C, in which the bleaching step was omitted, sample prints which were obtained by subjecting them to the image processing to remove residual silver using infrared image information, exhibited superior image quality, compared to those which were obtained without subjecting them to the image processing. From the results of photographic materials samples 101, 102 and 103 which were processed according to the standard process (Processing A), it was further noted that in these samples, the residual silver is rather low so that sample prints which were obtained by subjecting them to the image processing to remove residual silver using of infrared image information, did not exhibit markedly superior image quality, compared to those which were obtained without subjecting them to the image processing, however, in Sample 103 in which the residual silver exceeded 5%, deterioration of image quality was observed and enhancements in image quality according to the invention was also proved.

Comparing photographic material sample 103 being higher in residual silver to sample 101 being lower in residual silver, sample prints which were obtained by subjecting them to the image processing to remove residual silver using infrared image information, exhibited superior image quality, compared to those which were obtained without subjecting them to the image processing.

Example 2

Preparation of Seed emulsion T-1

According to the following procedure, a silver halide seed emulsion T-1 comprised of seed grains having two parallel twinned planes.

| Solution A-1 | |
|---|---|
| Ossein gelatin | 38.0 g |
| Potassium bromide | 11.7 g |
| Water to make | 34.0 lit. |

-continued

| Solution B-1 | |
|---|---|
| Silver nitrate | 810.0 g |
| Water to make | 3815 ml |
| Solution C-1 | |
| Potassium bromide | 567.3 g |
| Water to make | 3815 ml |
| Solution D-1 | |
| Ossein gelatin | 163.4 g |
| $CH_3 \cdot HO(CH_2CH_2O)m(CHCH_2O)_{19.8}(CH_2CH_2O)nH$ (m + n = 9.77), 10% methanol solution | 5.5 ml |
| Water to make | 3961 ml |
| Solution E-1 | |
| Nitric acid (10%) | 91.1 ml |
| Solution (F-1) | |
| 56% acetic acid aqueous solution | Necessary amount |
| Solution G-1 | |
| Ammoniacal solution (28%) | 105.7 ml |
| Solution H-1 | |
| Aqueous sodium hydroxide solution (10%) | Necessary amount |

To solution A-1, solution E-1 was added, while vigorously stirring at 30° C. by a stirring apparatus described in JP-A 62-160128; then, solutions B-1 and C-1, 279 ml of each were added at a constant flow rate by the double jet addition over a period of 1 min. to form nucleus silver halide grains.

Then, solution D-1 was added thereto and the temperature was raised to 60° C. in 31 min.; solution G-1 was added and after adjusting the pH to 9.3, ripening was carried out over a period of 6.5 min. Subsequently, the pH was adjusted to 5.8 with solution F-1, and remaining B-1 and C-1 solutions were added by the double jet addition over a period of 37 min. The resulting emulsion was immediately subjected to desalting. From electron microscopic observation, the seed grain emulsion, was comprised of monodispersed tabular grains having two parallel twinned planes, ECD (i.e., equivalent circular diameter) of 0.72 $\mu$m and a variation coefficient of grain size distribution of 16%.

Preparation of Tabualar Grain Emulsion Em-1

Using seed emulsion T-1 and solutions described below, emulsion Em-1 was prepared.

| | |
|---|---|
| Solution A-2 | |
| Ossein gelatin | 519.9 g |
| $CH_3 \cdot HO(CH_2CH_2O)m(CHCH_2O)_{19.8}(CH_2CH_2O)nH$ (m + n = 9.77), 10% methanol solution | 4.5 ml |
| Seed emulsion T-1 | 5.3 mole equivalent |
| Water to make | 18 lit. |
| Solution B-2 | |
| 3.5N Silver nitrate aqueous solution | 2787 ml |
| Solution C-2 | |
| Potassium bromide | 1020 g |
| Potassium iodide | 29.1 g |
| Water to make | 2500 ml |
| Solution D-2 | |
| Potassium bromide | 618.5 g |
| Potassium iodide | 8.7 g |
| Water to make | 1500 ml |
| Solution E-2 | |
| Potassium bromide | 208.3 g |
| Water to make | 1000 ml |
| Solution F-2 | |
| 56% Acetic acid aqueous solution | Necessary amount |
| Solution G-2 | |
| Potassium bromide | 624.8 g |
| Water to make | 1500 ml |
| Solution H-2 | |
| Fine grain emulsion comprised of 3.0 wt.% gelatin and fine silver iodide grains (having ECD of 0.05 $\mu$m) | 0.672 mole equivalent |

The fine grain emulsion was prepared as follows. To 9942 ml of 5.0% gelatin aqueous solution containing 0.254 moles potassium iodide were added 10.59 moles silver nitrate containing solution and 10.59 moles potassium iodide solution at a constant flow rate over a period of 35 min. to form fine grains, while the temperature was maintained at 40° C. anf the pH and EAg were not specifically controlled.

| | |
|---|---|
| Solution I-2 | |
| Aqueous solution containing thiourea oxide of $1.4 \times 10^{-6}$ mole/mole AgX | 10 ml |
| Solution J-2 | |
| Aqueous solution containing sodium ethylthiosulfonate of $2.3 \times 10^{31\ 5}$ mole/mole AgX | 100 ml |
| Solution K-2 | |
| 10% potassium hydroxide aqueous solution | Necessary amount |

To a reaction vessel was added solution A-2 and further added solution I-2, while vigorously stirring at 75° C.; then solutions B-2, C-2 and D-2 were simultaneously added thereto according to the conditions described in Table 2 to allow the seed grains to grow to obtain emulsion Em-1. Taking into account the critical growth rate, the addition of solutions B-2, C-2 and D-2 was acceleratedly varied so that fine grains other than the growing seed grains were mot formed or an increase of the distribution width of grain size did not occurred due to Ostwald ripening between grains.

TABLE 2

| Solution | Add. time (min) | Add. amount (%) | Iodide Content (mol %) | Addition |
|---|---|---|---|---|
| B-2, C-2 | 0.00 | 0.0 | 2.0 | 1st add. |
| | 5.26 | 11.7 | 2.0 | |
| | 8.63 | 21.2 | 2.0 | |
| | 12.65 | 34.8 | 2.0 | |
| | 15.81 | 47.3 | 2.0 | |
| | 19.85 | 65.8 | 2.0 | |
| B-2, D-2 | 0.00 | 65.8 | 1.0 | 2nd add. |
| | 6.23 | 73.8 | 1.0 | |
| | 12.62 | 82.5 | 1.0 | |
| | 18.67 | 91.1 | 1.0 | |
| | 24.42 | 100.0 | 1.0 | |

In the course of growing grains, the temperature, pAg and pH of the reaction mixture in the reaction vessel was controlled at 75° C., 8.9 and 5.8, respectively, during the first addtion, in which 65.8% of solution B-2 were added. Subsequently, solution J-2 was added and the temperature was lowered to 40° C. in 30 min., the pAg was adjusted to 10.3 and solution H-2 was added at a constant flow rate for 2 min.; then, the second addition started. During the second addition, the temperature, pAg and pH were maintained at 40° C., 10.3 and 5.0, respectively and the residue of the solution B-2 was added, while the pAg and pH was controlled using solutions E-2, F-2 and K-2. After completing the grain growth, the emulsion was desalted accordingto the method described in JP-A 5-72658 and redispersed by adding gelatin to obtain emulsion Em-1 with a pAg of 8.06 and a pH of 5.8 at 40 C. As a result of electron microscopic observation, the emulsion was comprised of monodispersed hexagonal tabular silver halide grains having ECD of 1.50 $\mu$m, a variation coefficient of grain size distribution of 14% and an average aspect ratio of 7.0.

Chemical Sensitization and Spectral Sensitization

Emulsion Em-1 was divided to small amount portions. To each of them, optimal amounts of sodium thiocyanate, sodium thiosulfate, triethylthiourea, chloroauric acid, and 1-(3-acetoamidophenyl)-5-mercaptotetrazole (AF-5) were added and ripened at 50 C. After completion of optimal ripening, the emulsions were cooled and stabilizer ST-1 and antifoggant AF-5 were added thereto to obtain red-sensitive silver halide emulsion-1, green-sensitive silver halide emulsion-1 and blu-sensitive silver halide emulsion-1. Sensitizing dyes added to each of the emulsions are as follows, in which the addition amount is per mol of silver halide.

Red-sensitive silver halide emulsion-1

| | |
|---|---|
| Sensitizing dye (SD-1) | 0.04 mmol |
| Sensitizing dye (SD-2) | 0.07 mmol |
| Sensitizing dye (SD-3) | 0.04 mmol |
| Sensitizing dye (SD-4) | 0.13 mmol |
| Green-sensitive silver halide emulsion-1 | |
| Sensitizing dye (SD-5) | 0.04 mmol |
| Sensitizing dye (SD-6) | 0.03 mmol |
| Sensitizing dye (SD-7) | 0.17 mmol |
| Sensitizing dye (SD-8) | 0.02 mmol |
| Sensitizing dye (SD-9) | 0.02 mmol |
| Sensitizing dye (SD-10) | 0.02 mmol |
| Blue-sensitive silver halide emulsion-1 | |
| Sensitizing dye (SD-11) | 0.19 mmol |
| Sensitizing dye (SD-12) | 0.06 mmol |

Preparation of Tabualar Grain Emulsion Em-2

Emulsion Em-2 was prepared similarly to Em-1, which was comprised of monodispersed tabular silver iodobromide grains having ECD of 0.59 μm, a variation coefficient of grain size distribution of 16% and an average aspect ratio of 3.4. The emulsion was further chemically and spectrally sensitized similarly to Em-1 to obtain red-sensitive silver halide emulsion-2, green-sensitive silver halide emulsion-2 and blu-sensitive silver halide emulsion-2. Sensitizing dyes added to each of the emulsions are as follows, in which the addition amount is per mol of silver halide.

| | |
|---|---|
| Red-sensitive silver halide emulsion-2 | |
| Sensitizing dye (SD-1) | 0.08 mmol |
| Sensitizing dye (SD-3) | 0.08 mmol |
| Sensitizing dye (SD-4) | 0.42 mmol |
| Green-sensitive silver halide emulsion-2 | |
| Sensitizing dye (SD-5) | 0.04 mmol |
| Sensitizing dye (SD-6) | 0.15 mmol |
| Sensitizing dye (SD-7) | 0.35 mmol |
| Sensitizing dye (SD-9) | 0.05 mmol |
| Blue-sensitive silver halide emulsion-2 | |
| Sensitizing dye (SD-11) | 0.38 mmol |
| Sensitizing dye (SD-12) | 0.11 mmol |

Preparation of Photographic Material 104

Using the emulsions described above and adjuvants described below, the following photographic component layers having the composition described below were coated on a subbed tranparent PEN base support (85 μm in thick) in this order from the support to prepare a multi-layered color photographic material Sample 104. The addition amount in the silver halide photographic material was expressed in mg per $m^2$, unless otherwise noted. The coating amount of silver halide was represented by equivalent comverted to silver.

| | |
|---|---|
| 1st Layer Layer; Antihalation Layer | |
| Gelatin | 800 |
| UV absorbent (UV-1) | 200 |
| High boiling solvent (Oil-2) | 200 |
| Zinc hydroxide | 500 |
| Dye (AI-1) | 280 |
| Dye (AI-2) | 240 |
| Dye (AI-3) | 400 |
| 2nd Layer; Cyan Dye Forming Layer | |
| Gelatin | 1000 |
| Red sensitive silver halide emulsion-1 | 350 |
| Red sensitive silver halide emulsion-2 | 290 |
| Color developing agent (A-64) | 520 |
| Cyan coupler (C-1) | 230 |
| Cyan coupler (C-2) | 160 |
| High boiling solvent (Oil-1) | 460 |
| High boiling solvent (Oil-2) | 130 |
| Antifoggant (AF-6) | 1 |
| 3rd Layer; Interlayer | |
| Gelatin | 800 |
| Dye (AI-2) | 160 |
| Additive (HQ-2) | 20 |
| High boiling solvent (Oil-2) | 60 |
| Aqueous soluble polymer (PS-1) | 60 |
| Zinc hydroxide | 500 |

-continued

| | |
|---|---|
| 4th Layer; Magenta Dye Forming Layer | |
| Gelatin | 1800 |
| Green sensitive silver halide emulsion-1 | 350 |
| Green sensitive silver halide emulsion-2 | 290 |
| Color developing agent (A-64) | 520 |
| Magenta coupler (M-1) | 400 |
| High boiling solvent (Oil-1) | 460 |
| High boiling solvent (Oil-2) | 90 |
| Antifoggant (AF-6) | 1 |
| Aqueous soluble polymer (PS-1) | 20 |
| 5th Layer; Interlayer | |
| Gelatin | 800 |
| Dye (AI-1) | 320 |
| Additive (HQ-1) | 6 |
| Additive (HQ-2) | 20 |
| High boiling solvent (Oil-1) | 75 |
| Zinc hydroxide | 300 |
| 6th Layer; Yellow Dye Forming Layer | |
| Gelatin | 3200 |
| Blue sensitive silver halide emulsion-1 | 670 |
| Blue sensitive silver halide emulsion-2 | 550 |
| Color developing agent (A-64) | 520 |
| Yellow coupler (Y-1) | 1060 |
| High boiling solvent (Oil-1) | 450 |
| High boiling solvent (Oil-2) | 300 |
| Antifoggant (AF-6) | 2 |
| Aqueous soluble polymer (PS-1) | 40 |
| 7th Layer; Interlayer | |
| Gelatin | 1500 |
| Aqueous polymer (PS-1) | 60 |
| Zinc hydroxide | 700 |
| 8th Layer; Protective Layer | |
| gelatin | 1000 |
| <atting agent (WAX-1) | 200 |
| Aqueous soluble pomer (PS-1) | 120 |

In addition to the above composition were added coating aid compounds SU-1, SU-2 and SU-3; dispersing aid SU-4; viscosity-adjusting agent V-1; stabilizer ST-1 and ST-2, hardener (H-1 and 2), dyes (AI-i and 2), stabilizer (ST-1), Antifoggants AF-1, AF-2, AF-3, AF-4 and AF-5; and hardeners H-1, H-2, H-3 and H-4. AF-2, AF-3, AF-4 and AF-5 were added to each layer, in a total amount of 15.0 mg/$m^2$, 60.01 mg/$m^2$, 50.0 mg/$m^2$ nd 10.0 mg/$m^2$.

ST-2

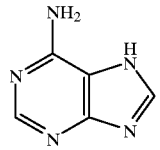

AF-2

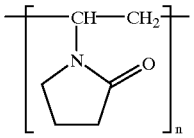

Mw≈100,000

*n*:Polymerization degree

-continued

AF-3

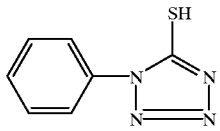

AF-4

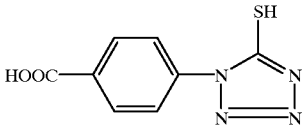

AF-5

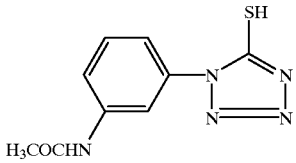

SU-3

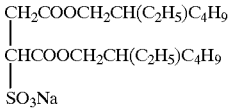

SU-4

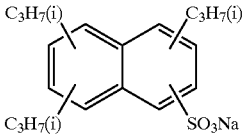

H-3

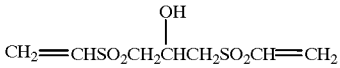

H-4

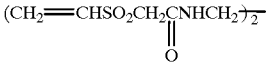

Antimold (F-2)

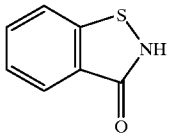

Antimold (F-3)

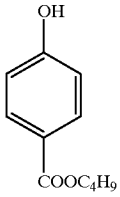

-continued

Antimold (F-4)

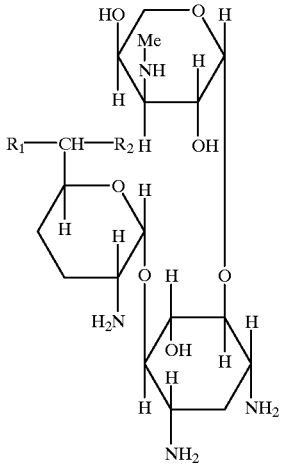

| | $R_1$ | $R_2$ |
|---|---|---|
| a | —Me | —NHMe |
| b | —Me | —$NH_2$ |
| c | —H | —$NH_2$ |
| d | —H | —NHMe |

Mixture a, b, c, and d (1:1:1:1)

Antimold (F-5)

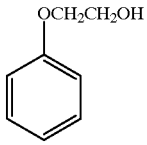

Preparation of Processing Sheet P-1 (Deloping sheet)

The following photographic component layers having the composition described below were coated on a subbed tranparent PEN base support (85 $\mu$m in thick) in this order from the support to prepare a processing sheet P-1. The addition amount in the silver halide photographic material was expressed in mg/m$^2$, unless otherwise noted.

| | |
|---|---|
| 1st Layer | |
| Gelatin | 280 |
| Aqueous soluble polymer (PS-2) | 12 |
| Surfactant (SU-3) | 14 |
| Hardener (H-5) | 185 |
| 2nd Layer | |
| Gelatin | 2400 |
| Aqueous soluble polymer (PS-3) | 360 |
| Aqueous soluble polymer (PS-1) | 700 |
| Aqueous soluble polymer (PS-4) | 600 |
| High boiling solvent (Oil-3) | 2000 |
| Picolinic acid guanidium | 2800 |
| Potassium quinilinate | 225 |
| Sodium quinilinate | 180 |
| Surfactant (SU-3) | 24 |
| 3rd Layer | |
| Gelatin | 240 |
| Aqueous soluble polymer (PS-1) | 24 |
| Hardener (H-5) | 180 |
| Surfactant (SU-3) | 9 |

-continued

| 4th Layer | |
|---|---|
| Gelatin | 220 |
| Aqueous soluble polymer (PS-2) | 60 |
| Aqueous soluble polymer (PS-3) | 200 |
| Potassium nitrate | 12 |
| Matting agent (PM-2) | 10 |
| Surfactant (SU-3) | 7 |
| Surfactant (SU-5) | 7 |
| Surfactant (SU-6) | 10 |

Preparation of Photographic Material 105

Photographic material sample 105 was prepared in the same manner as Sample 104, except that coating amounts of silver halide emulsions were varied as below.

| 2nd Layer; Cyan Dye Forming Layer | |
|---|---|
| Red sensitive silver halide emulsion-1 | 875 |
| Red sensitive silver halide emulsion-2 | 725 |
| 4th Layer; Magenta Dye Forming Layer | |
| Green sensitive silver halide emulsion-1 | 875 |
| Green sensitive silver halide emulsion-2 | 725 |
| 6th Layer; Yellow Dye Forming Layer | |
| Blue sensitive silver halide emulsion-1 | 1675 |
| Blue sensitive silver halide emulsion-2 | 1375 |

Preparation of Photographic Material 106

Photographic material sample 106 was prepared in the same manner as Sample 104, except that coating amounts of silver halide emulsions were varied as below.

| 2nd Layer; Cyan Dye Forming Layer | |
|---|---|
| Red sensitive silver halide emulsion-1 | 1225 |
| Red sensitive silver halide emulsion-2 | 1015 |
| 4th Layer; Magenta Dye Forming Layer | |
| Green sensitive silver halide emulsion-1 | 1225 |
| Green sensitive silver halide emulsion-2 | 1015 |
| 6th Layer; Yellow Dye Forming Layer | |
| Blue sensitive silver halide emulsion-1 | 2345 |
| Blue sensitive silver halide emulsion-2 | 1925 |

The thus prepared photographic materials (Samples 104, 105 and 106) were each cut into conventional 35 mm negative film size, perforated and loaded into a camera; then, five landscape scenes and five portraits were photographed using the camera.

After exposure, warmed water at 40° C. was added to the surface of the photographic material, in an amount of 15 ml/m2. Then the photographic material was overlapped on the layer surface of processing sheet P-1 and heated at 80° C. for 30 sec. using a heated drum. After heating, the photographic material was peel off and neutral wedge-shaped images were obtained and transparent desities were measured with blue, green or red light to obtain characteristic curves. The thus thermally processed samples were evaluated in a manner similar to Example 1, and the results thereof are shown in Table 3.

TABLE 3

| Experiment No. | Photographic material | Processing | Proc. time (min) | Residual silver in Dmax ($g/m^2$) | Residual silver (%) | Image processing Yes | Image processing No | Image processing Ratio | Evaluation*1 |
|---|---|---|---|---|---|---|---|---|---|
| 201 (Inv.) | 104 | Thermal | 0.5 | 0.51 | 9.56 | 4.5 | 3.2 | 1.41 | B |
| 202 (Inv.) | 105 | Thermal | 0.5 | 1.23 | 11.02 | 4.2 | 2.5 | 1.68 | B |
| 203 (Inv.) | 106 | Thermal | 0.5 | 2.42 | 12.36 | 3.9 | 1.5 | 2.60 | A |

As is apparent from Table 3, sample prints which were obtained by subjecting them to the image processing to remove residual silver using of infrared image information, exhibited superior image quality, compared to those which were obtained without subjecting the image processing. Thus, comparing Sample 106, being higher in residual silver to Sample 104, being lower in residual silver, sample prints which were obtained by subjecting them to the image processing to remove residual silver using infrared image information, exhibited superior image quality, compared to those which were obtained without subjecting the image processing.

Example 3

Similarly to Example 1, photographic material samples 101 to 103 were subjected to photographic processing C to form dye images and were then further subjected to image processing to remove residual silver images. The obtained image data was further subjected to image processing A, in which image processing to enhance sharpness was performed using an unsharp mask and then image processing to remove noise was performed using Photoshop plug-in software (available from Konica Corp.). From the thus obtained image data, print samples of A-4 size (210×297 mm) were prepared, and evaluated similarly to Example 1, with respect to image quality, based on sensory examination. Results thereof are shown in Table 4.

TABLE 4

| Experiment No. | Photographic Material | Image Processing Example 1 | Image Processing Image processing A |
|---|---|---|---|
| 301 | 101 | 4.0 | 3.9 |
| 302 | 102 | 3.8 | 3.7 |
| 303 | 103 | 3.5 | 3.7 |

As is apparent from Table 4, although the image data was outputted at A-4 size, with magnifying power increased, images having image quality close to that of Example 1 were obtained through image processing A.

Example 4

Similarly to Example 2, photographic material samples 104 to 106 were subjected to thermal processing to form dye images and were then further subjected to image processing to remove residual silver images. The obtained image data was further subjected to image processing A similarly to Example 3. From the thus obtained image data, print samples of A-4 size (210×297 mm) were prepared, and evaluated similarly to Example 2, with respect to image quality, based on sensory examination, and the results thereof are shown in Table 5.

TABLE 5

| Experiment No. | Photographic Material | Image Processing | |
|---|---|---|---|
| | | Example 2 | Image processing A |
| 401 | 104 | 4.5 | 4.3 |
| 402 | 105 | 4.2 | 4.0 |
| 403 | 106 | 3.9 | 4.0 |

As is apparent from Table 5, although the image data was outputted at A-4 size and with magnifying power increased, images have image quality close to that of Example 3 were obtained through image processing A.

What is claimed is:

1. An image forming method comprising the steps of:

(a) exposing a photographic element comprising a support having on at least one side thereof one or more photographic component layers including a component layer containing light sensitive silver halide and a dye forming coupler and (b) subjecting the exposed photographic element to photographic processing to form a dye image, wherein the photographic processing is allowed to be completed, while the residual silver content in the photographic element, as defined below, is 5% or more, and the method further comprises:

(c) subjecting the processed photographic element to image processing, which comprises (c-1) reading image information in the visible light wavelength region and image information in the invisible light wavelength region corresponding to the residual silver and (c-2) subjecting the read image information to operational calculus to reduce image information due to the residual silver, Residual silver content=(Silver weight per unit area of a maximum exposure portion after subjected to the photographic processing/silver weight per unit area before subjected to the photographic processing)×100.

2. The image forming method of claim 1, wherein in step (b), said exposed photographic element is subjected to the photographic processing by using a processing solution to form a dye image.

3. The image forming method of claim 1, wherein said photographic component layer further contains a developing agent, and in step (b) said exposed photographic element is subjected to thermal processing to form a dye image.

4. The image forming method of claim 1, wherein in step (b), said exposed photographic element is laminated to a processing sheet containing a developing agent and then subjected to thermal processing to form a dye image.

5. The image forming method of claim 1, wherein in step (b), said exposed photographic element is laminated to a processing sheet containing a developing agent and then subjected to thermal processing to form a dye image, and said photographic element being further laminated to a processing sheet containing a bleaching agent to remove a portion of developed silver contained in the photographic element.

6. The image forming method of claim 1, wherein said operational calculus is run based on the following formula:

$$\begin{pmatrix} R' \\ G' \\ B' \end{pmatrix} = \begin{pmatrix} r_1 & g_1 & b_1 & i_1 \\ r_2 & g_2 & b_2 & i_2 \\ r_3 & g_3 & b_3 & i_3 \end{pmatrix} \begin{pmatrix} R \\ G \\ B \\ I \end{pmatrix}$$

where in R, G, B and I represent red, green, blue and invisible input signals, respectively; $r_1$, $r_2$ and $r_3$ independently represent red signal correction coefficient, and $r_1 \geqq 1$; $g_1$, $g_2$ and $g_3$ independently represent green signal correction coefficient, and $g_2 \geqq 1$; $b_1$, $b_2$ and $b_3$ independently represent blue signal correction coefficient, and $b_3 \geqq 1$; $i_1$, $i_2$ and $i_3$ independently represent infrared signal correction coefficient, and $i_1<0$, $i_2<0$ and $i_3<0$; R', G' and B' represent red, green and blue output signals .

7. The image forming method of claim 1, wherein said invisible light is infrared light.

8. The image forming method of claim 7, wherein said operational calculus is run based on the following formula:

$$\begin{pmatrix} R' \\ G' \\ B' \end{pmatrix} = \begin{pmatrix} r_1 & g_1 & b_1 & i_1 \\ r_2 & g_2 & b_2 & i_2 \\ r_3 & g_3 & b_3 & i_3 \end{pmatrix} \begin{pmatrix} R \\ G \\ B \\ I \end{pmatrix}$$

wherein R, G, B and I represent red, green, blue and infrared input signals, respectively; $r_1$, $r_2$ and $r_3$ independently represent red signal correction coefficient, and $r_1 \geqq 1$; $g_1$, $g_2$ and $g_3$ independently represent green signal correction coefficient, and $g_2 1$; $b_1$, $b_2$ and $b_3$ independently represent blue signal correction coefficient, and $b_3 1$; $i_1$, $i_2$ and $i_3$ independently represent infrared signal correction coefficient, and $i_1<0$, $i_2<0$ and $i_3<0$; R', G' and B' represent red, green and blue output signals.

9. The image forming method of claim 1, wherein said photographic component layers comprise at least a red-sensitive silver halide containing layer, at least a green-sensitive silver halide containing layer, at least a blue-sensitive silver halide containing layer and at least a light-insensitive layer.

10. The image forming method of claim 1, wherein at least one of the photographic component layer contains a dye capable of being decolorized or removed when subjected to photographic processing.

11. The image forming method of claim 1, wherein subsequently to step (c), the image information is further subjected to image processing to enhance sharpness, followed by image processing to remove noise due to sharpness enhancement.

12. The image forming method of claim 10, wherein the image processing to enhance sharpness is performed using an unsharp mask.

13. The image forming method of claim 10, wherein the image processing to remove noise is performed using a smoothing filter.

* * * * *